US009353469B2

(12) United States Patent
Meir et al.

(10) Patent No.: US 9,353,469 B2
(45) Date of Patent: May 31, 2016

(54) INDEPENDENTLY CONTROLLED ROLLERS FOR TAKE-DOWN ASSEMBLY OF KNITTING MACHINE

(71) Applicant: NIKE, Inc., Beaverton, OR (US)

(72) Inventors: Adrian Meir, Portland, OR (US); Daniel A. Podhajny, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 14/824,317

(22) Filed: Aug. 12, 2015

(65) Prior Publication Data

US 2015/0345052 A1 Dec. 3, 2015

Related U.S. Application Data

(63) Continuation of application No. 14/607,536, filed on Jan. 28, 2015, now Pat. No. 9,139,938, which is a continuation of application No. 14/524,095, filed on Oct. 27, 2014, now Pat. No. 8,978,422, which is a continuation of application No. 13/781,514, filed on Feb. 28, 2013, now Pat. No. 8,899,079.

(51) Int. Cl.

*D04B 15/90* (2006.01)
*D04B 1/22* (2006.01)
*D04B 15/99* (2006.01)

(52) U.S. Cl.

CPC *D04B 15/90* (2013.01); *D04B 1/22* (2013.01); *D04B 15/99* (2013.01)

(58) Field of Classification Search

CPC ..... D04B 15/88; D04B 15/885; D04B 15/90; D04B 27/34

See application file for complete search history.

(56) References Cited

U.S. PATENT DOCUMENTS 3,618,343 A * 11/1971 Essig ..... D04B 15/90 66/149 R
4,478,058 A * 10/1984 Kazmaier ..... D04B 15/90 66/149 R
4,660,392 A * 4/1987 Stoppazzini ..... D04B 15/90 66/149 R
4,774,820 A * 10/1988 Mestre Mas ..... D04B 15/90 66/149 R
4,854,134 A * 8/1989 Stoppazzini ..... D04B 15/90 66/152
5,133,197 A * 7/1992 Shima ..... D04B 15/90 66/149 R
5,425,251 A * 6/1995 Schmid ..... D04B 15/90 66/149 R
5,870,904 A * 2/1999 Shima ..... D04B 15/90 66/149 R
5,960,646 A * 10/1999 Schmid ..... D04B 15/90 66/149 R
6,029,478 A * 2/2000 Panuccio ..... D04B 15/88 66/149 R
8,899,079 B2 * 12/2014 Meir ..... D04B 15/90 66/150
8,978,422 B2 * 3/2015 Meir ..... D04B 15/90 66/150

* cited by examiner

*Primary Examiner* — Danny Worrell
(74) *Attorney, Agent, or Firm* — Brinks Gilson & Lione

(57) ABSTRACT

A knitting machine includes a take-down assembly that includes a first take-down roller and a second take-down roller. The first take-down roller is configured to rotatably contact and apply tension to a first portion of a knit component. The second take-down roller is configured to rotatably contact and apply tension to a second portion of the knit component. The knitting machine further includes a first actuator that actuates to selectively adjust tension applied by the first take-down roller on the first portion of the knit component. Furthermore, the knitting machine includes a second actuator that actuates to selectively adjust tension applied by the second take-down roller on the second portion of the knit component. Additionally, the knitting machine includes a controller that is operably coupled to the first actuator and the second actuator to selectively and independently control actuation of the first actuator and the second actuator.

20 Claims, 43 Drawing Sheets

INDEPENDENTLY CONTROLLED ROLLERS FOR TAKE-DOWN ASSEMBLY OF KNITTING MACHINE

CROSS-REFERENCE TO RELATED APPLICATION

This application is a continuation of co-pending U.S. patent application Ser. No. 14/607,536, filed Jan. 28, 2015, which is a continuation of U.S. patent application Ser. No. 14/524,095, filed Oct. 27, 2014, now U.S. Pat. No. 8,978,422, which is a continuation of U.S. patent application Ser. No. 13/781,514, filed Feb. 28, 2013, now U.S. Pat. No. 8,899,079, the entire disclosure of each being incorporated herein by reference.

BACKGROUND

Various knitting machines have been proposed that can automate one or more steps in knitting a fabric or other knitted component. For instance, flat knitting machines can include a bed of knitting needles, a carriage, and a feeder. The carriage can move the feeder relative to the needles as the feeder feeds yarn or other strands toward the needles. The needles can, in turn, knit or otherwise form the knitted component from the strands. These actions can repeat until the knitted component is fully formed.

Various components can be produced from such knitted components. For instance, an upper for an article of footwear can be made from the knitted component.

SUMMARY

A knitting machine configured for knitting a knit component having a first portion and a second portion is disclosed. The knitting machine includes a knitting bed with a plurality of knitting needles that are arranged along a longitudinal direction. The knitting bed defines a first knitting area and a second knitting area that are spaced apart in the longitudinal direction. The first knitting area is configured to form the first portion of the knit component, and the second knitting area is configured to form the second portion of the knit component. The knitting machine also includes a feeder assembly that feeds a strand toward the knitting bed to be incorporated into the knit component. Moreover, the knitting machine includes a take-down assembly that includes a first take-down roller and a second take-down roller. The first take-down roller is configured to rotatably contact and apply tension to the first portion of the knit component. The second take-down roller is configured to rotatably contact and apply tension to the second portion of the knit component. The knitting machine further includes a first actuator that is operably coupled to the first take-down roller, and the first actuator is operable to actuate to selectively adjust tension applied by the first take-down roller on the first portion of the knit component. Furthermore, the knitting machine includes a second actuator that is operably coupled to the second take-down roller. The second actuator is operable to actuate to selectively adjust tension applied by the second take-down roller on the second portion of the knit component. Additionally, the knitting machine includes a controller that is operably coupled to the first actuator and the second actuator to selectively and independently control actuation of the first actuator and the second actuator.

Moreover, a method of manufacturing a knit component with a knitting machine is disclosed. The knitting machine defines a first knitting area and a second knitting area that are spaced apart in a longitudinal direction. The first knitting area is configured to form a first portion of the knit component, and the second knitting area is configured to form a second portion of the knit component. The method includes feeding at least one strand toward a knitting bed of the knitting machine to be incorporated into the knit component. The method includes rotating a first take-down roller configured to contact the first portion of the knit component to apply tension to the first portion. The method also includes actuating a first actuator that is operably coupled to the first take-down roller to selectively adjust tension applied by the first take-down roller on the first portion of the knit component. Additionally, the method includes rotating a second take-down roller configured to contact the second portion of the knit component to apply tension to the second portion. Furthermore, the method includes actuating a second actuator that is operably coupled to the second take-down roller to selectively adjust tension applied by the second take-down roller on the second portion of the knit component. Moreover, the method includes controlling actuation of the first actuator and the second actuator independently to independently vary tension applied by the first take-down roller on the first portion and applied by the second take-down roller on the second portion Still further, a knitting machine that is configured to knit a knit component having a first portion and a second portion is disclosed. The knitting machine includes a knitting bed with a plurality of knitting needles that are arranged along a longitudinal direction. The knitting bed defines a first knitting area and a second knitting area that are spaced apart in the longitudinal direction. The first knitting area is configured to form the first portion of the knit component, and the second knitting area is configured to form the second portion of the knit component. Additionally, the knitting machine includes a feeder assembly that feeds a strand toward the knitting bed to be incorporated into the knit component. Furthermore, the knitting machine includes a take-down assembly. The take down assembly includes a first pair of rollers that are configured to receive the first portion therebetween, to rotatably contact the first portion, and to apply tension to the first portion. The take down assembly also includes a first biasing member that biases the first pair of rollers toward each other. Furthermore, the take down assembly includes a first actuator that is operably coupled to the first biasing member. The first actuator is operable to actuate to adjust a biasing load of the first biasing member to adjust tension applied by the first pair of rollers onto the first portion of the knit component. Moreover, the take down assembly includes a second pair of rollers that are configured to receive the second portion therebetween, to rotatably contact the second portion, and to apply tension to the second portion. Still further, the take down assembly includes a second biasing member that biases the second pair of rollers toward each other. A second actuator is also included that is operably coupled to the second biasing member, and the second actuator is operable to actuate to adjust a biasing load of the second biasing member to adjust tension applied by the second pair of rollers onto the second portion of the knit component. Moreover, the take down assembly includes a controller that is operably coupled to the first actuator and the second actuator to selectively and independently control actuation of the first actuator and the second actuator.

The advantages and features of novelty characterizing aspects of the present disclosure are pointed out with particularity in the appended claims. To gain an improved understanding of the advantages and features of novelty, however, reference may be made to the following descriptive matter and accompanying figures that describe and illustrate various configurations and concepts related to the present disclosure.

FIGURE DESCRIPTIONS

The foregoing Summary and the following Detailed Description will be better understood when read in conjunction with the accompanying figures.

DETAILED DESCRIPTION

Figure 1:
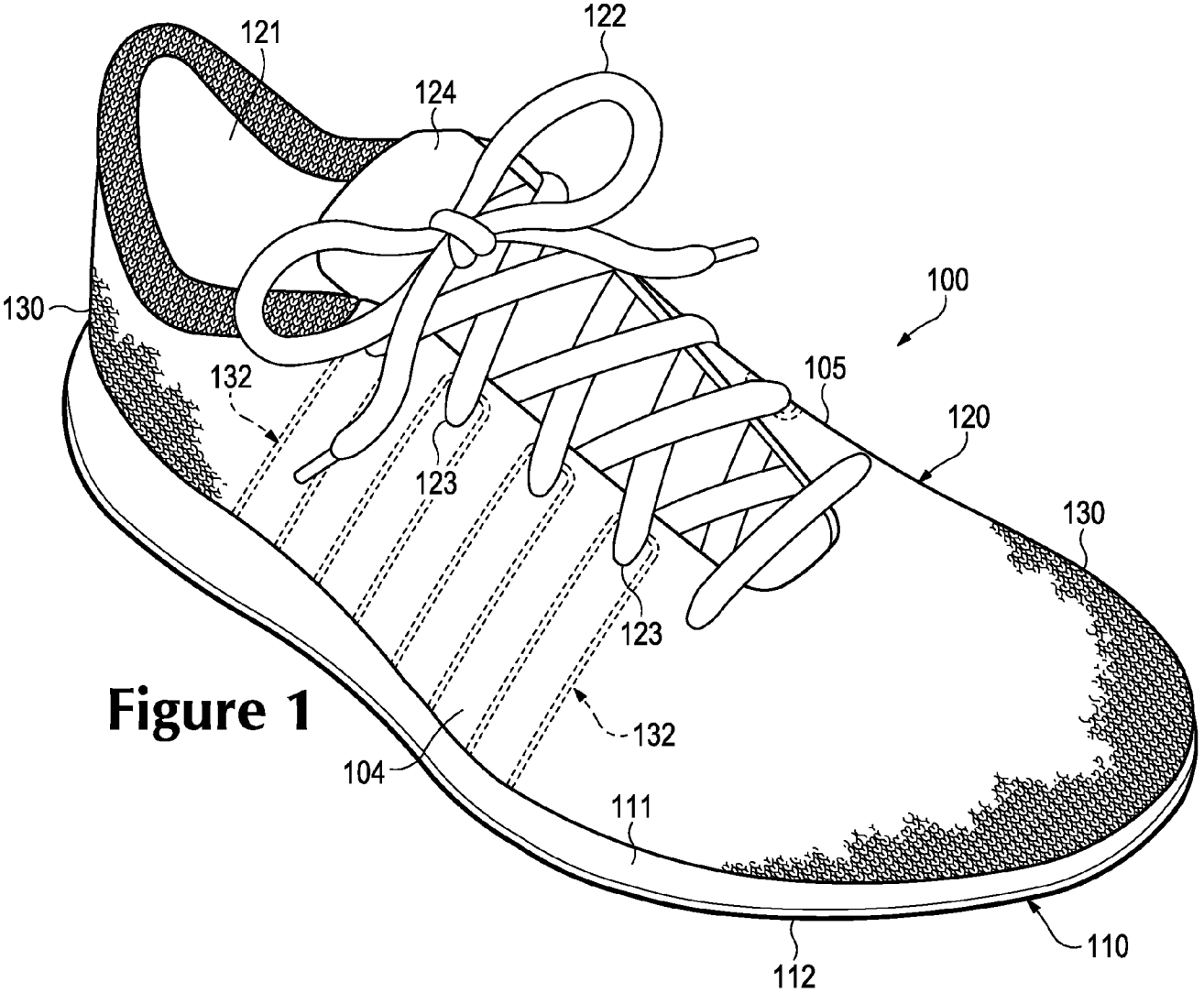
FIG. 1 is a perspective view of an article of footwear.
Figure 2:
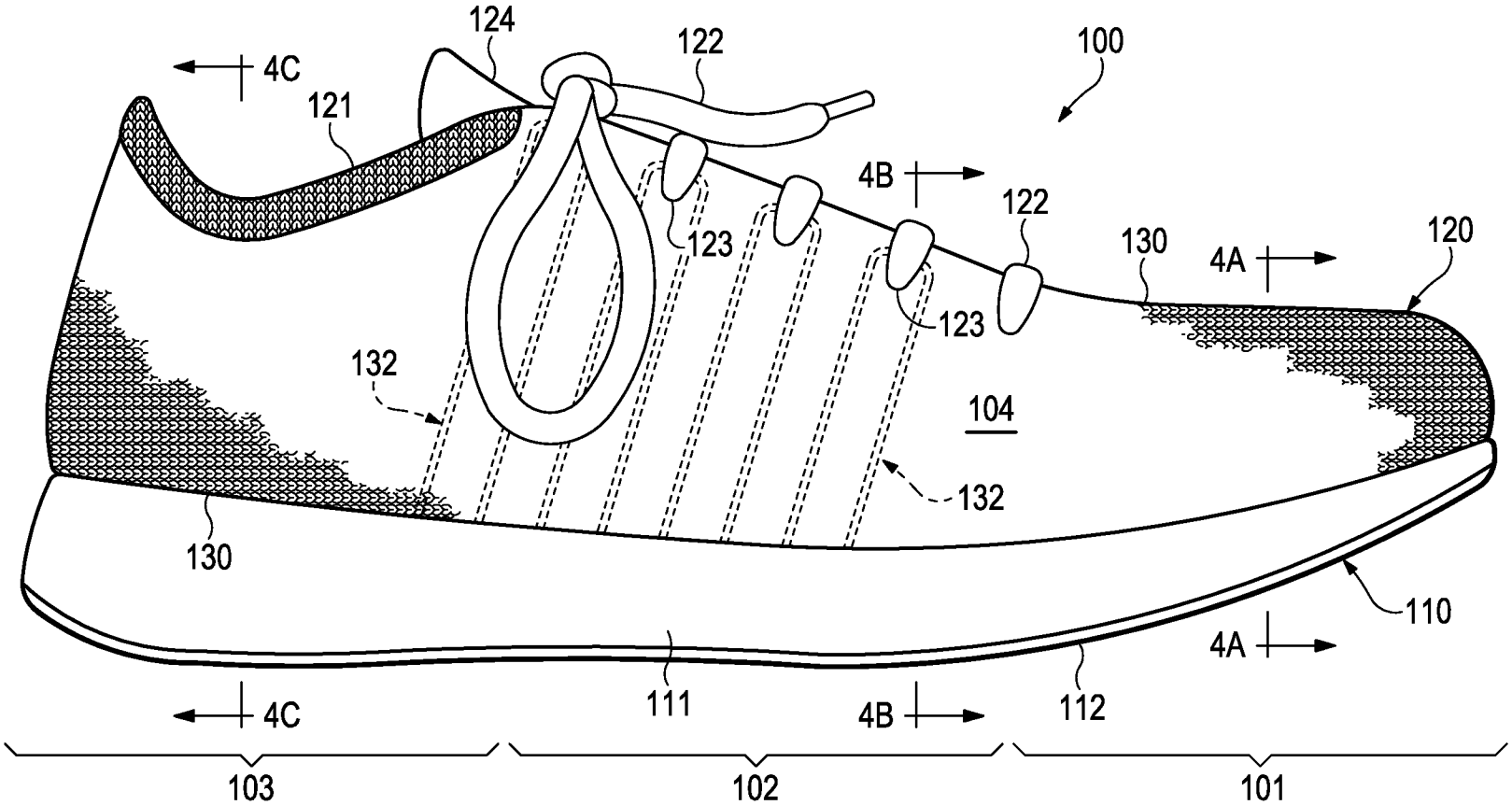
FIG. 2 is a lateral side elevational view of the article of footwear.
Figure 3:
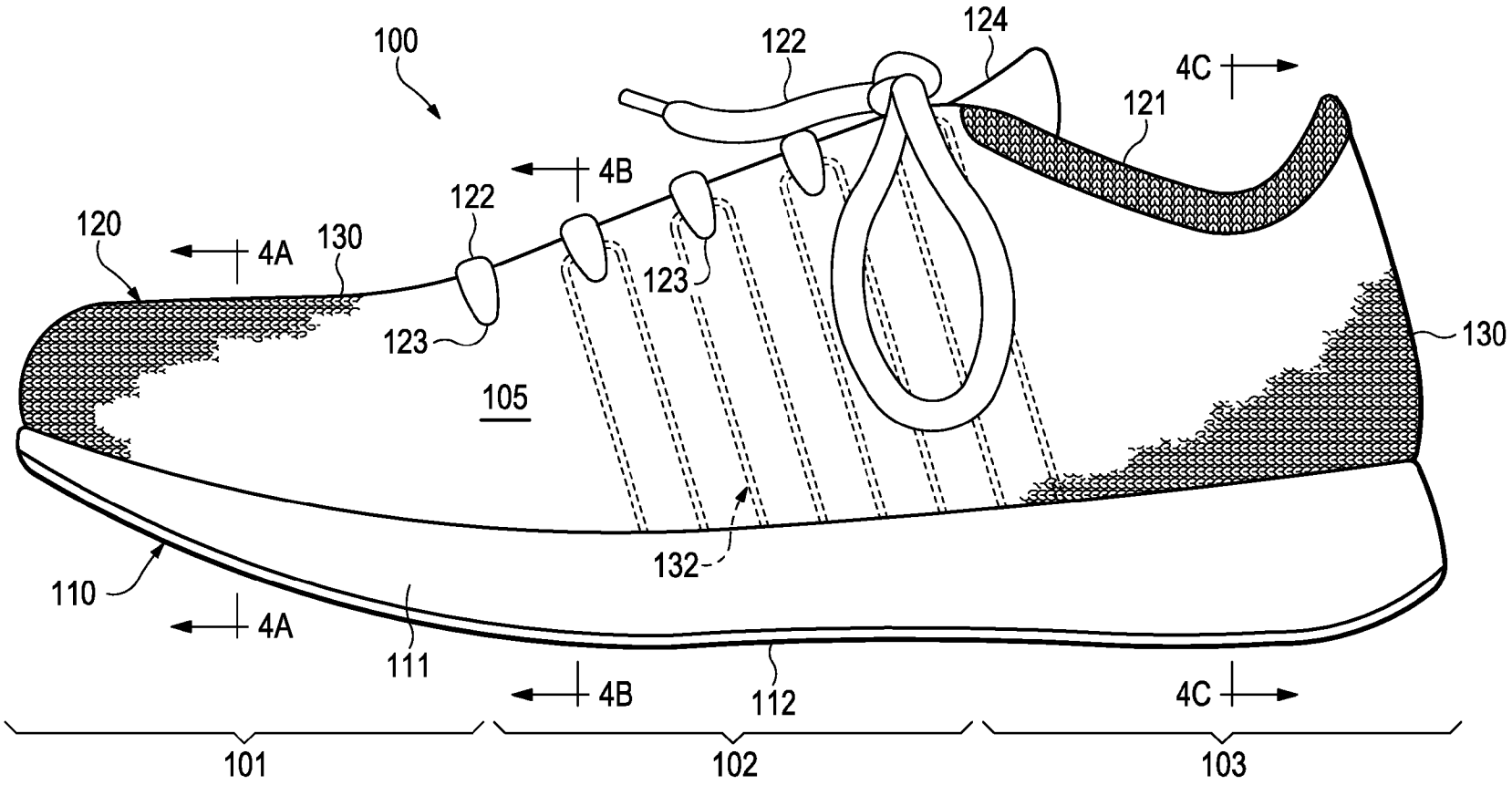
FIG. 3 is a medial side elevational view of the article of footwear.

The following discussion and accompanying figures disclose a variety of concepts relating to knitting machines, knitted components, and the manufacture of knitted components. Although the knitted components may be utilized in a variety of products, an article of footwear that incorporates one of the knitted components is disclosed below as an example. In addition to footwear, the knitted components may be utilized in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted components may also be utilized in bed coverings (e.g., sheets, blankets), table coverings, towels, flags, tents, sails, and parachutes. The knitted components may be utilized as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, the knitted components and other concepts disclosed herein may be incorporated into a variety of products for both personal and industrial purposes.

Footwear Configuration

An article of footwear 100 is depicted in FIGS. 1-4C as including a sole structure 110 and an upper 120. Although footwear 100 is illustrated as having a general configuration suitable for running, concepts associated with footwear 100 may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to footwear 100 apply to a wide variety of footwear types.

For reference purposes, footwear 100 may be divided into three general regions: a forefoot region 101, a midfoot region 102, and a heel region 103. Forefoot region 101 generally includes portions of footwear 100 corresponding with the toes and the joints connecting the metatarsals with the phalanges. Midfoot region 102 generally includes portions of footwear 100 corresponding with an arch area of the foot. Heel region 103 generally corresponds with rear portions of the foot, including the calcaneus bone. Footwear 100 also includes a lateral side 104 and a medial side 105, which extend through each of regions 101-103 and correspond with opposite sides of footwear 100. More particularly, lateral side 104 corresponds with an outside area of the foot (i.e. the surface that faces away from the other foot), and medial side 105 corresponds with an inside area of the foot (i.e., the surface that faces toward the other foot). Regions 101-103 and sides 104-105 are not intended to demarcate precise areas of footwear 100. Rather, regions 101-103 and sides 104-105 are intended to represent general areas of footwear 100 to aid in the following discussion. In addition to footwear 100, regions 101-103 and sides 104-105 may also be applied to sole structure 110, upper 120, and individual elements thereof.

Sole structure 110 is secured to upper 120 and extends between the foot and the ground when footwear 100 is worn.

The primary elements of sole structure 110 are a midsole 111, an outsole 112, and a sockliner 113. Midsole 111 is secured to a lower surface of upper 120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 111 may incorporate plates, moderators, fluid-filled chambers, lasting elements, or motion control members that further attenuate forces, enhance stability, or influence the motions of the foot, or midsole 21 may be primarily formed from a fluid-filled chamber. Outsole 112 is secured to a lower surface of midsole 111 and may be formed from a wear-resistant rubber material that is textured to impart traction. Sockliner 113 is located within upper 120 and is positioned to extend under a lower surface of the foot to enhance the comfort of footwear 100. Although this configuration for sole structure 110 provides an example of a sole structure that may be used in connection with upper 120, a variety of other conventional or nonconventional configurations for sole structure 110 may also be utilized. Accordingly, the features of sole structure 110 or any sole structure utilized with upper 120 may vary considerably.

Upper 120 defines a void within footwear 100 for receiving and securing a foot relative to sole structure 110. The void is shaped to accommodate the foot and extends along a lateral side of the foot, along a medial side of the foot, over the foot, around the heel, and under the foot. Access to the void is provided by an ankle opening 121 located in at least heel region 103. A lace 122 extends through various lace apertures 123 in upper 120 and permits the wearer to modify dimensions of upper 120 to accommodate proportions of the foot. More particularly, lace 122 permits the wearer to tighten upper 120 around the foot, and lace 122 permits the wearer to loosen upper 120 to facilitate entry and removal of the foot from the void (i.e., through ankle opening 121). In addition, upper 120 includes a tongue 124 that extends under lace 122 and lace apertures 123 to enhance the comfort of footwear 100. In further configurations, upper 120 may include additional elements, such as (a) a heel counter in heel region 103 that enhances stability, (b) a toe guard in forefoot region 101 that is formed of a wear-resistant material, and (c) logos, trademarks, and placards with care instructions and material information.

Figure 4A:
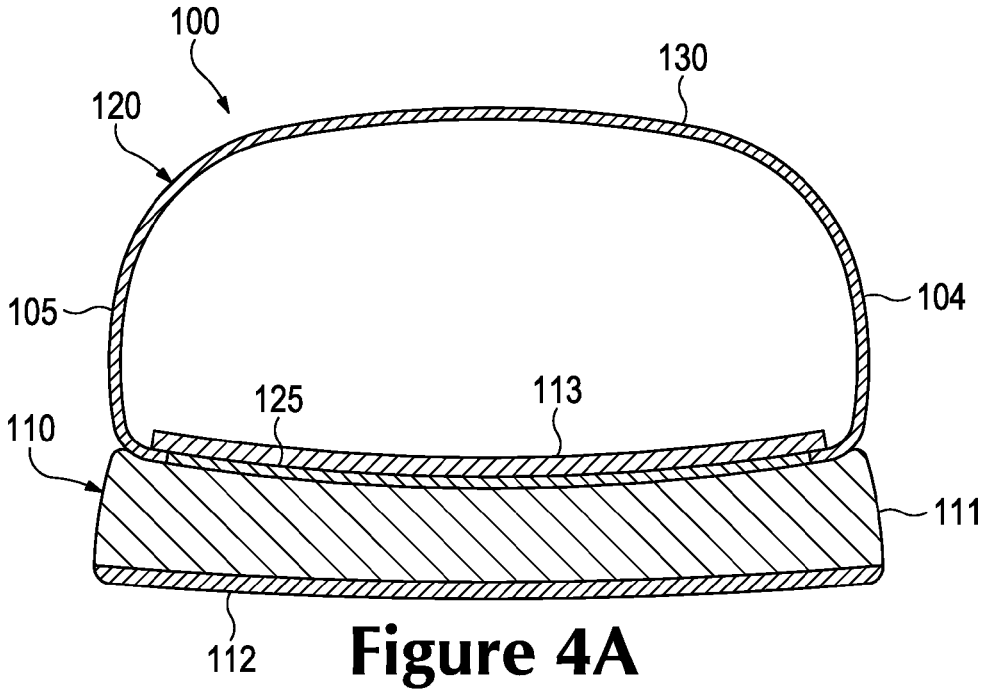
FIGS. 4A-4C are cross-sectional views of the article of footwear, as defined by section lines 4A-4C in FIGS. 2 and 3.
Figure 4B:
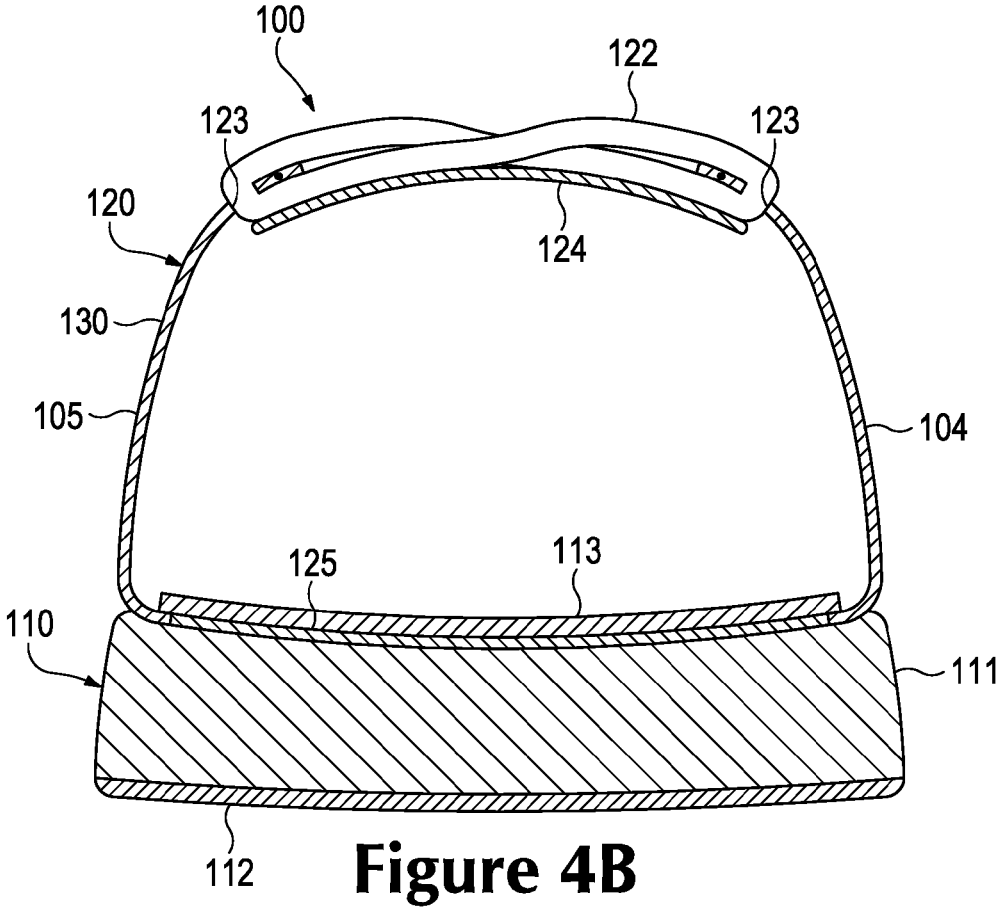
Figure 4C:
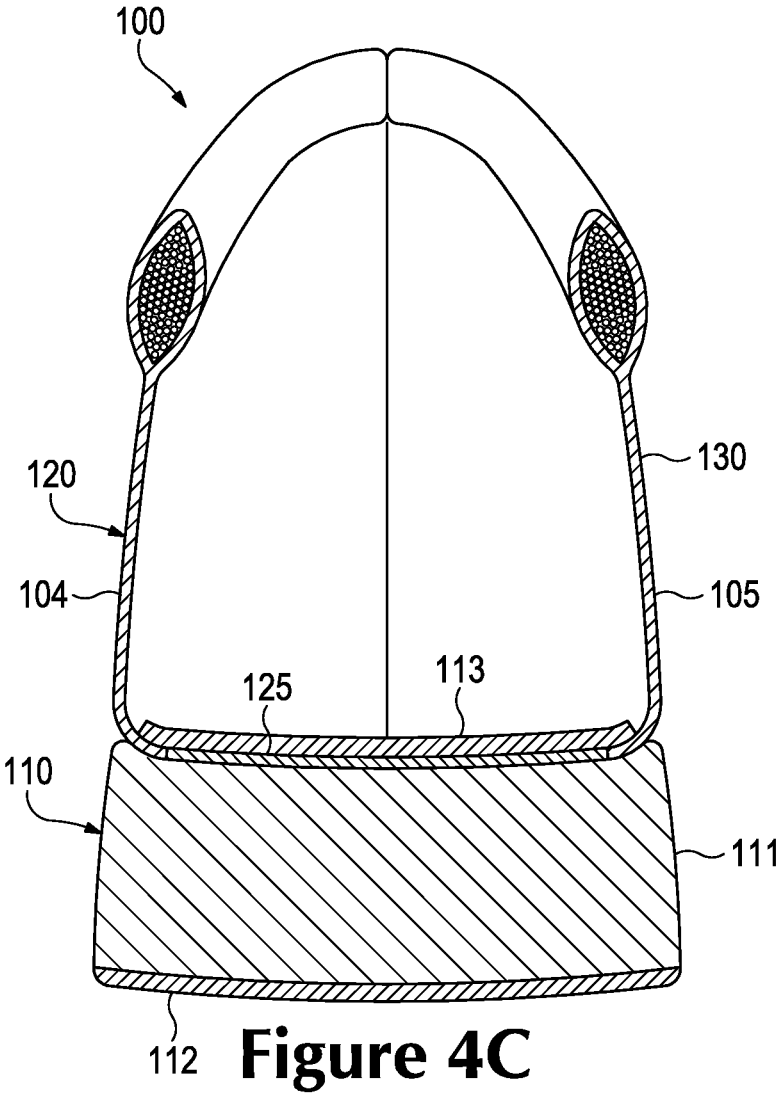

Many conventional footwear uppers are formed from multiple material elements (e.g., textiles, polymer foam, polymer sheets, leather, synthetic leather) that are joined through stitching or bonding, for example. In contrast, a majority of upper 120 is formed from a knitted component 130, which extends through each of regions 101-103, along both lateral side 104 and medial side 105, over forefoot region 101, and around heel region 103. In addition, knitted component 130 forms portions of both an exterior surface and an opposite interior surface of upper 120. As such, knitted component 130 defines at least a portion of the void within upper 120. In some configurations, knitted component 130 may also extend under the foot. Referring to FIGS. 4A-4C, however, a strobel sock 125 is secured to knitted component 130 and an upper surface of midsole 111, thereby forming a portion of upper 120 that extends under sockliner 113.

Knitted Component Configuration

Figure 5:
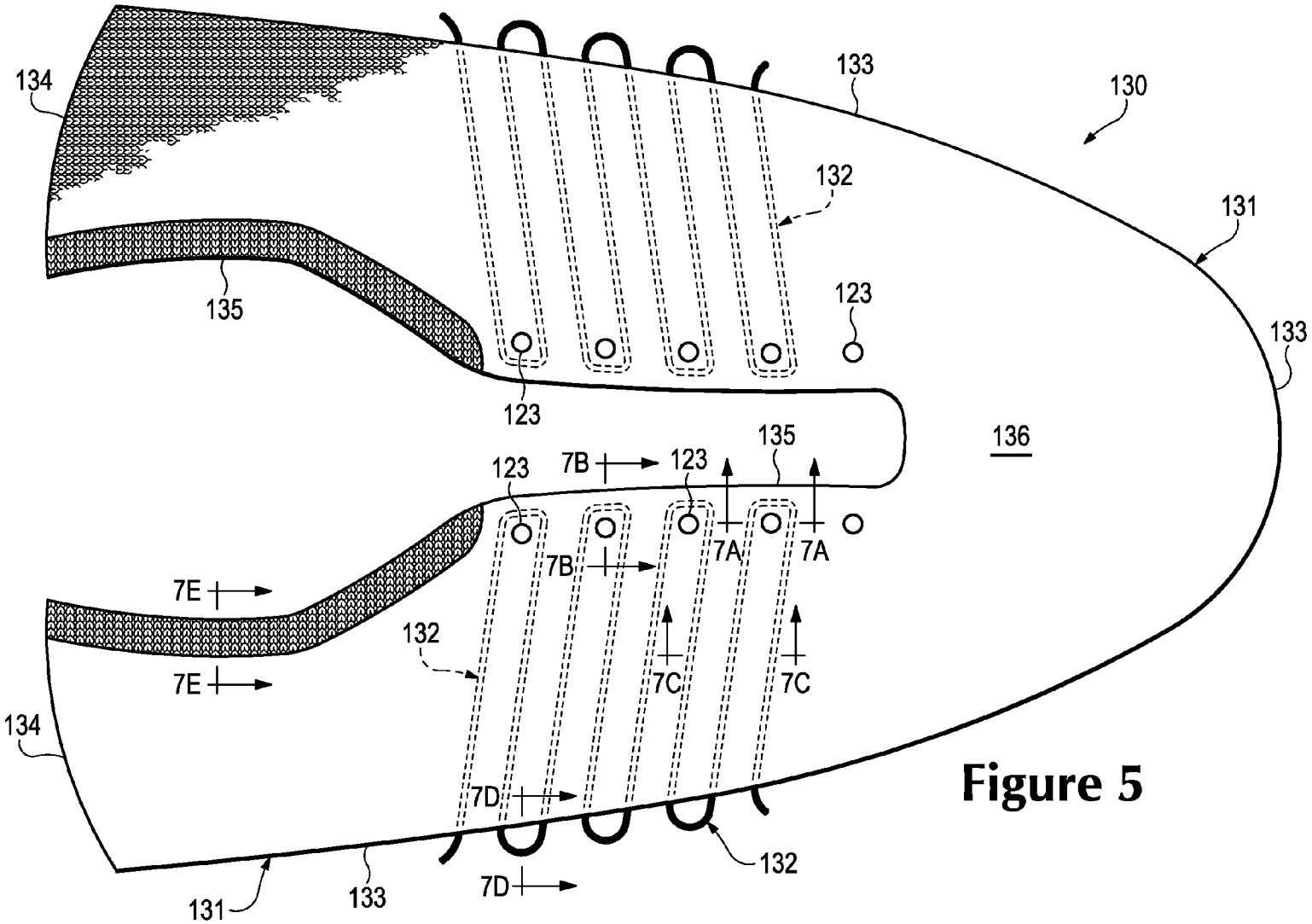
FIG. 5 is a top plan view of a knitted component that forms a portion of an upper of the article of footwear according to exemplary embodiments of the present disclosure.
Figure 6:
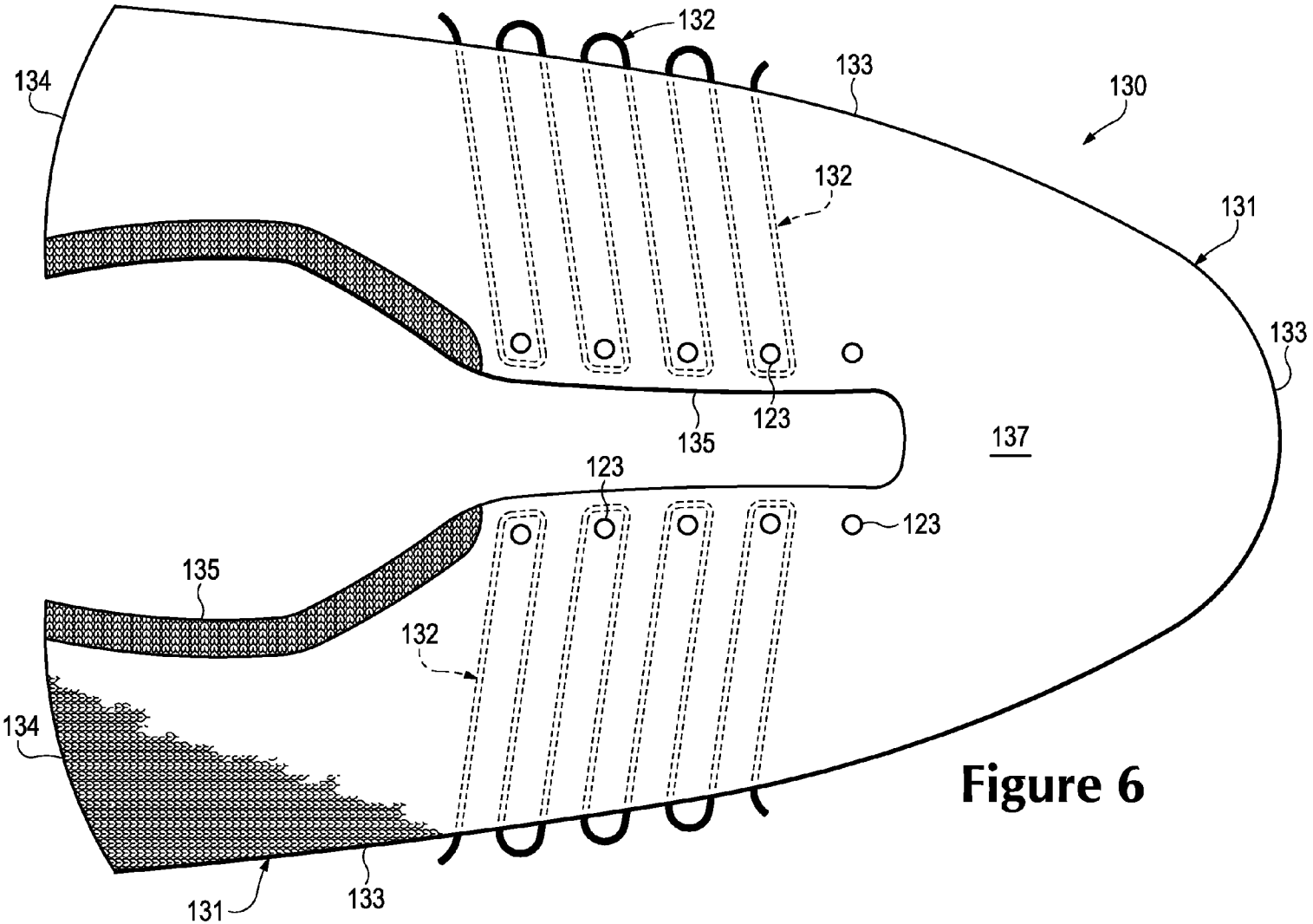
FIG. 6 is a bottom plan view of the knitted component of FIG. 5.

Knitted component 130 is depicted separate from a remainder of footwear 100 in FIGS. 5 and 6. Knitted component 130 is formed of unitary knit construction. As used herein and in the claims, a knitted component (e.g., knitted component 130) is defined as being formed of "unitary knit construction" when formed as a one-piece element through a knitting process. That is, the knitting process substantially forms the various features and structures of knitted component 130 without the need for significant additional manufacturing steps or processes. A unitary knit construction may be used to form a knitted component having structures or elements that include one or more courses of yarn or other knit material that are joined such that the structures or elements include at least one course in common (i.e., sharing a common yarn) and/or include courses that are substantially continuous between each of the structures or elements. With this arrangement, a one-piece element of unitary knit construction is provided. Although portions of knitted component 130 may be joined to each other (e.g., edges of knitted component 130 being joined together) following the knitting process, knitted component 130 remains formed of unitary knit construction because it is formed as a one-piece knit element. Moreover, knitted component 130 remains formed of unitary knit construction when other elements (e.g., lace 122, tongue 124, logos, trademarks, placards with care instructions and material information) are added following the knitting process.

The primary elements of knitted component 130 are a knit element 131 and an inlaid strand 132. Knit element 131 is formed from at least one yarn that is manipulated (e.g., with a knitting machine) to form a plurality of intermeshed loops that define a variety of courses and wales. That is, knit element 131 has the structure of a knit textile. Inlaid strand 132 extends through knit element 131 and passes between the various loops within knit element 131. Although inlaid strand 132 generally extends along courses within knit element 131, inlaid strand 132 may also extend along wales within knit element 131. Advantages of inlaid strand 132 include providing support, stability, and structure. For example, inlaid strand 132 assists with securing upper 120 around the foot, limits deformation in areas of upper 120 (e.g., imparts stretch-resistance) and operates in connection with lace 122 to enhance the fit of footwear 100.

Knit element 131 has a generally U-shaped configuration that is outlined by a perimeter edge 133, a pair of heel edges 134, and an inner edge 135. When incorporated into footwear 100, perimeter edge 133 lays against the upper surface of midsole 111 and is joined to strobel sock 125. Heel edges 134 are joined to each other and extend vertically in heel region 103. In some configurations of footwear 100, a material element may cover a seam between heel edges 134 to reinforce the seam and enhance the aesthetic appeal of footwear 100. Inner edge 135 forms ankle opening 121 and extends forward to an area where lace 122, lace apertures 123, and tongue 124 are located. In addition, knit element 131 has a first surface 136 and an opposite second surface 137. First surface 136 forms a portion of the exterior surface of upper 120, whereas second surface 137 forms a portion of the interior surface of upper 120, thereby defining at least a portion of the void within upper 120.

Inlaid strand 132, as noted above, extends through knit element 131 and passes between the various loops within knit element 131. More particularly, inlaid strand 132 is located within the knit structure of knit element 131, which may have the configuration of a single textile layer in the area of inlaid strand 132, and between surfaces 136 and 137, as depicted in FIGS. 7A-7D. When knitted component 130 is incorporated into footwear 100, therefore, inlaid strand 132 is located between the exterior surface and the interior surface of upper 120. In some configurations, portions of inlaid strand 132 may be visible or exposed on one or both of surfaces 136 and 137. For example, inlaid strand 132 may lay against one of surfaces 136 and 137, or knit element 131 may form indentations or apertures through which inlaid strand passes. An advantage of having inlaid strand 132 located between surfaces 136 and 137 is that knit element 131 protects inlaid strand 132 from abrasion and snagging.

Referring to FIGS. 5 and 6, inlaid strand 132 repeatedly extends from perimeter edge 133 toward inner edge 135 and adjacent to a side of one lace aperture 123, at least partially around the lace aperture 123 to an opposite side, and back to perimeter edge 133. When knitted component 130 is incorporated into footwear 100, knit element 131 extends from a throat area of upper 120 (i.e., where lace 122, lace apertures 123, and tongue 124 are located) to a lower area of upper 120 (i.e., where knit element 131 joins with sole structure 110. In this configuration, inlaid strand 132 also extends from the throat area to the lower area. More particularly, inlaid strand repeatedly passes through knit element 131 from the throat area to the lower area.

Although knit element 131 may be formed in a variety of ways, courses of the knit structure generally extend in the same direction as inlaid strands 132. That is, courses may extend in the direction extending between the throat area and the lower area. As such, a majority of inlaid strand 132 extends along the courses within knit element 131. In areas adjacent to lace apertures 123, however, inlaid strand 132 may also extend along wales within knit element 131. More particularly, sections of inlaid strand 132 that are parallel to inner edge 135 may extend along the wales.

As discussed above, inlaid strand 132 passes back and forth through knit element 131. Referring to FIGS. 5 and 6, inlaid strand 132 also repeatedly exits knit element 131 at perimeter edge 133 and then re-enters knit element 131 at another location of perimeter edge 133, thereby forming loops along perimeter edge 133. An advantage to this configuration is that each section of inlaid strand 132 that extends between the throat area and the lower area may be independently tensioned, loosened, or otherwise adjusted during the manufacturing process of footwear 100. That is, prior to securing sole structure 110 to upper 120, sections of inlaid strand 132 may be independently adjusted to the proper tension.

In comparison with knit element 131, inlaid strand 132 may exhibit greater stretch-resistance. That is, inlaid strand 132 may stretch less than knit element 131. Given that numerous sections of inlaid strand 132 extend from the throat area of upper 120 to the lower area of upper 120, inlaid strand 132 imparts stretch-resistance to the portion of upper 120 between the throat area and the lower area. Moreover, placing tension upon lace 122 may impart tension to inlaid strand 132, thereby inducing the portion of upper 120 between the throat area and the lower area to lay against the foot. As such, inlaid strand 132 operates in connection with lace 122 to enhance the fit of footwear 100.

Knit element 131 may incorporate various types of yarn that impart different properties to separate areas of upper 120. That is, one area of knit element 131 may be formed from a first type of yarn that imparts a first set of properties, and another area of knit element 131 may be formed from a second type of yarn that imparts a second set of properties. In this configuration, properties may vary throughout upper 120 by selecting specific yarns for different areas of knit element 131. The properties that a particular type of yarn will impart to an area of knit element 131 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the yarns selected for knit element 131 may affect the properties of upper 120. For example, a yarn forming knit element 131 may be a monofilament yarn or a multifilament yarn. The yarn may also include separate filaments that are each formed of different materials. In addition, the yarn may include filaments that are each formed of two or more different materials, such as a bicomponent yarn with filaments having a sheath-core configuration or two halves formed of different materials. Different degrees of twist and crimping, as well as different deniers, may also affect the properties of upper 120. Accordingly, both the materials forming the yarn and other aspects of the yarn may be selected to impart a variety of properties to separate areas of upper 120.

As with the yarns forming knit element 131, the configuration of inlaid strand 132 may also vary significantly. In addition to yarn, inlaid strand 132 may have the configurations of a filament (e.g., a monofilament), thread, rope, webbing, cable, or chain, for example. In comparison with the yarns forming knit element 131, the thickness of inlaid strand 132 may be greater. In some configurations, inlaid strand 132 may have a significantly greater thickness than the yarns of knit element 131. Although the cross-sectional shape of inlaid strand 132 may be round, triangular, square, rectangular, elliptical, or irregular shapes may also be utilized. Moreover, the materials forming inlaid strand 132 may include any of the materials for the yarn within knit element 131, such as cotton, elastane, polyester, rayon, wool, and nylon. As noted above, inlaid strand 132 may exhibit greater stretch-resistance than knit element 131. As such, suitable materials for inlaid strands 132 may include a variety of engineering filaments that are utilized for high tensile strength applications, including glass, aramids (e.g., para-aramid and meta-aramid), ultra-high molecular weight polyethylene, and liquid crystal polymer. As another example, a braided polyester thread may also be utilized as inlaid strand 132.

Figure 8A:
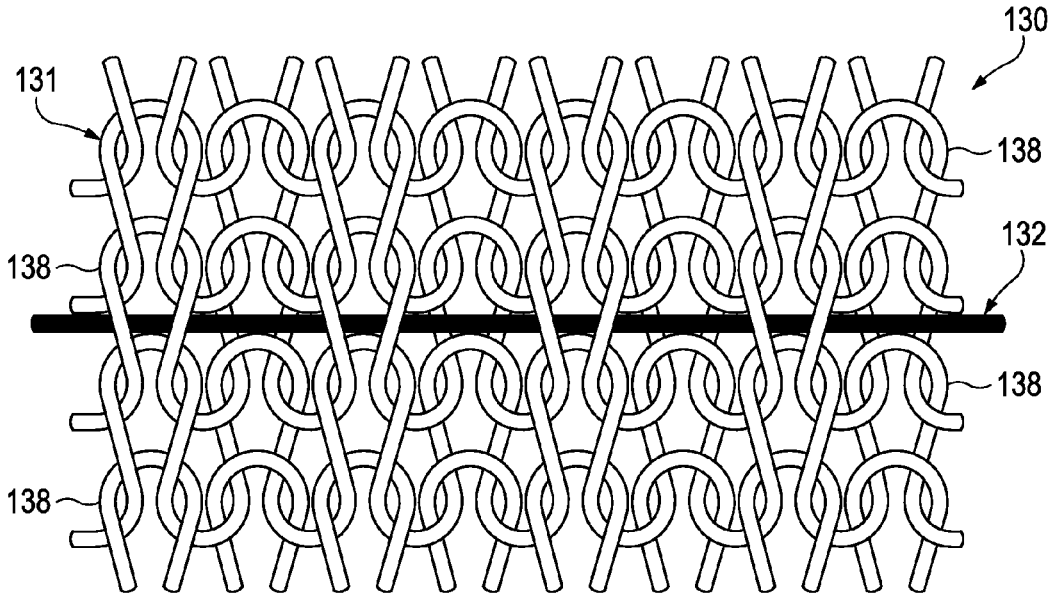
FIGS. 8A and 8B are plan views showing knit structures of the knitted component of FIG. 5.

An example of a suitable configuration for a portion of knitted component 130 is depicted in FIG. 8A. In this configuration, knit element 131 includes a yarn 138 that forms a plurality of intermeshed loops defining multiple horizontal courses and vertical wales. Inlaid strand 132 extends along one of the courses and alternates between being located (a) behind loops formed from yarn 138 and (b) in front of loops formed from yarn 138. In effect, inlaid strand 132 weaves through the structure formed by knit element 131. Although yarn 138 forms each of the courses in this configuration, additional yarns may form one or more of the courses or may form a portion of one or more of the courses.

Figure 8B:
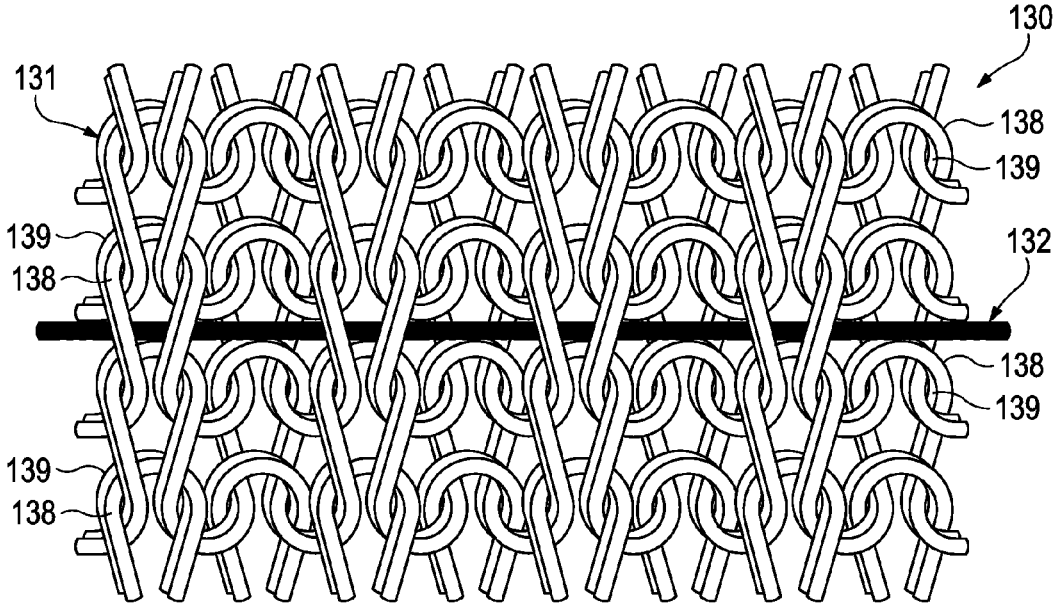

Another example of a suitable configuration for a portion of knitted component 130 is depicted in FIG. 8B. In this configuration, knit element 131 includes yarn 138 and another yarn 139. Yarns 138 and 139 are plated and cooperatively form a plurality of intermeshed loops defining multiple horizontal courses and vertical wales. That is, yarns 138 and 139 run parallel to each other. As with the configuration in FIG. 8A, inlaid strand 132 extends along one of the courses and alternates between being located (a) behind loops formed from yarns 138 and 139 and (b) in front of loops formed from yarns 138 and 139. An advantage of this configuration is that the properties of each of yarns 138 and 139 may be present in this area of knitted component 130. For example, yarns 138 and 139 may have different colors, with the color of yarn 138 being primarily present on a face of the various stitches in knit element 131 and the color of yarn 139 being primarily present on a reverse of the various stitches in knit element 131. As another example, yarn 139 may be formed from a yarn that is softer and more comfortable against the foot than yarn 138, with yarn 138 being primarily present on first surface 136 and yarn 139 being primarily present on second surface 137.

Continuing with the configuration of FIG. 8B, yarn 138 may be formed from at least one of a thermoset polymer material and natural fibers (e.g., cotton, wool, silk), whereas yarn 139 may be formed from a thermoplastic polymer material. In general, a thermoplastic polymer material melts when heated and returns to a solid state when cooled. More particularly, the thermoplastic polymer material transitions from a solid state to a softened or liquid state when subjected to sufficient heat, and then the thermoplastic polymer material transitions from the softened or liquid state to the solid state when sufficiently cooled. As such, thermoplastic polymer materials are often used to join two objects or elements together. In this case, yarn 139 may be utilized to join (a) one portion of yarn 138 to another portion of yarn 138, (b) yarn 138 and inlaid strand 132 to each other, or (c) another element (e.g., logos, trademarks, and placards with care instructions and material information) to knitted component 130, for example. As such, yarn 139 may be considered a fusible yarn given that it may be used to fuse or otherwise join portions of knitted component 130 to each other. Moreover, yarn 138 may be considered a non-fusible yarn given that it is not formed from materials that are generally capable of fusing or otherwise joining portions of knitted component 130 to each other. That is, yarn 138 may be a non-fusible yarn, whereas yarn 139 may be a fusible yarn. In some configurations of knitted component 130, yarn 138 (i.e., the non-fusible yarn) may be substantially formed from a thermoset polyester material and yarn 139 (i.e., the fusible yarn) may be at least partially formed from a thermoplastic polyester material.

The use of plated yarns may impart advantages to knitted component 130. When yarn 139 is heated and fused to yarn 138 and inlaid strand 132, this process may have the effect of stiffening or rigidifying the structure of knitted component 130. Moreover, joining (a) one portion of yarn 138 to another portion of yarn 138 or (b) yarn 138 and inlaid strand 132 to each other has the effect of securing or locking the relative positions of yarn 138 and inlaid strand 132, thereby imparting stretch-resistance and stiffness. That is, portions of yarn 138 may not slide relative to each other when fused with yarn 139, thereby preventing warping or permanent stretching of knit element 131 due to relative movement of the knit structure. Another benefit relates to limiting unraveling if a portion of knitted component 130 becomes damaged or one of yarns 138 is severed. Also, inlaid strand 132 may not slide relative to knit element 131, thereby preventing portions of inlaid strand 132 from pulling outward from knit element 131. Accordingly, areas of knitted component 130 may benefit from the use of both fusible and non-fusible yarns within knit element 131.

Figure 7A:
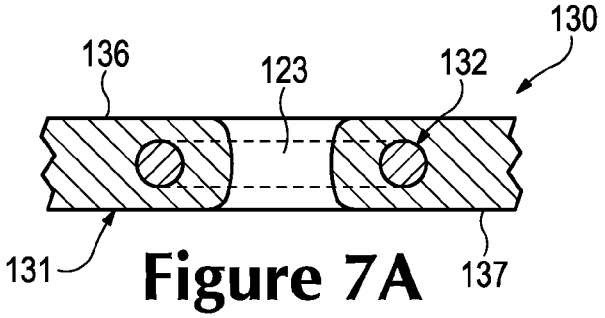
FIGS. 7A-7E are cross-sectional views of the knitted component, as defined by section lines 7A-7E in FIG. 5.
Figure 7B:
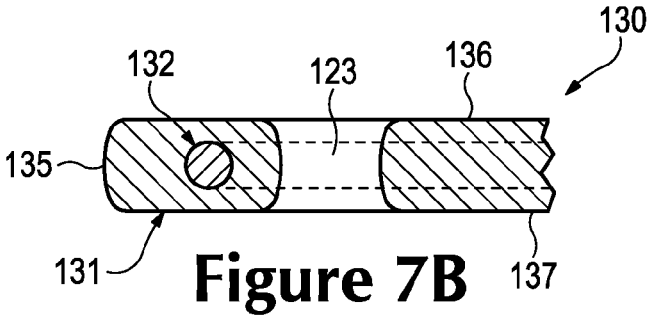
Figure 7C:
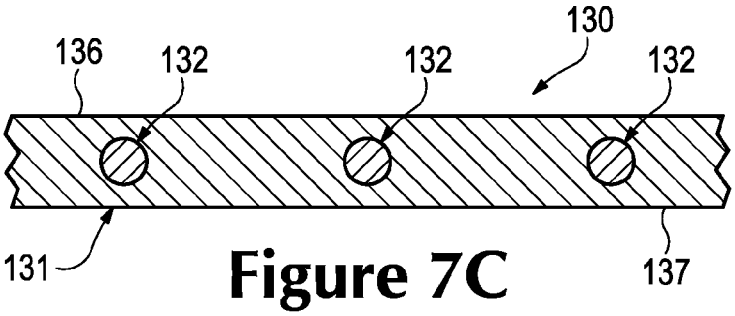
Figure 7D:
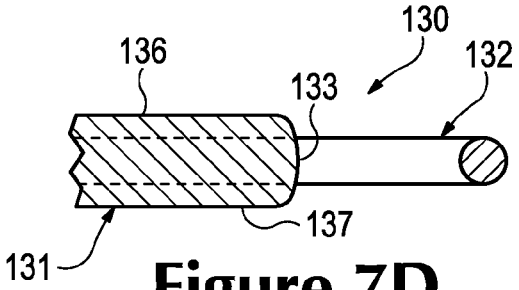
Figure 7E:
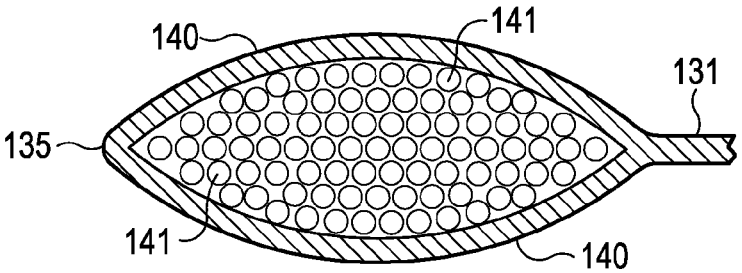

Another aspect of knitted component 130 relates to a padded area adjacent to ankle opening 121 and extending at least partially around ankle opening 121. Referring to FIG. 7E, the padded area is formed by two overlapping and at least partially coextensive knitted layers 140, which may be formed of unitary knit construction, and a plurality of floating yarns 141 extending between knitted layers 140. Although the sides or edges of knitted layers 140 are secured to each other, a central area is generally unsecured. As such, knitted layers 140 effectively form a tube or tubular structure, and floating yarns 141 (FIG. 7E) may be located or inlaid between knitted layers 140 to pass through the tubular structure. That is, floating yarns 141 extend between knitted layers 140, are generally parallel to surfaces of knitted layers 140, and also pass through and fill an interior volume between knitted layers 140. Whereas a majority of knit element 131 is formed from yarns that are mechanically-manipulated to form intermeshed loops, floating yarns 141 are generally free or otherwise inlaid within the interior volume between knitted layers 140. As an additional matter, knitted layers 140 may be at least partially formed from a stretch yarn. An advantage of this configuration is that knitted layers will effectively compress floating yarns 141 and provide an elastic aspect to the padded area adjacent to ankle opening 121. That is, the stretch yarn within knitted layers 140 may be placed in tension during the knitting process that forms knitted component 130, thereby inducing knitted layers 140 to compress floating yarns 141. Although the degree of stretch in the stretch yarn may vary significantly, the stretch yarn may stretch at least one-hundred percent in many configurations of knitted component 130.

The presence of floating yarns 141 imparts a compressible aspect to the padded area adjacent to ankle opening 121, thereby enhancing the comfort of footwear 100 in the area of ankle opening 121. Many conventional articles of footwear incorporate polymer foam elements or other compressible materials into areas adjacent to an ankle opening. In contrast with the conventional articles of footwear, portions of knitted component 130 formed of unitary knit construction with a remainder of knitted component 130 may form the padded area adjacent to ankle opening 121. In further configurations of footwear 100, similar padded areas may be located in other areas of knitted component 130. For example, similar padded areas may be located as an area corresponding with joints between the metatarsals and proximal phalanges to impart padding to the joints. As an alternative, a terry loop structure may also be utilized to impart some degree of padding to areas of upper 120.

Based upon the above discussion, knitted component 130 imparts a variety of features to upper 120. Moreover, knitted component 130 provides a variety of advantages over some conventional upper configurations. As noted above, conventional footwear uppers are formed from multiple material elements (e.g., textiles, polymer foam, polymer sheets, leather, synthetic leather) that are joined through stitching or bonding, for example. As the number and type of material elements incorporated into an upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements utilized in the upper, therefore, waste may be decreased while increasing the manufacturing efficiency and recyclability of the upper. To this end, knitted component 130 forms a substantial portion of upper 120, while increasing manufacturing efficiency, decreasing waste, and simplifying recyclability.

Knitting Machine and Feeder Configurations

Figure 9:
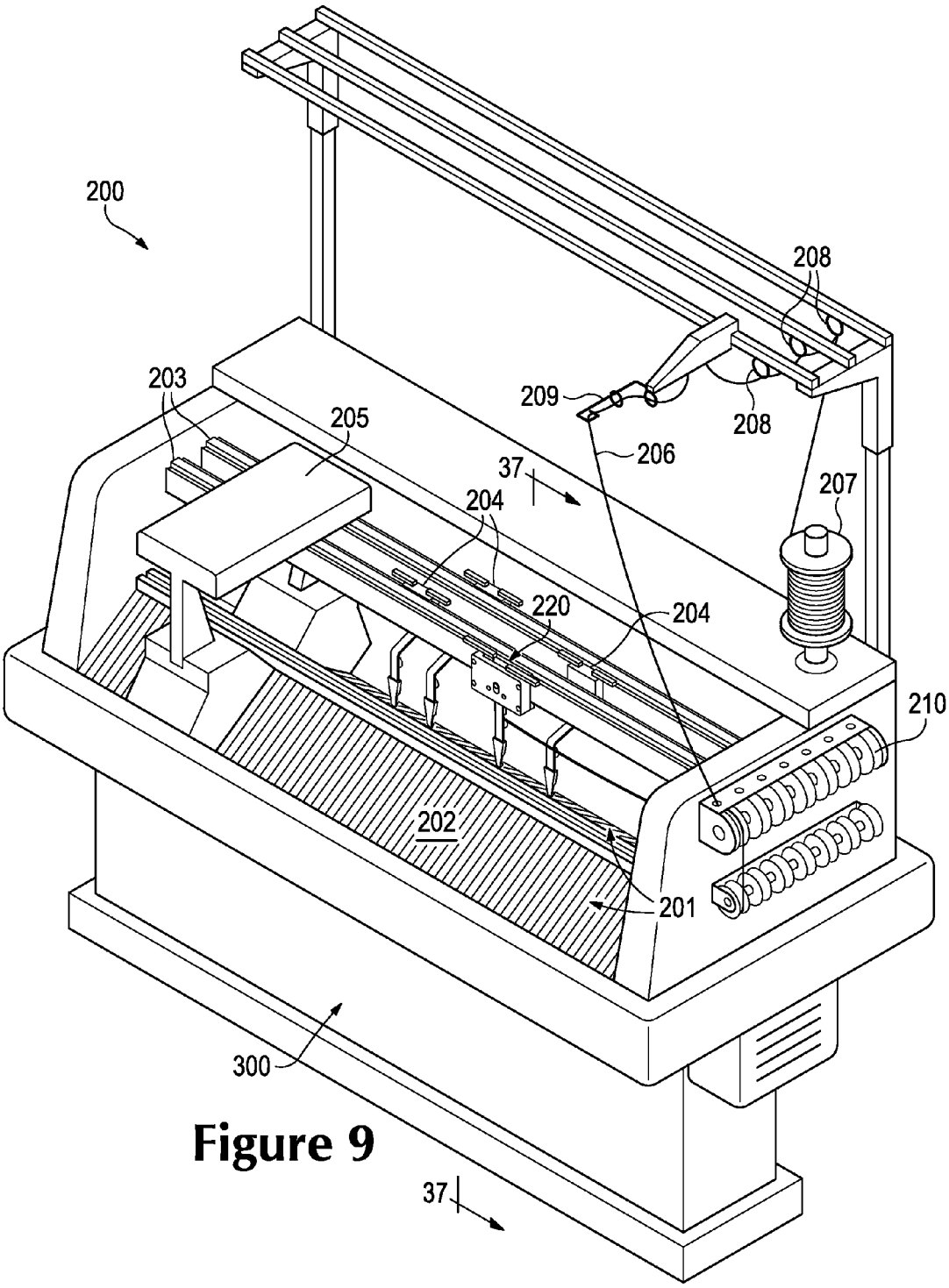
FIG. 9 is a perspective view of a knitting machine according to exemplary embodiments of the present disclosure.

Although knitting may be performed by hand, the commercial manufacture of knitted components is often performed by knitting machines. An example of a knitting machine 200 that is suitable for producing knitted component 130 is depicted in FIG. 9. Knitting machine 200 has a configuration of a V-bed flat knitting machine for purposes of example, but the knitting machine 200 can have different configurations without departing from the scope of the present disclosure.

Knitting machine 200 includes two needle beds 201 that are angled with respect to each other, thereby forming a V-bed. Each of needle beds 201 include a plurality of individual needles 202 that lay on a common plane. That is, needles 202 from one needle bed 201 lay on a first plane, and needles 202 from the other needle bed 201 lay on a second plane. The first plane and the second plane (i.e., the two needle beds 201) are angled relative to each other and meet to form an intersection that extends along a majority of a width of knitting machine 200. As described in greater detail below and shown in FIGS. 19-21, needles 202 each have a first position where they are retracted (shown in solid lines) and a second position where they are extended (shown in broken lines). In the first position, needles 202 are spaced from the intersection where the first plane and the second plane meet. In the second position, however, needles 202 pass through the intersection where the first plane and the second plane meet.

A pair of rails 203 extend above and parallel to the intersection of needle beds 201 and provide attachment points for multiple first feeders 204 and combination feeders 220. Each rail 203 has two sides, each of which accommodates either one first feeder 204 or one combination feeder 220. As such, knitting machine 200 may include a total of four feeders 204 and 220. As depicted, the forward-most rail 203 includes one combination feeder 220 and one first feeder 204 on opposite sides, and the rearward-most rail 203 includes two first feeders 204 on opposite sides. Although two rails 203 are depicted, further configurations of knitting machine 200 may incorporate additional rails 203 to provide attachment points for more feeders 204 and 220.

The knitting machine 200 also includes carriage 205, which can move substantially parallel to the longitudinal axis of the rails 203, above the needle beds 201. The carriage 205 can include one or more drive bolts 219 (FIGS. 17 and 18) that can be moveably mounted to an underside of the carriage 205. As indicated by the arrow 402 in FIG. 18, the drive bolt(s) 219 can selectively extend downward and retract upward relative to the carriage 205. Thus, the drive bolt 219 can move between an extended position (FIG. 18) and a retracted position (FIG. 17) relative to the carriage 205.

Figure 17:
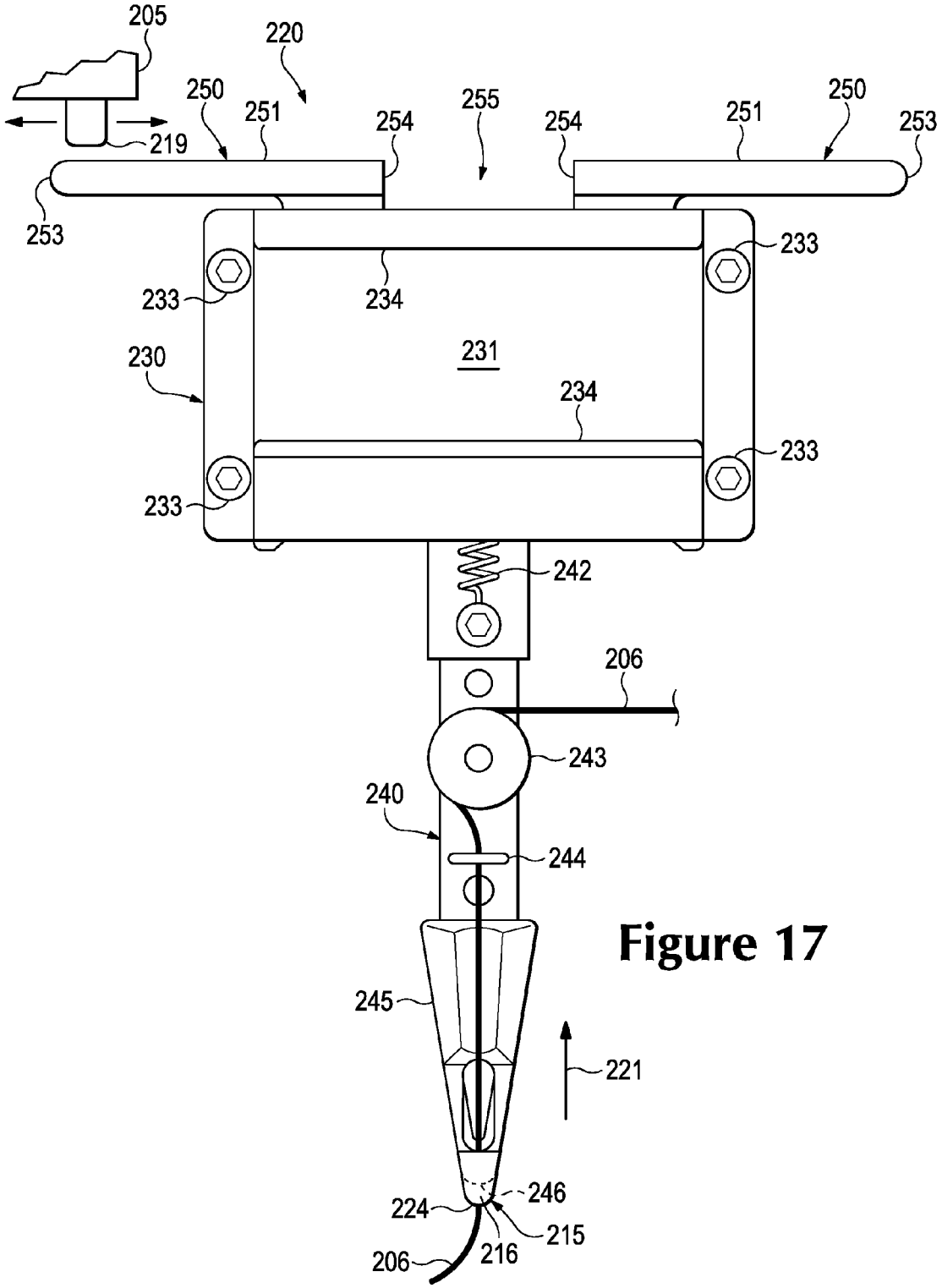
FIG. 17 is an elevational view of the combination feeder of FIGS. 10-16 shown in the retracted position.
Figure 18:
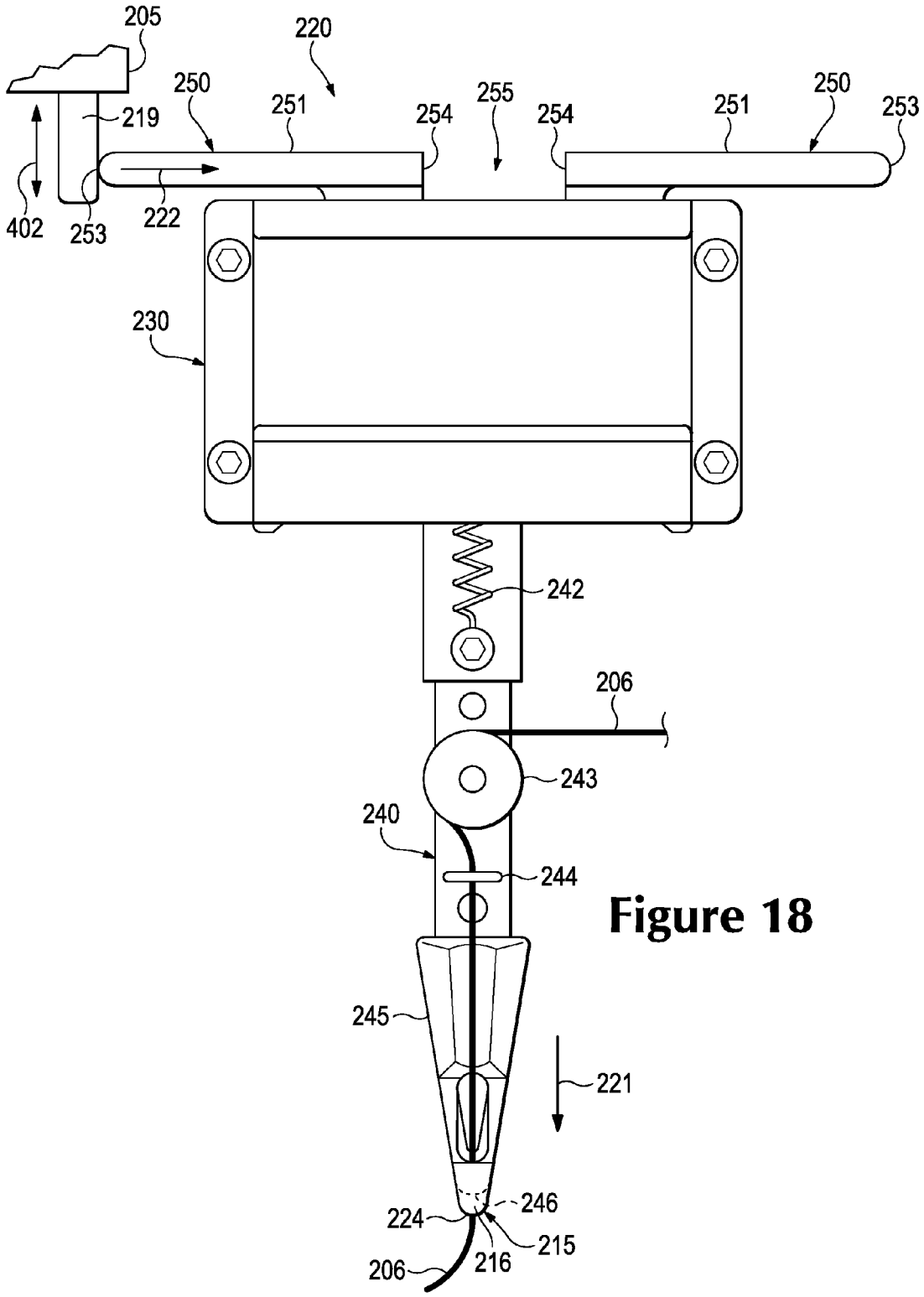
FIG. 18 is an elevational view of the combination feeder of FIGS. 10-16 shown in the extended position.

The carriage 205 can include any number of drive bolts 219, and each drive bolt 219 can be positioned so as to selectively engage different ones of the feeders 204, 220. For instance, FIGS. 17 and 18 show how the drive bolt 219 can operably engage with the combination feeder 220. When the bolt 219 is in the retracted position (FIG. 17), the carriage 205 can move along the rails 203 and bypass the feeder 220. However, when the bolt 219 is in the extended position (FIG. 18), the bolt 219 can abut against a surface 253 of the feeder 220. Thus, when the bolt 219 is extended, movement of the carriage 205 can drive movement of the feeder 220 along the axis of the rail 203.

Also, in relation to the combination feeder 220, the drive bolt 219 can supply a force, which causes the combination feeder 220 to move (e.g., downward) toward the needle bed 201. These operations will be discussed in more detail below.

As the feeders 204, 220 move along the rails 203, the feeders 204, 220 can supply yarns to needles 202. In FIG. 9, a yarn 206 is provided to combination feeder 220 by a spool 207. More particularly, yarn 206 extends from spool 207 to various yarn guides 208, a yarn take-back spring 209, and a yarn tensioner 210 before entering combination feeder 220. Although not depicted, additional spools 207 may be utilized to provide yarns to first feeders 204.

Moreover, the first feeders 204 can also supply a yarn to needle bed 201 that needles 202 manipulate to knit, tuck, and float. As a comparison, combination feeder 220 has the ability to supply a yarn (e.g., yarn 206) that needles 202 knit, tuck, and float, and combination feeder 220 has the ability to inlay the yarn. Moreover, combination feeder 220 has the ability to inlay a variety of different strands (e.g., filament, thread, rope, webbing, cable, chain, or yarn). The feeders 204, 220 can also incorporate one or more features of the feeders disclosed in U.S. patent application Ser. No. 13/048,527, entitled "Combination Feeder for a Knitting Machine," which was filed on Mar. 15, 2011 and published as U.S. Patent Publication No. 2012-0234051 on Sep. 20, 2012, and which is incorporated by reference in its entirety.

Figure 10:
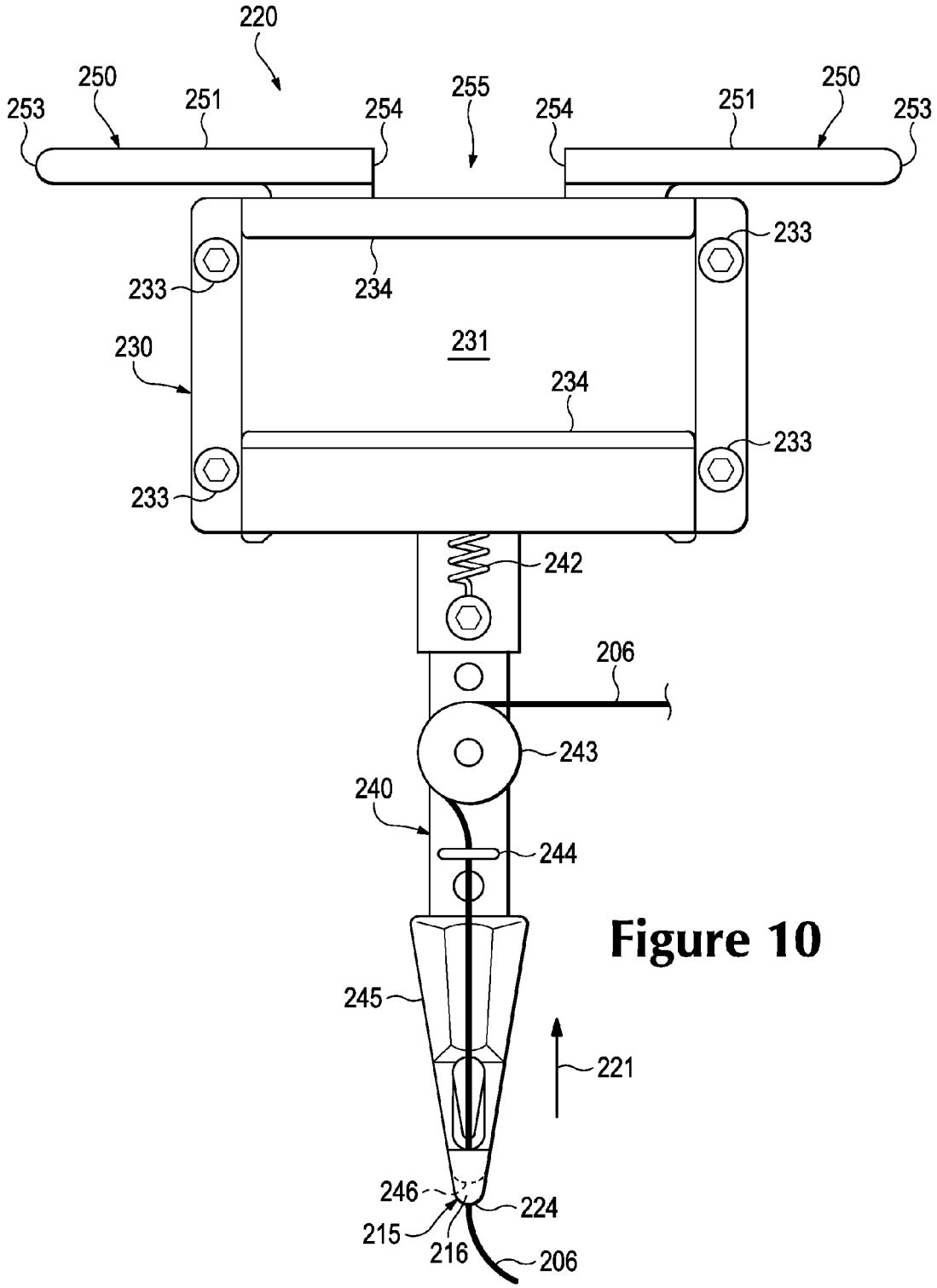
FIGS. 10-12 are elevational views of a combination feeder of the knitting machine.

The combination feeder 220 will now be discussed in greater detail. As shown in FIGS. 10-13, combination feeder 220 can include a carrier 230, a feeder arm 240, and a pair of actuation members 250. Although a majority of combination feeder 220 may be formed from metal materials (e.g., steel, aluminum, titanium), portions of carrier 230, feeder arm 240, and actuation members 250 may be formed from polymer, ceramic, or composite materials, for example. As discussed above, combination feeder 220 may be utilized when inlaying a yarn or other strand, in addition to knitting, tucking, and floating a yarn. Referring to FIG. 10 specifically, a portion of yarn 206 is depicted to illustrate the manner in which a strand interfaces with combination feeder 220.

Figure 11:
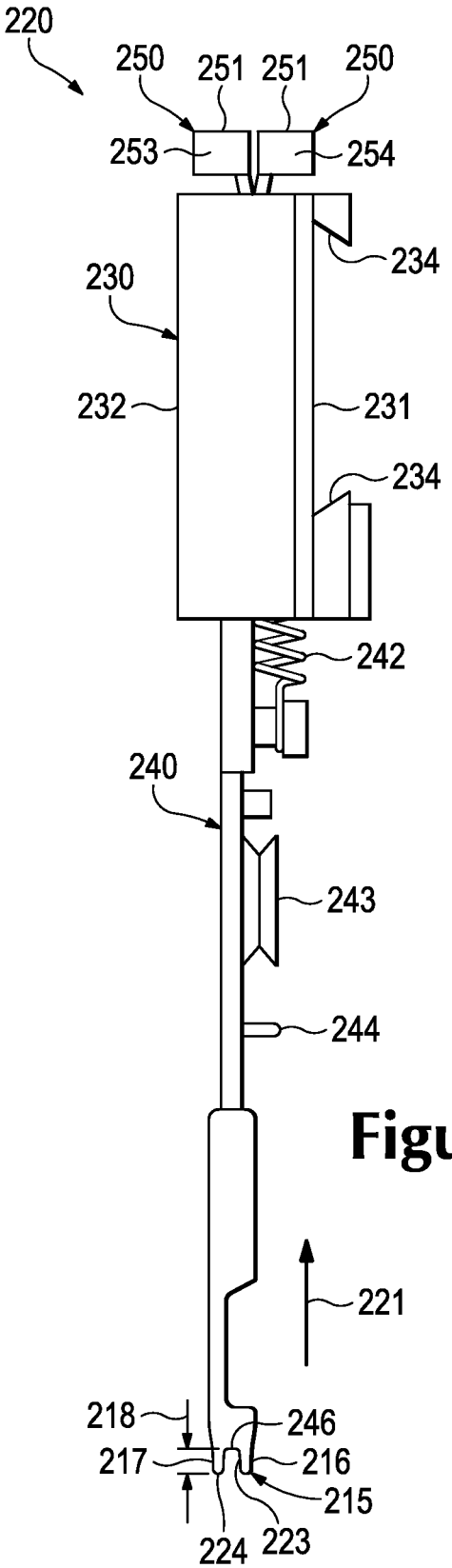
Figure 12:
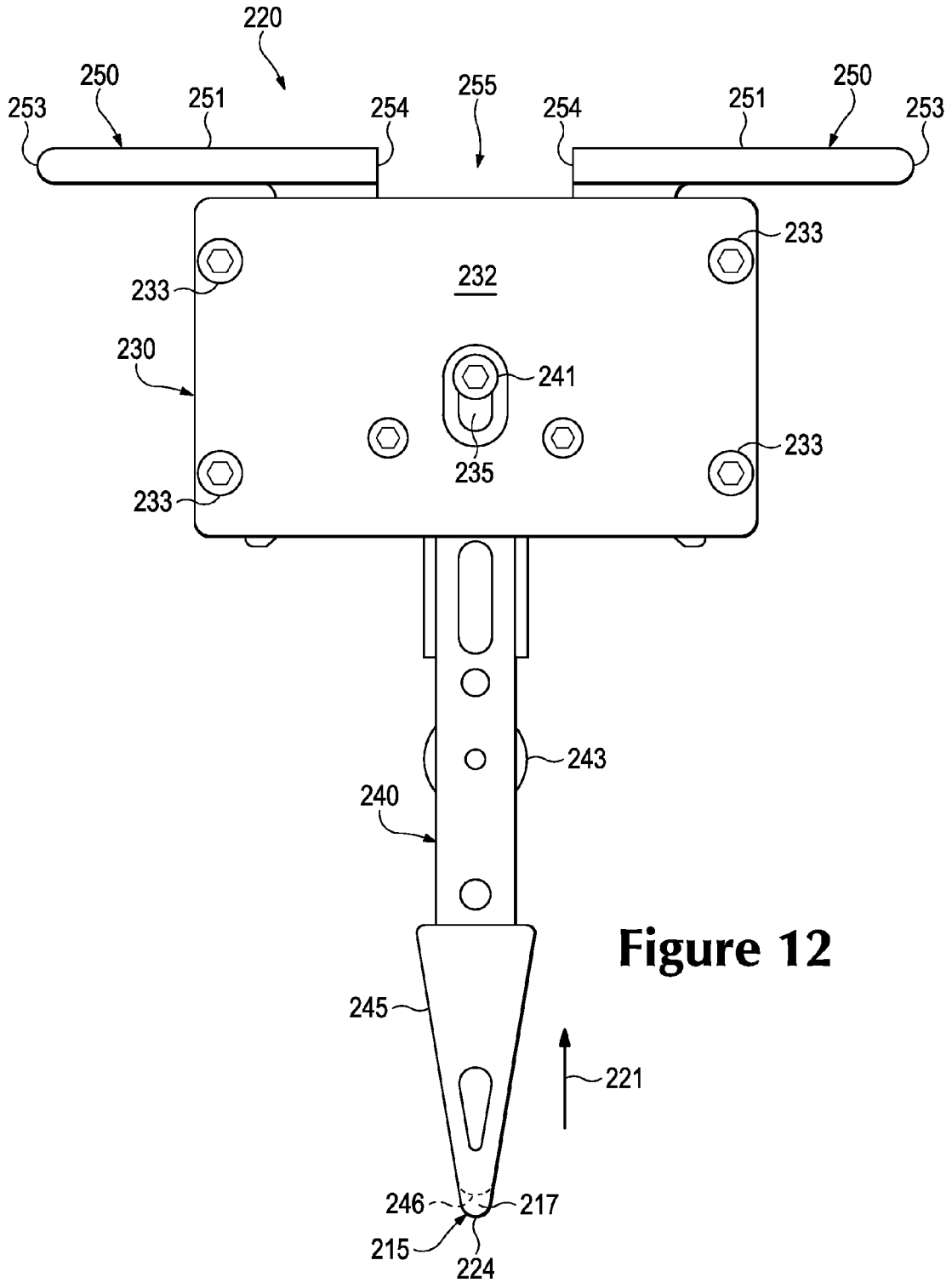

Carrier 230 has a generally rectangular configuration and includes a first cover member 231 and a second cover member 232 that are joined by four bolts 233. Cover members 231 and 232 define an interior cavity in which portions of feeder arm 240 and actuation members 250 are located. Carrier 230 also includes an attachment element 234 that extends outward from first cover member 231 for securing feeder 220 to one of rails 203. Although the configuration of attachment element 234 may vary, attachment element 234 is depicted as including two spaced protruding areas that form a dovetail shape, as depicted in FIG. 11. A reverse dovetail configuration on one of rails 203 may extend into the dovetail shape of attachment element 234 to effectively join combination feeder 220 to knitting machine 200. It should also be noted that second cover member 234 forms a centrally-located and elongate slot 235, as depicted in FIG. 12.

Feeder arm 240 has a generally elongate configuration that extends through carrier 230 (i.e., the cavity between cover members 231, 232) and outward from a lower side of carrier 230.

Figure 13:
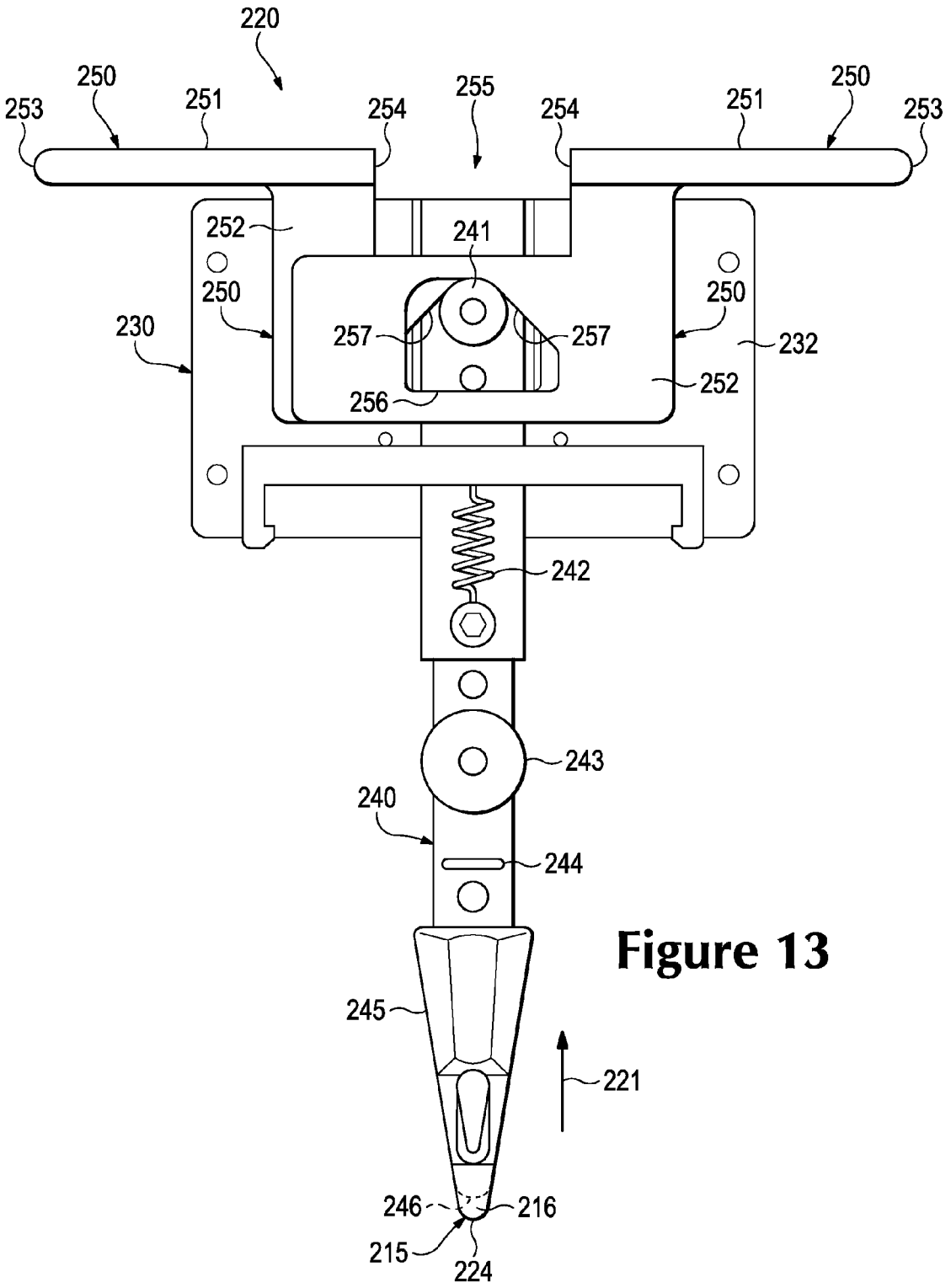
FIG. 13 is an elevational view corresponding with FIG. 10 and showing internal components of the combination feeder.
Figure 14:
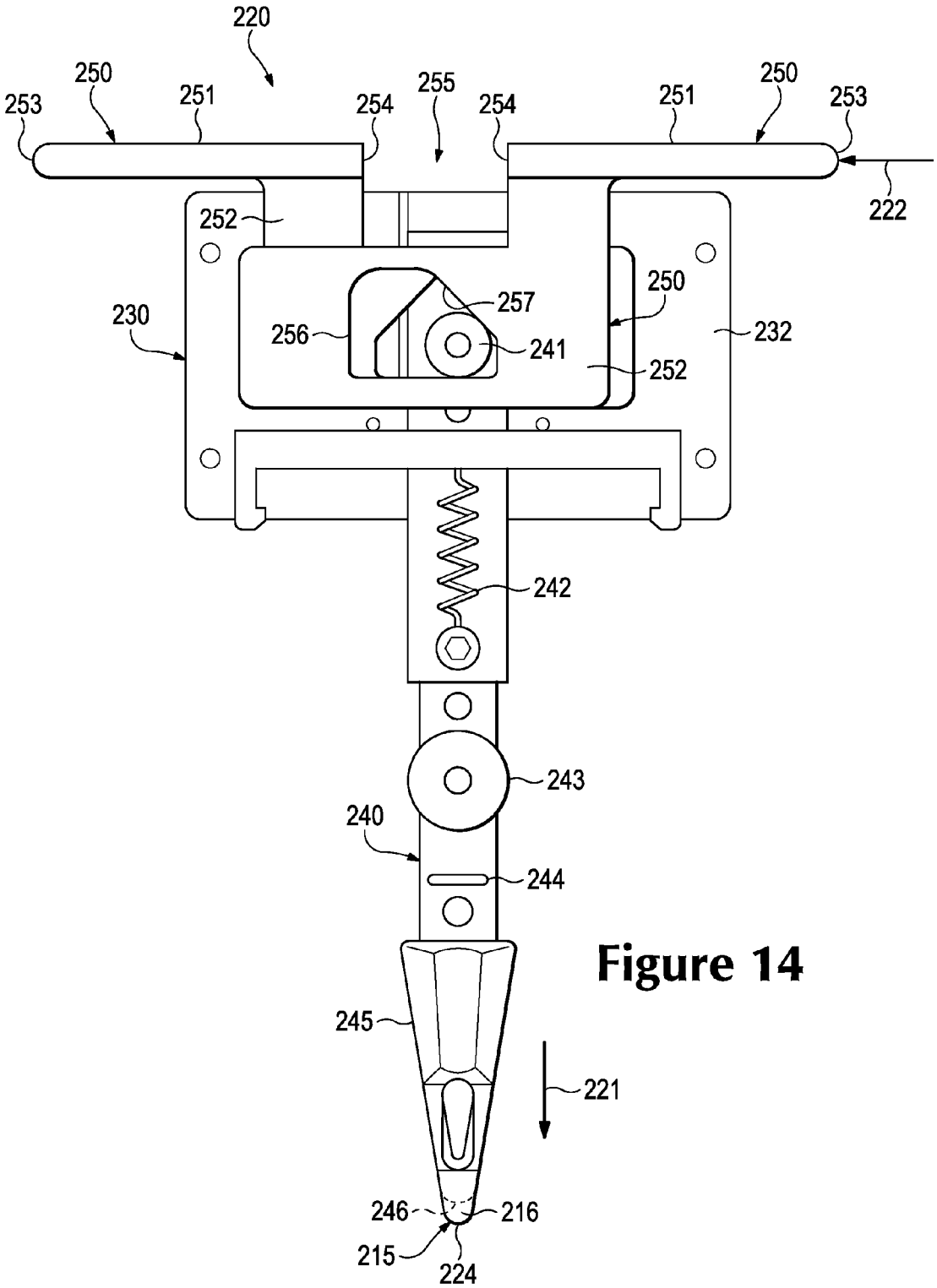
FIG. 14-16 are elevational views corresponding with FIG. 13 and showing the operation of the combination feeder.
Figure 15:
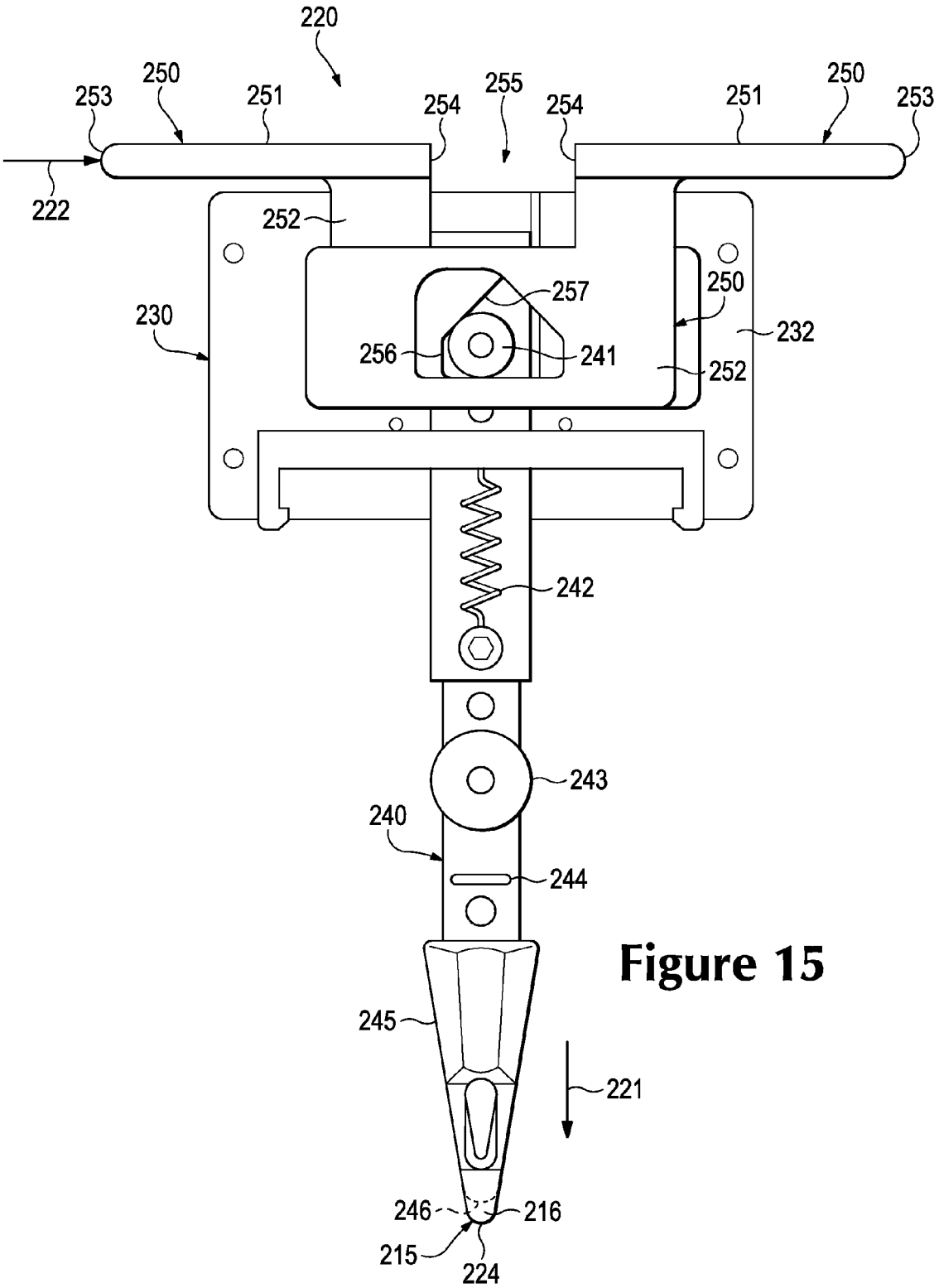

As shown in FIGS. 10 and 13, feeder arm 240 includes an actuation bolt 241, a spring 242, a pulley 243, a loop 244, and a dispensing area 245. Actuation bolt 241 extends outward from feeder arm 240 and is located within the cavity between cover members 231 and 232. One side of actuation bolt 241 is also located within slot 235 in second cover member 232, as depicted in FIG. 12. Spring 242 is secured to carrier 230 and feeder arm 240. More particularly, one end of spring 242 is secured to carrier 230, and an opposite end of spring 242 is secured to feeder arm 240. Pulley 243, loop 244, and dispensing area 245 are present on feeder arm 240 to interface with yarn 206 or another strand. Moreover, pulley 243, loop 244, and dispensing area 245 are configured to ensure that yarn 206 or another strand smoothly passes through combination feeder 220, thereby being reliably-supplied to needles 202. Referring again to FIG. 10, yarn 206 extends around pulley 243, through loop 244, and into dispensing area 245. In addition, the dispensing area 245 can terminate at a dispensing tip 246, and the yarn 206 can extend out from the dispensing tip 246 to be supplied to the needles 202 of the needle bed 201. It will be appreciated, however, that the feeder 220 could be configured differently and that the feeder 220 can be configured for actuation relative to the needle beds 201 in different ways without departing from the scope of the present disclosure.

Moreover, in some embodiments, the feeder 220 can be provided with one or more features that are configured to assist with inlaying a yarn or other strand within a knitted component. These features can also assist in otherwise incorporating strands within a knitted component during knitting processes. For instance, as shown in FIGS. 10-13, the feeder 220 can include at least one pushing member 215 that is operably supported by the feeder arm 240. The pushing member 215 can push against the knitted component to assist in inlaying yarn or other strands therein as will be discussed.

In the embodiments illustrated, the pushing member 215 includes a first projection 216 and a second projection 217, which project from opposite sides of the dispensing tip 246. Stated differently, the dispensing tip 246 can be disposed and defined between the first and second projections 216, 217. Also, an open-ended groove 223 (FIG. 11) can be collectively defined by inner surfaces of the projections 216, 217 and the dispensing tip 246.

As will be discussed, the feeder 220 can be supported on the rail 203 of the knitting machine 200 (FIG. 9), and the feeder 220 can move along the axis of the rail 203. As such, the groove 223 can extend substantially parallel to the longitudinal axis of the rail 203 and, thus, substantially parallel to the direction of movement of the feeder 220. Stated differently, the projections 216, 217 can be spaced from the dispensing tip 246 in opposite directions and substantially perpendicular to the direction of movement of the feeder 220.

In some embodiments, projections 216, 217 can have a shape that is configured to further assist in pushing the knitted component for inlaying yarns or other strands and/or for otherwise facilitating the incorporation of strands within the knitted component. For instance, the projections 216, 217 may be tapered. The projections 216, 217 can taper so as to substantially match the profile of the dispensing area 245 (see FIGS. 10, 12, and 13). Also, the projections 216, 217 can each include a terminal end 224 that is rounded convexly. The end 224 can curve three-dimensionally (e.g., hemispherically). In additional embodiments, the end 224 can curve in two dimensions.

As shown in FIG. 11, each projection 216, 217 projects generally downward from the dispensing tip 246 at a distance 218 (FIG. 11) such that the projections 216, 217 can push against the knit component during knitting processes. The distance 218 can have any suitable value, such as from approximately 1 mil (0.0254 millimeters) to approximately 5 millimeters. Each projection 216, 217 can project at substantially the same distance 218 as shown, or in additional embodiments, the projections 216, 217 can project at different distances. Furthermore, in some embodiments, the projections 216, 217 can be moveably attached to the feeder arm 240 such that the distance 218 is selectively adjustable. For instance, in some embodiments, the projections 216, 217 can have a plurality of set positions relative to the dispensing tip 213, and the user of the knitting machine 200 can select the distance 218 that the projections 216, 217 project from the tip 213.

The projections 216, 217 can be made from any suitable material. For instance, in some embodiments, the projections 216, 217 can be made from and/or include a metallic material, such as steel, titanium, aluminum, and the like. Also, in some embodiments, the projections 216, 217 can be made from a polymeric material. Moreover in some embodiments, the projections 216, 217 can be at least partially made from a ceramic material, such that the projections 216, 217 can have high strength and can have a low surface roughness. As such, the projections 216, 217 are unlikely to damage the yarn 206 and/or the knitted component 130 during use of the feeder 220.

In some embodiments, the projections 216, 217 can be integrally connected to the dispensing area 245 so as to be monolithic. For instance, the dispensing area 246 and projections 216, 217 can be formed together in a common mold or machined from a block of material. In additional embodiments, the projections 216, 217 can be removably attached to the dispensing area 245 of the feeder 220 via fasteners, adhesives, or other suitable ways.

Referring back to FIGS. 10-13, the actuation members 250 of the feeder 220 will be discussed. Each of actuation members 250 includes an arm 251 and a plate 252. Each of arms 251 can be elongate and can define an outside end 253 and an opposite inside end 254. Each plate 252 can be flat and generally rectangular.

In some configurations of actuation members 250, each arm 251 is formed as a one-piece (monolithic) element with one of the plates 252. The arms 251 and/or plates 252 can be made from a metal, nylon or from another suitable material.

The arms 251 can be located outside of carrier 230 and at an upper side of carrier 230, and the plates 252 can be located within carrier 250. Arms 251 are positioned to define a space 255 between both of inside ends 254. That is, arms 251 are spaced from each other longitudinally. Also, as shown in FIG. 11, the arms 251 can be spaced transversely such that one arm 251 is disposed closer to the first cover member 231, and the other arm 251 is disposed closer to the second cover member 232.

The arms 251 can additionally include one or more features that assist in engaging and/or disengaging the drive bolts 219. The arms 251 can be shaped so as to facilitate engagement and/or disengagement of the drive bolts 219. Also, the arms 251 can include other features that reduce friction during disengagement. This can reduce the likelihood of the feeder 220 missing stitches or otherwise causing errors during the knitting process.

For instance, in the embodiments illustrated in FIGS. 10, 12, and 13, the outside end 253 of each arm 251 can be rounded and convex. In some embodiments, the end 253 can be two-dimensionally curved (i.e., in the plane of FIGS. 10, 12, and 13). In additional embodiments, the end 253 can be hemispherical so as to be three-dimensionally curved. Additionally, the ends 253 can have a relatively low surface roughness. For instance, in some embodiments, the ends 253 can be polished. Moreover, the ends 253 can be treated with a lubricant. Also, although the inside ends 254 of the arms 251 are substantially planar in the embodiments illustrated, the inside ends 254 can be rounded and convex, similar to the outside ends 253 shown in FIGS. 10, 12, and 13.

Referring to FIG. 13, each of plates 252 define an aperture 256 with an inclined edge 257. Moreover, actuation bolt 241 of feeder arm 240 extends into each aperture 256.

The configuration of combination feeder 220 discussed above provides a structure that facilitates a translating movement of feeder arm 240. As discussed in greater detail below, the translating movement of feeder arm 240 selectively positions dispensing tip 246 at a location that is above or below the intersection of needle beds 201 (compare FIGS. 20 and 21). That is, dispensing tip 246 has the ability to reciprocate through the intersection of needle beds 201. An advantage to the translating movement of feeder arm 240 is that combination feeder 220 (a) supplies yarn 206 for knitting, tucking, and floating when dispensing tip 246 is positioned above the intersection of needle beds 201 and (b) supplies yarn 206 or another strand for inlaying when dispensing tip 246 is positioned below the intersection of needle beds 201. Moreover, feeder arm 240 reciprocates between the two positions depending upon the manner in which combination feeder 220 is being utilized.

Figure 20:
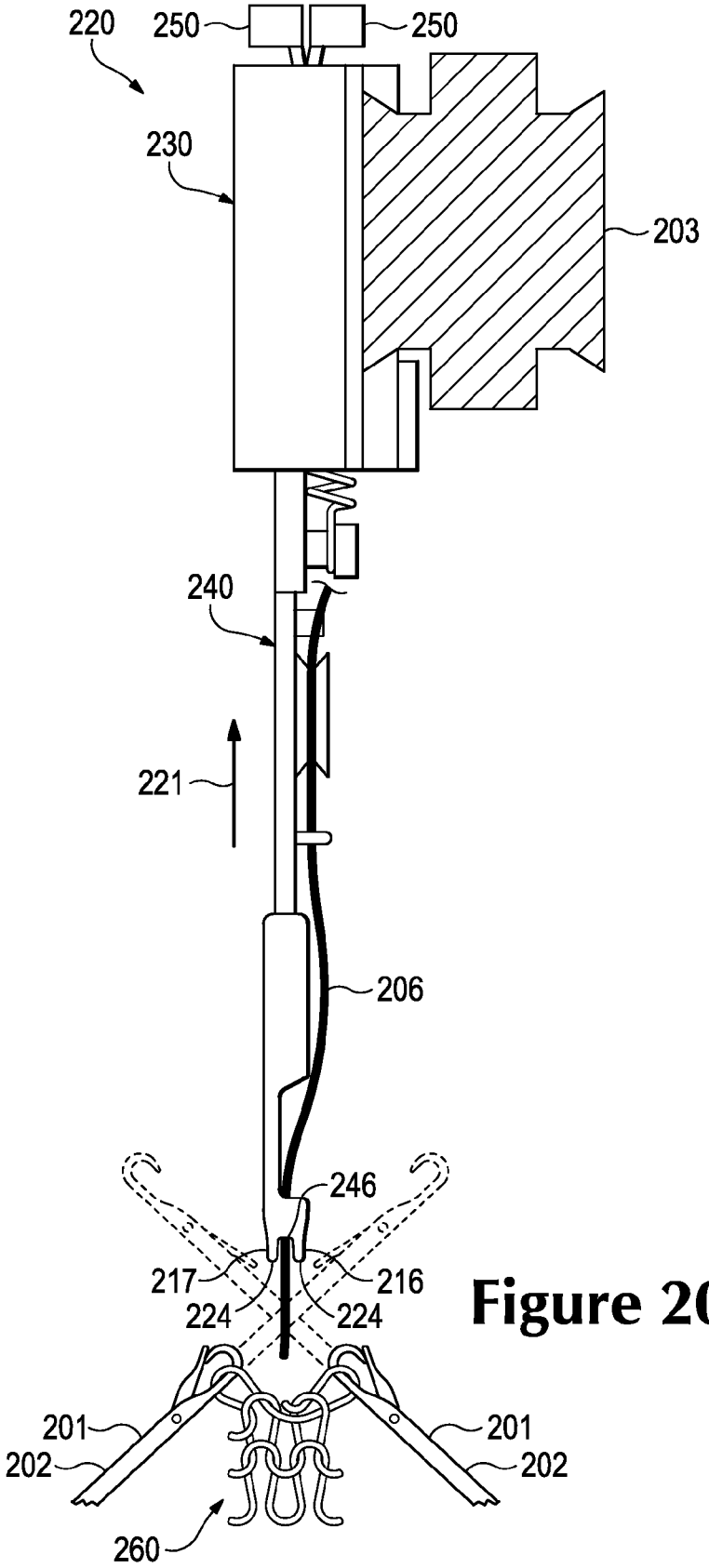
FIGS. 20 and 21 are end views of the combination feeder of FIGS. 10-16 shown inlaying a strand into the knit component of FIG. 19, wherein the combination feeder is shown in the retracted position in FIG. 20, and wherein the combination feeder is shown in the extended position in FIG. 21.
Figure 21:
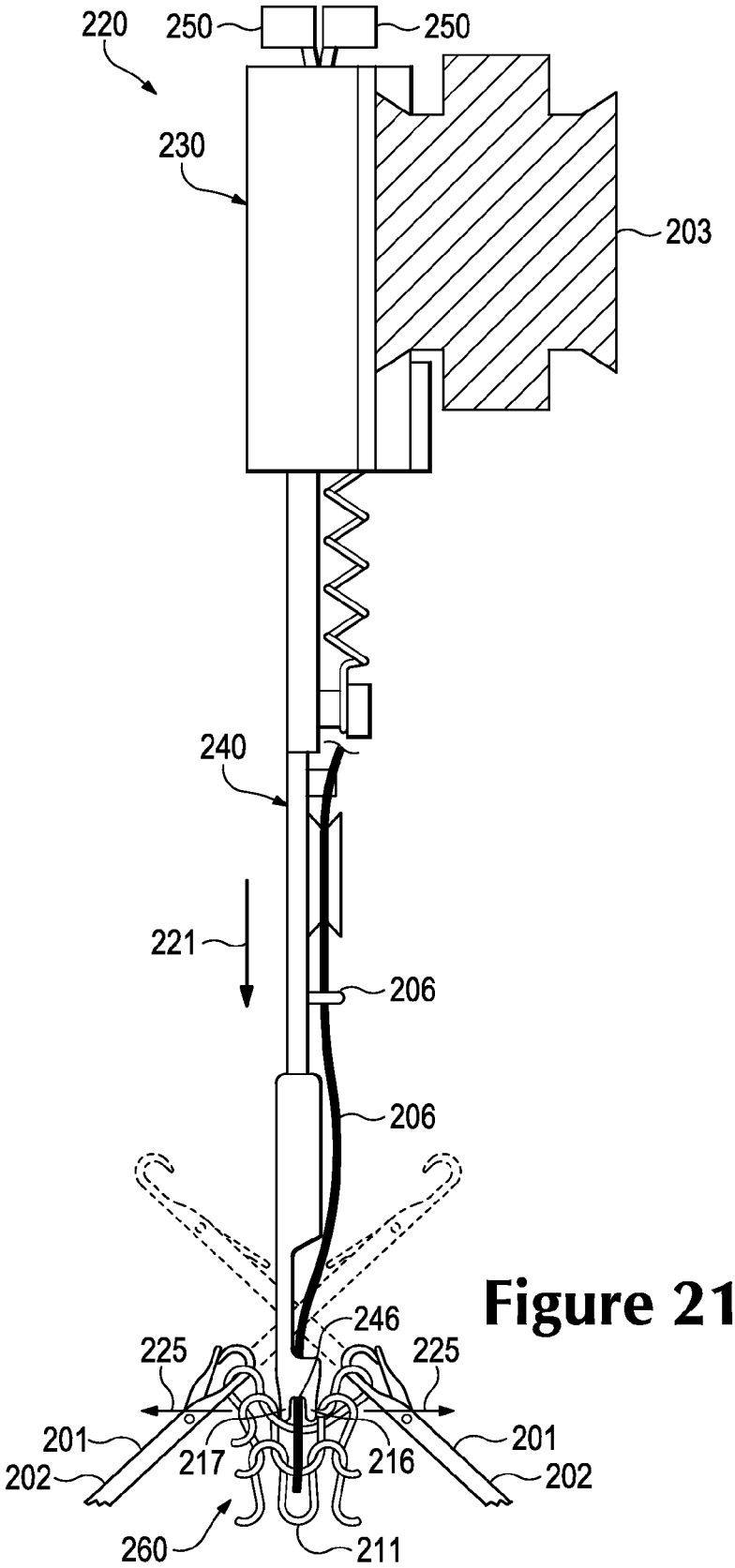

In reciprocating through the intersection of needle beds 201, feeder arm 240 translates from a retracted position to an extended position. When in the retracted position, dispensing tip 246 is positioned above the intersection of needle beds 201 (FIG. 20). When in the extended position, dispensing tip 246 is positioned below the intersection of needle beds 201 (FIG. 21). Dispensing tip 246 is closer to carrier 230 when feeder arm 240 is in the retracted position than when feeder arm 240 is in the extended position. Similarly, dispensing tip 246 is further from carrier 230 when feeder arm 240 is in the extended position than when feeder arm 240 is in the retracted position. In other words, dispensing tip 246 moves away from carrier 230 and toward the needle bed 201 when moving toward the extended position, and dispensing tip 246 moves closer to carrier 230 and away from the needle bed 201 when moving toward the retracted position.

For purposes of reference in FIGS. 13-16, an arrow 221 is positioned adjacent to dispensing area 245. When arrow 221 points upward or toward carrier 230, feeder arm 240 is in the retracted position. When arrow 221 points downward or away from carrier 230, feeder arm 240 is in the extended position. Accordingly, by referencing the position of arrow 221, the position of feeder arm 240 may be readily ascertained.

Figure 16:
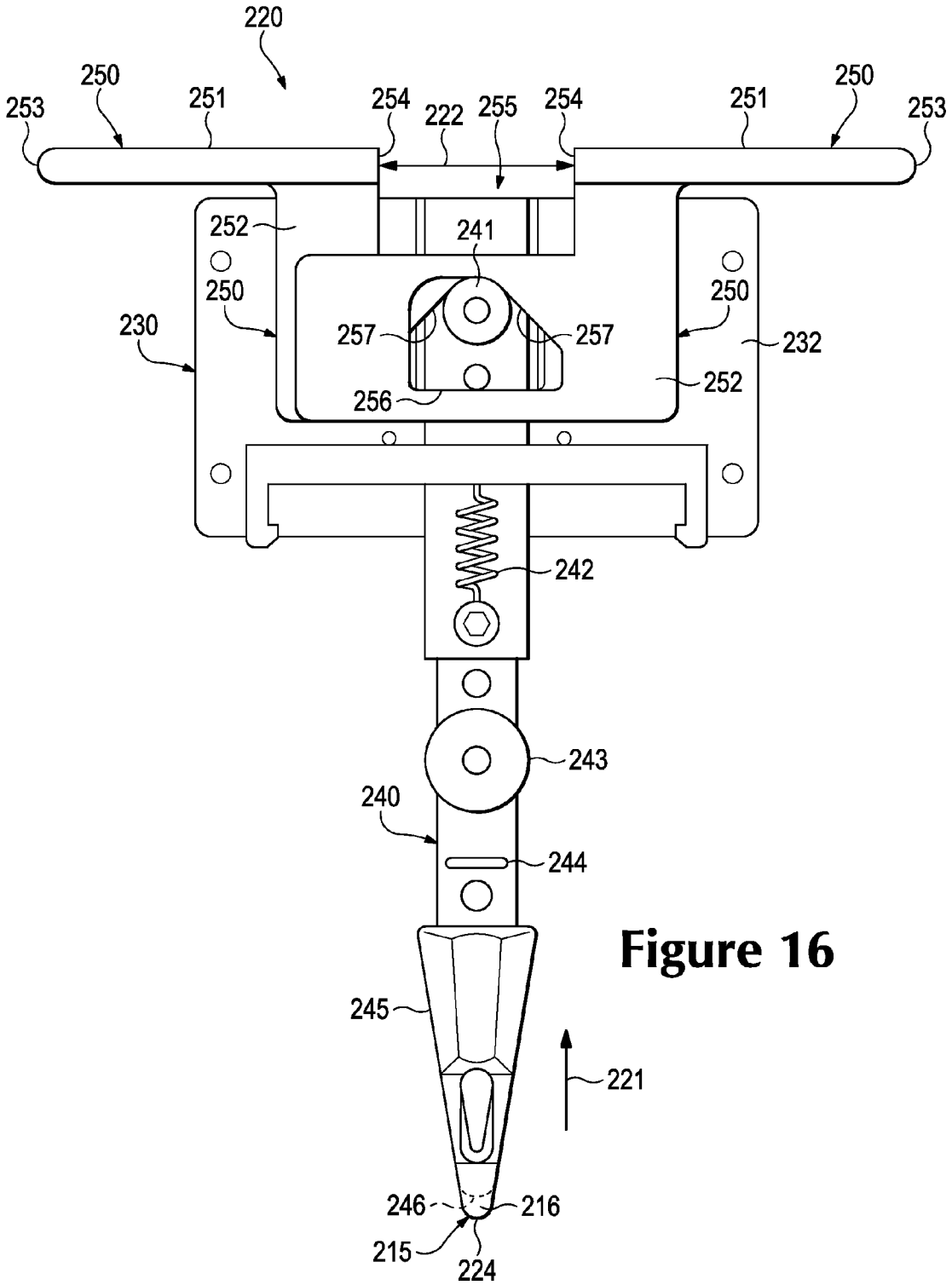

The spring 242 can bias the feeder arm 240 toward the retracted position (i.e., the neutral state of the feeder arm 240) as shown in FIG. 13. The feeder arm 240 can move from the retracted position toward the extended position when a sufficient force is applied to one of arms 251. More particularly, the extension of feeder arm 240 occurs when a sufficient force 222 is applied to one of outside ends 253 and is directed toward space 255 (see FIGS. 14 and 15). Accordingly, feeder arm 240 moves to the extended position as indicated by arrow 221. Upon removal of force 222, however, feeder arm 240 will return to the retracted position due to the biasing force of the spring 242. It should also be noted that FIG. 16 depicts force 222 as acting upon inside ends 254 and being directed outward. As a result, the feeder 220 will move horizontally (along the rail 203), and yet the feeder arm 240 remains in the retracted position.

FIGS. 13-16 depict combination feeder 220 with first cover member 231 removed, thereby exposing the elements within the cavity in carrier 230. By comparing FIG. 13 with FIGS. 14 and 15, the manner in which force 222 induces feeder arm 240 to extend and retract may be apparent. When force 222 acts upon one of outside ends 253, one of actuation members 250 slides in a direction that is perpendicular to the length of feeder arm 240. That is, one of actuation members 250 slides horizontally in FIGS. 14 and 15. The movement of one of actuation members 250 causes actuation bolt 241 to engage one of inclined edges 257. Given that the movement of actuation members 250 is constrained to the direction that is perpendicular to the length of feeder arm 240, actuation bolt 241 rolls or slides against inclined edge 257 and induces feeder arm 240 to translate to the extended position. Upon removal of force 222, spring 242 pulls feeder arm 240 from the extended position to the retracted position.

Movement of Feeders Relative to Needle Bed

As mentioned above, feeders 204 and 220 move along rails 203 and over the needle beds 201 due to the action of carriage 205 and drive bolt(s) 219. More particularly, respective drive bolts 219 extended from carriage 205 can contact feeders 204 and 220 to push feeders 204 and 220 along the rails 203 to move over the needle beds 201. More specifically, as shown in FIG. 18, the drive bolt 219 can extend downward from the carriage 205, and horizontal movement of the carriage 205 can cause the drive bolt 219 to push against the outside end 253, thereby moving the feeder 220 horizontally in tandem with the carriage 205. Alternatively, the drive bolt 219 can abut against one of the inside ends 254 to move the feeder 240 along the rail 203. Drive bolt 219 can also selectively push against an arm of the first feeder 204 (similar to drive bolt 219 pushing against arm 251 of the combination feeder 220) to move the first feeder 204 over the needle bed 201. As a result of this movement, the feeders 204, 220 can be used to feed yarn 206 or other strands toward the needle beds 201 to produce the knitted component 130.

With respect to combination feeder 220, the drive bolt 219 can also cause the feeder arm 240 to move from the retracted position toward the extended position. As shown in FIG. 18, when the drive bolt 219 abuts and pushes against one of outside ends 253, feeder arm 240 translates to the extended position. As a result, the dispensing tip 246 passes below the intersection of needle beds 201 as shown in FIG. 21.

The drive bolt 219 can then move from the extended position (FIG. 18) to the retracted position (FIG. 17) to disengage from the end 253. The spring 242 can bias the feeder 220 back to the retracted position as a result as indicated by the arrow 221 in FIG. 17.

It will be appreciated that frictional forces can inhibit disengagement of the drive bolt 219 from the end 253 of the feeder 220. Also, in the case of the combination feeder 220, the return force of the spring 242 and/or tension in the yarn 206 can cause the end 253 to be pressed into the bolt 219 with significant force, thereby increasing frictional engagement with the bolt 219. If the bolt 219 fails to disengage, the feeder 220 can erroneously remain in the extended position, the bolt 219 could move the feeder 220 too far in the longitudinal direction, and the like, and the knitted component may be formed erroneously. However, the convexly rounded shape of the end 253 can facilitate disengagement of the bolt 219 from the end 253. This is because the convex and round surface of the end 253 can reduce the area of contact between the drive bolt 219 and the end 253. Polishing and/or lubricating the end 253 can also reduce friction. Therefore, the drive bolt 219 is better able to disengage from the end 253, the feeder 220 can operate more accurately and efficiently, and speed of the knitting process can be improved. Furthermore, the drive bolt 219 and/or end 253 is less prone to wear over time after repeatedly disengaging from each other.

It will also be appreciated that the inside ends 254 can be curved and convex, can be polished, treated with lubricant, or otherwise similar to the ends 253 described in detail herein. As such, the drive bolts 219 can similarly disengage the ends 254 more efficiently. Moreover, the first feeders 204 can include actuation members with rounded, convex ends that are similar to the ends 253 described in detail herein. Embodiments of the first feeders 204 with rounded ends 253 are shown, for instance, in FIG. 22.

Figure 31:
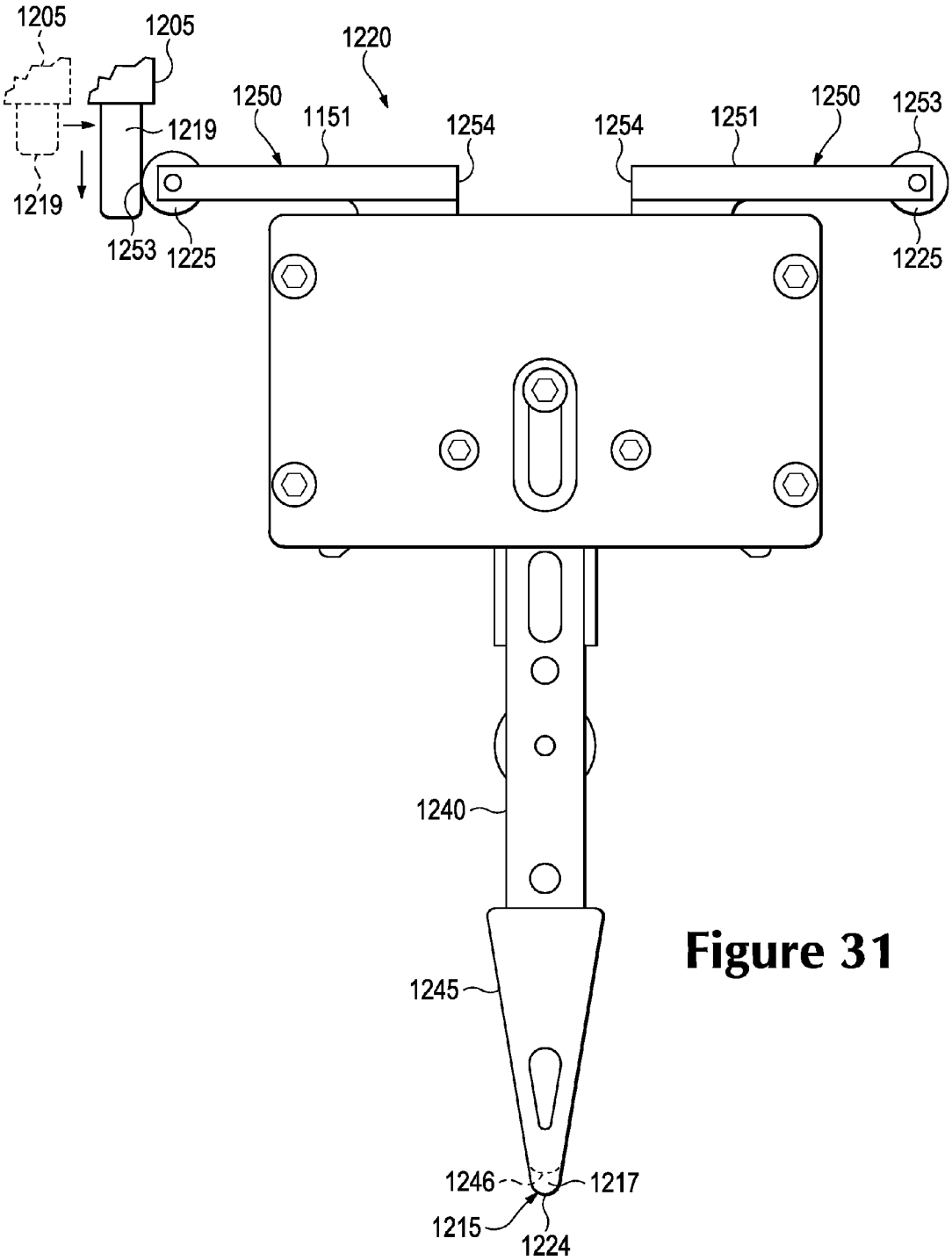
FIG. 31 is an elevational view of a combination feeder according to additional exemplary embodiments of the present disclosure.

FIG. 31 also illustrates additional embodiments of a combination feeder 1220 that can disengage from the drive bolts 1219 with increased efficiency. The feeder 1220 can be substantially similar to the feeder 220 described above. However, the feeder 1220 can include actuation members 1250, each with a base arm 1251 and a bearing 1225. The bearing 1225 can be a barrel-shaped wheel that is rotatably attached to the base arm 1251. The outer radial surface of the bearing 1225 can define a convexly curved outer end 1253 of the actuation member 1250. The bearing 1225 can rotate relative to the arm 1251 when the drive bolt 1219 disengages the feeder 1220. As such, disengagement between the drive bolt 1219 and the feeder 1220 can be facilitated. It will be appreciated that the first feeder 204 can include similar bearings 1225 to thereby reduce frictional engagement with the drive bolt 1219. Also, it will be appreciated that the inner ends 1254 can include similar bearings 1225.

Knitting Process

Figure 22:
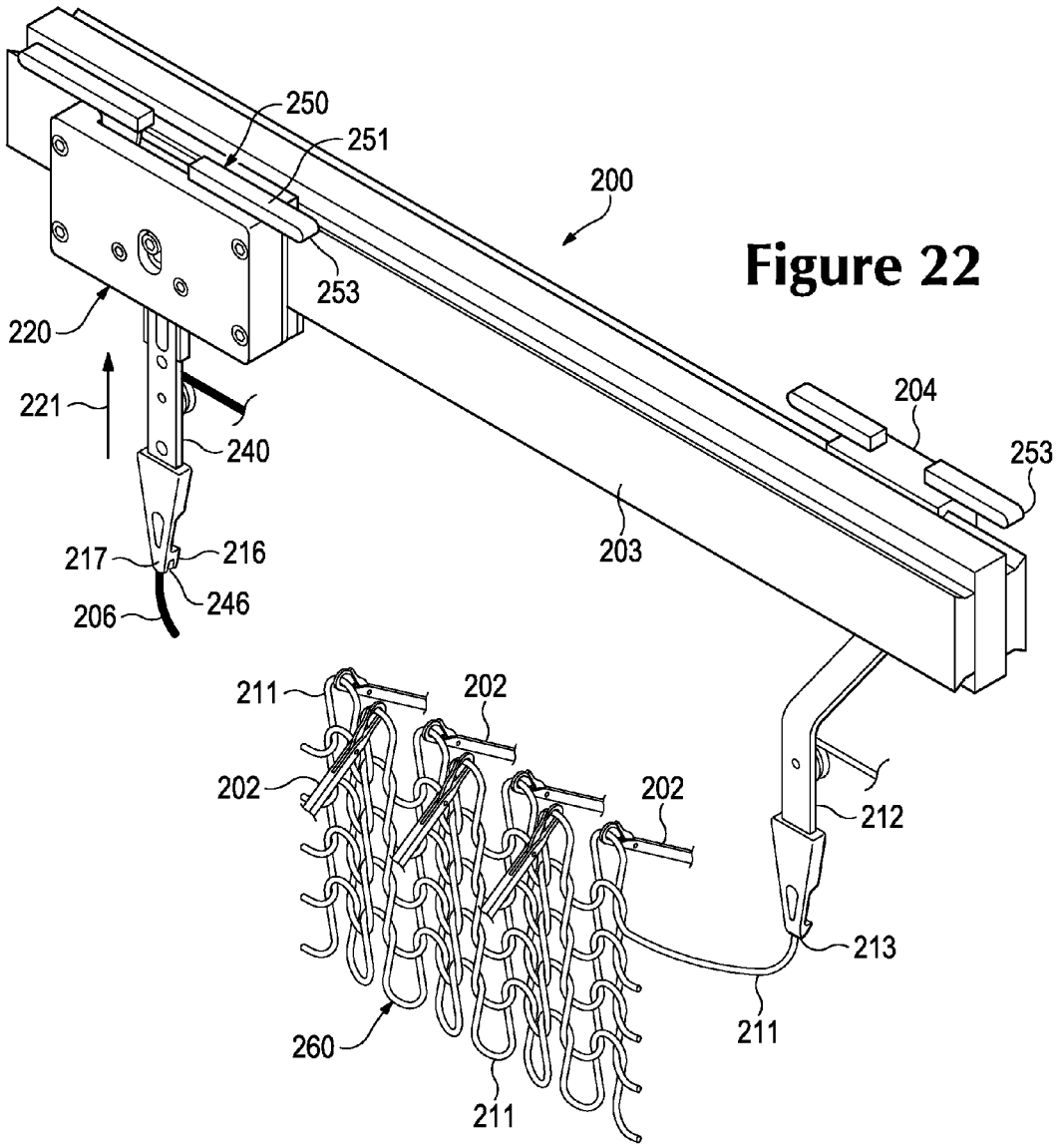
FIGS. 22-30 are schematic perspective views of a knitting process utilizing the combination feeder and a conventional feeder.

The manner in which knitting machine 200 operates to manufacture a knitted component 130 will now be discussed in detail. Moreover, the following discussion will demonstrate the operation of first feeders 204 and combination feeder 220 during a knitting process. Referring to FIG. 22, a portion of knitting machine 200 that includes various needles 202, rail 203, first feeder 204, and combination feeder 220 is depicted. Whereas combination feeder 220 is secured to a front side of rail 203, first feeder 204 is secured to a rear side of rail 203. Yarn 206 passes through combination feeder 220, and an end of yarn 206 extends outward from dispensing tip 246. Although yarn 206 is depicted, any other strand (e.g., filament, thread, rope, webbing, cable, chain, or yarn) may pass through combination feeder 220. Another yarn 211 passes through first feeder 204 and forms a portion of a knitted component 260, and loops of yarn 211 forming an uppermost course in knitted component 260 are held by hooks located on ends of needles 202.

The knitting process discussed herein relates to the formation of knitted component 260, which may be any knitted component, including knitted components that are similar to knitted component 130 discussed above in relation to FIGS. 5 and 6. For purposes of the discussion, only a relatively small section of knitted component 260 is shown in the figures in order to permit the knit structure to be illustrated. Moreover, the scale or proportions of the various elements of knitting machine 200 and knitted component 260 may be enhanced to better illustrate the knitting process.

Figure 19:
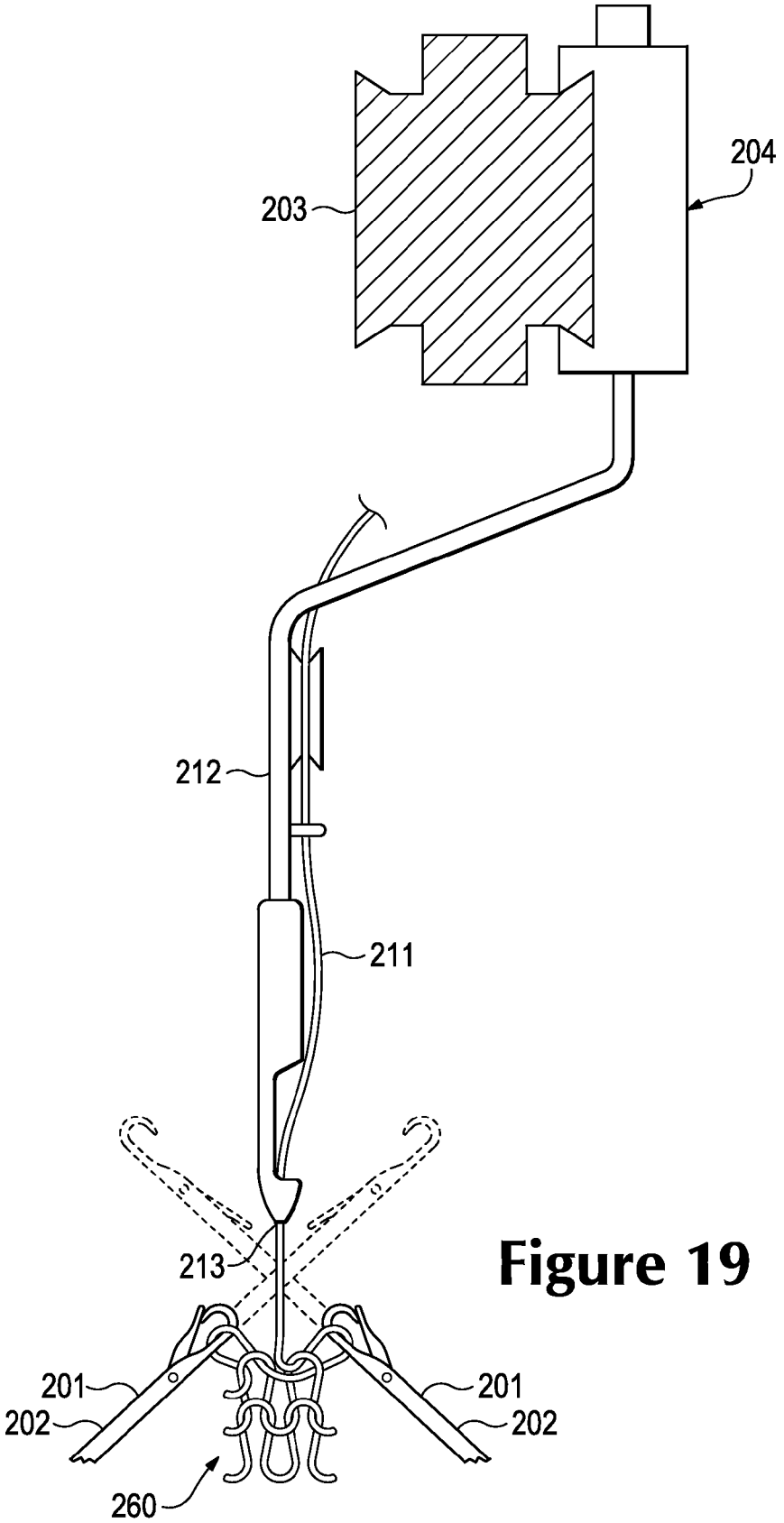
FIG. 19 is an end view of a conventional feeder knitting a knit component.

First feeder 204 includes a feeder arm 212 with a dispensing tip 213. Feeder arm 212 is angled to position dispensing tip 213 in a location that is (a) centered between needles 202 and (b) above an intersection of needle beds 201. FIG. 19 depicts a schematic cross-sectional view of this configuration. Note that needles 202 lay on different planes, which are angled relative to each other. That is, needles 202 from needle beds 201 lay on the different planes. Needles 202 each have a first position and a second position. In the first position, which is shown in solid line, needles 202 are retracted. In the second position, which is shown in dashed line, needles 202 are extended. In the first position, needles 202 are spaced from the intersection of the planes upon which needle beds 201 lay. In the second position, however, needles 202 are extended and pass through the intersection of the planes upon which needle beds 201 lay. That is, needles 202 cross each other when extended to the second position. It should be noted that dispensing tip 213 is located above the intersection of the planes. In this position, dispensing tip 213 supplies yarn 211 to needles 202 for purposes of knitting, tucking, and floating.

Combination feeder 220 is in the retracted position, as evidenced by the orientation of arrow 221 in FIG. 22. Feeder arm 240 extends downward from carrier 230 to position dispensing tip 246 in a location that is (a) centered between needles 202 and (b) above the intersection of needle beds 201. FIG. 20 depicts a schematic cross-sectional view of this configuration.

Figure 23:
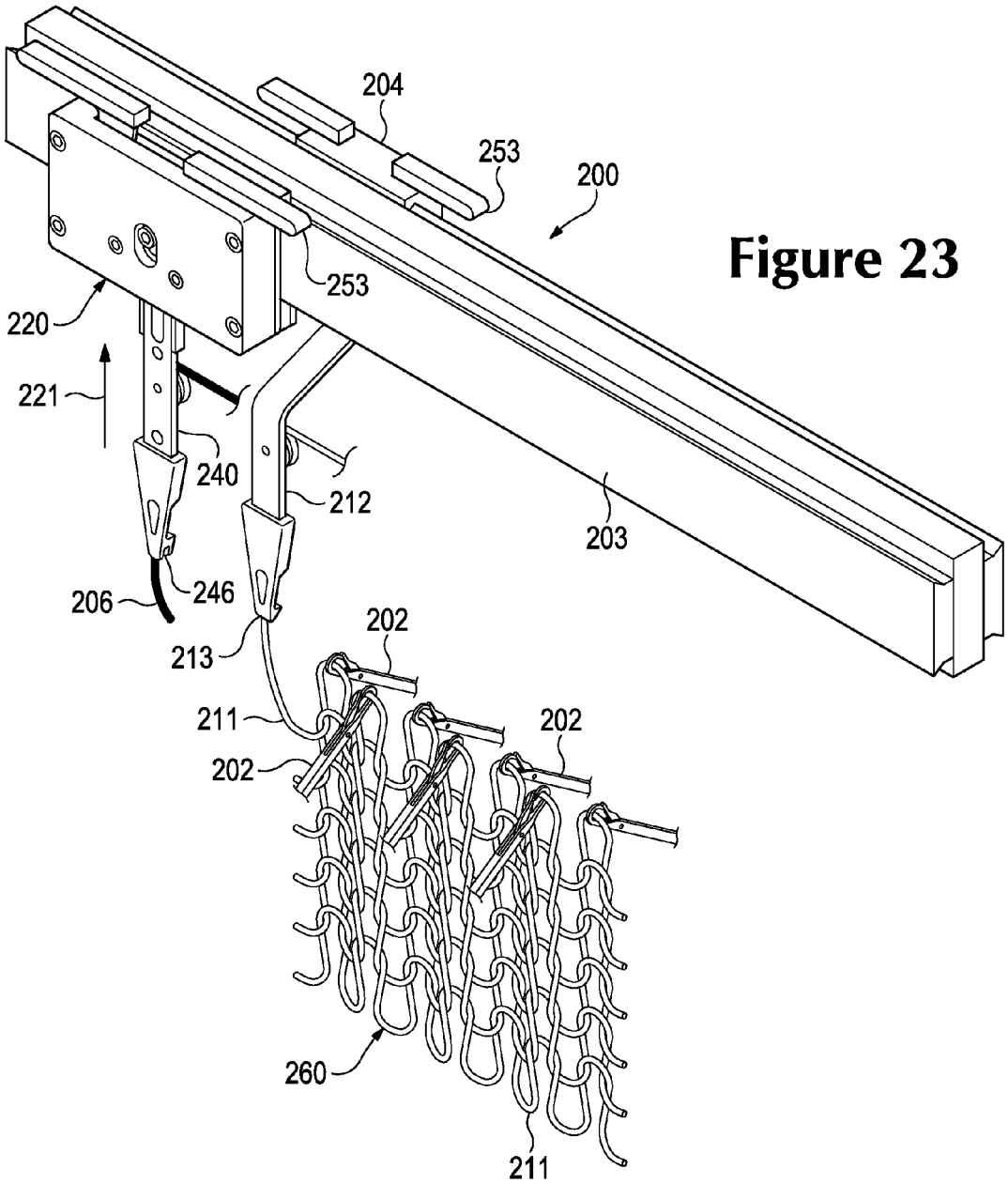

Referring now to FIG. 23, first feeder 204 moves along rail 203 and a new course is formed in knitted component 260 from yarn 211. More particularly, needles 202 pull sections of yarn 211 through the loops of the prior course, thereby forming the new course. Accordingly, courses may be added to knitted component 260 by moving first feeder 204 along needles 202, thereby permitting needles 202 to manipulate yarn 211 and form additional loops from yarn 211.

Figure 24:
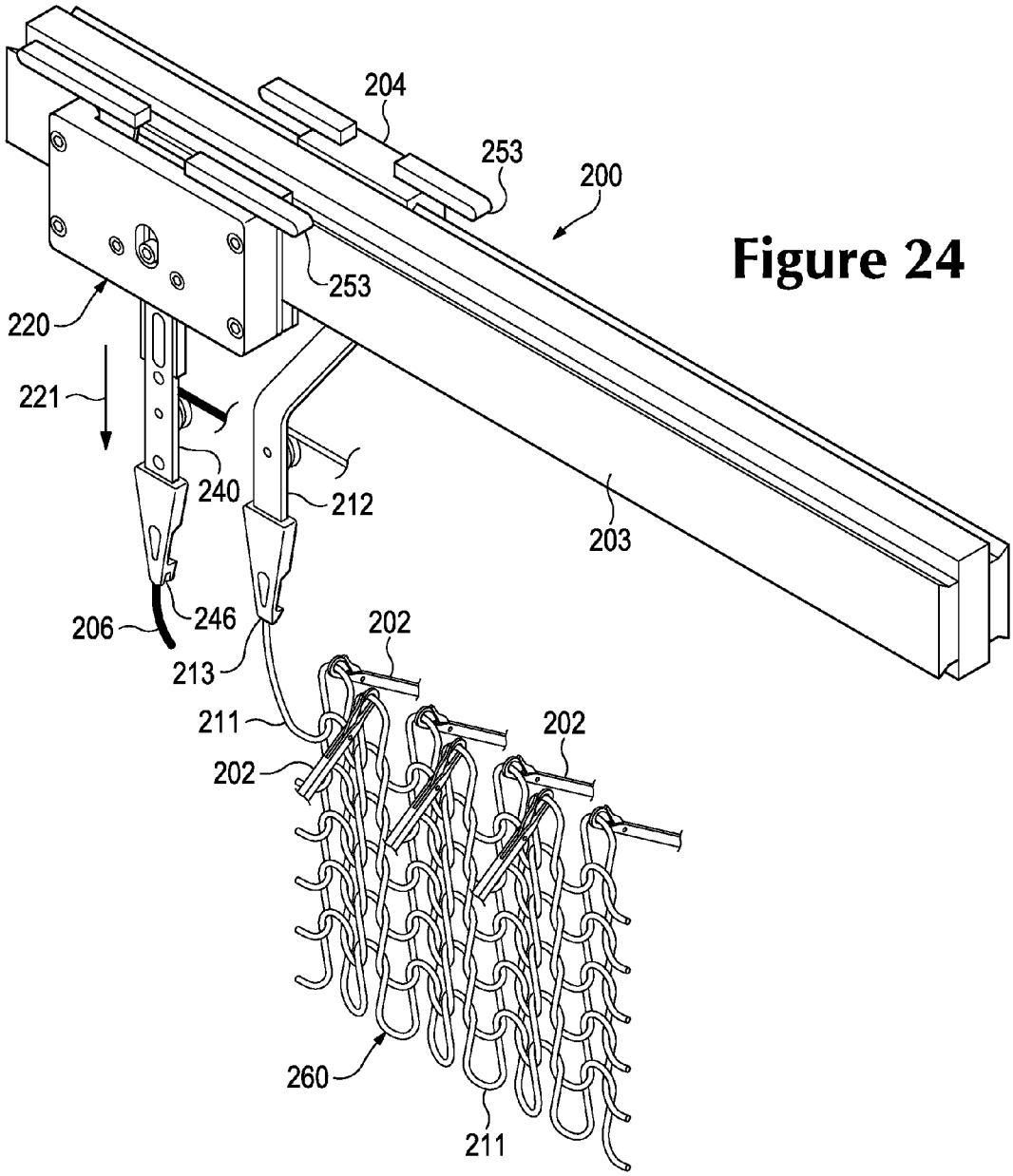

Continuing with the knitting process, feeder arm 240 now translates from the retracted position to the extended position, as depicted in FIG. 24. In the extended position, feeder arm 240 extends downward from carrier 230 to position dispensing tip 246 in a location that is (a) centered between needles 202 and (b) below the intersection of needle beds 201. FIG. 21 depicts a schematic cross-sectional view of this configuration. Note that dispensing tip 246 is positioned below the location of dispensing tip 246 in FIG. 22B due to the translating movement of feeder arm 240.

Figure 25:
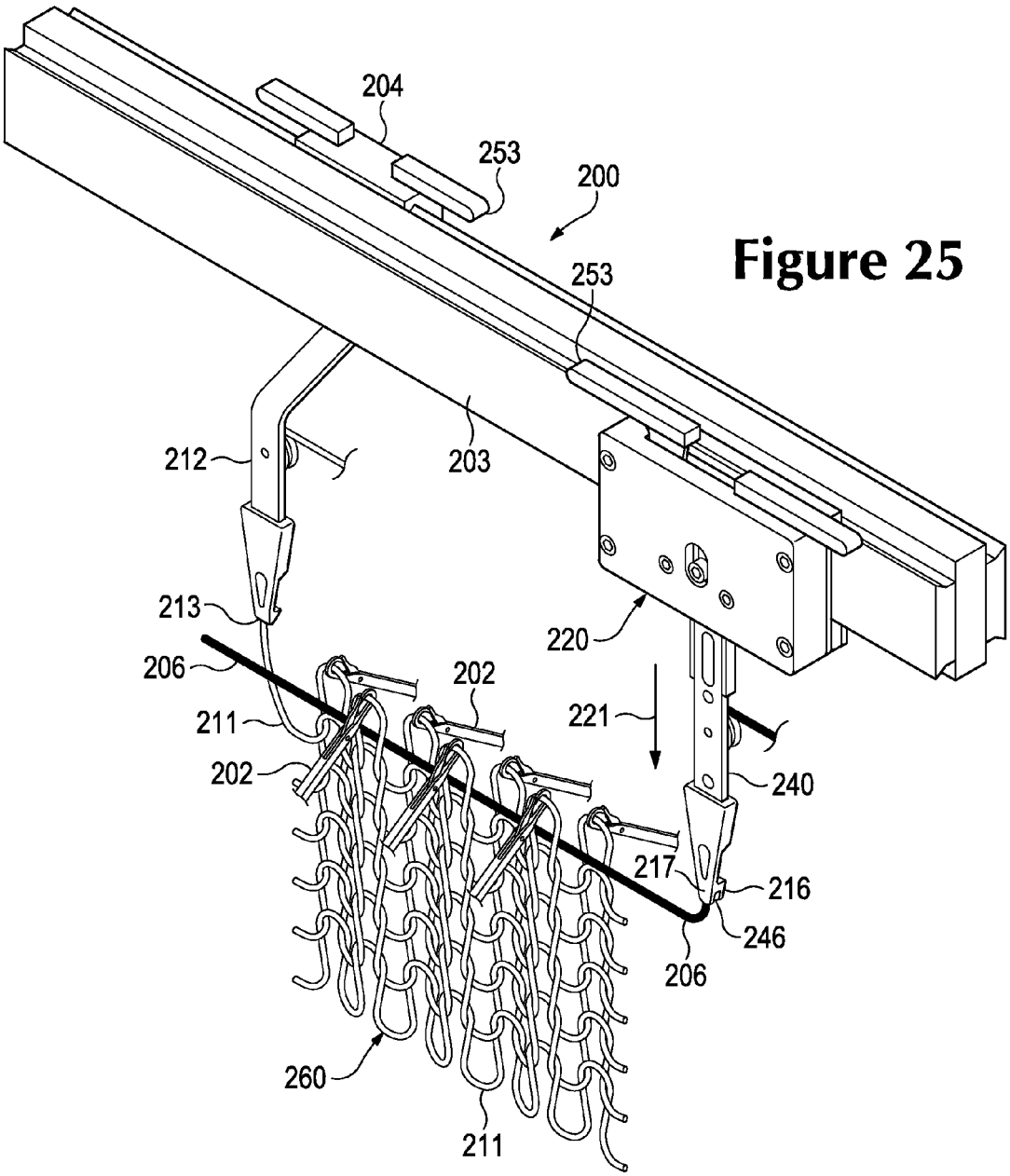

Referring now to FIG. 25, combination feeder 220 moves along rail 203 and yarn 206 is placed between loops of knitted component 260. That is, yarn 206 is located in front of some loops and behind other loops in an alternating pattern. Moreover, yarn 206 is placed in front of loops being held by needles 202 from one needle bed 201, and yarn 206 is placed behind loops being held by needles 202 from the other needle bed 201. Note that feeder arm 240 remains in the extended position in order to lay yarn 206 in the area below the intersection of needle beds 201. This effectively places yarn 206 within the course recently formed by first feeder 204 in FIG. 23.

Also, it is noted that the projections 216, 217 of the feeder 220 can push aside the yarn 211 within the previously-formed course of the knitted component 260 as the feeder 220 moves across the knitted component 260. Specifically, as shown in FIG. 21, the projections 216, 217 can push the knitted yarns 211 horizontally (as represented by arrows 225) to widen the course and provide ample clearance for the yarn 206 to be inlaid. In some embodiments, the projections 216, 217 can also push the knitted yarns 211 downward. Thus, even if the yarns 211, 206 have a relatively large diameter, the yarn 206 can be effectively laid within the course of the knitted component 260. Also, because the ends of the projections 216, 217 are rounded, the projections 216, 217 can assist in preventing tearing or otherwise damaging the yarns 211.

Figure 26:
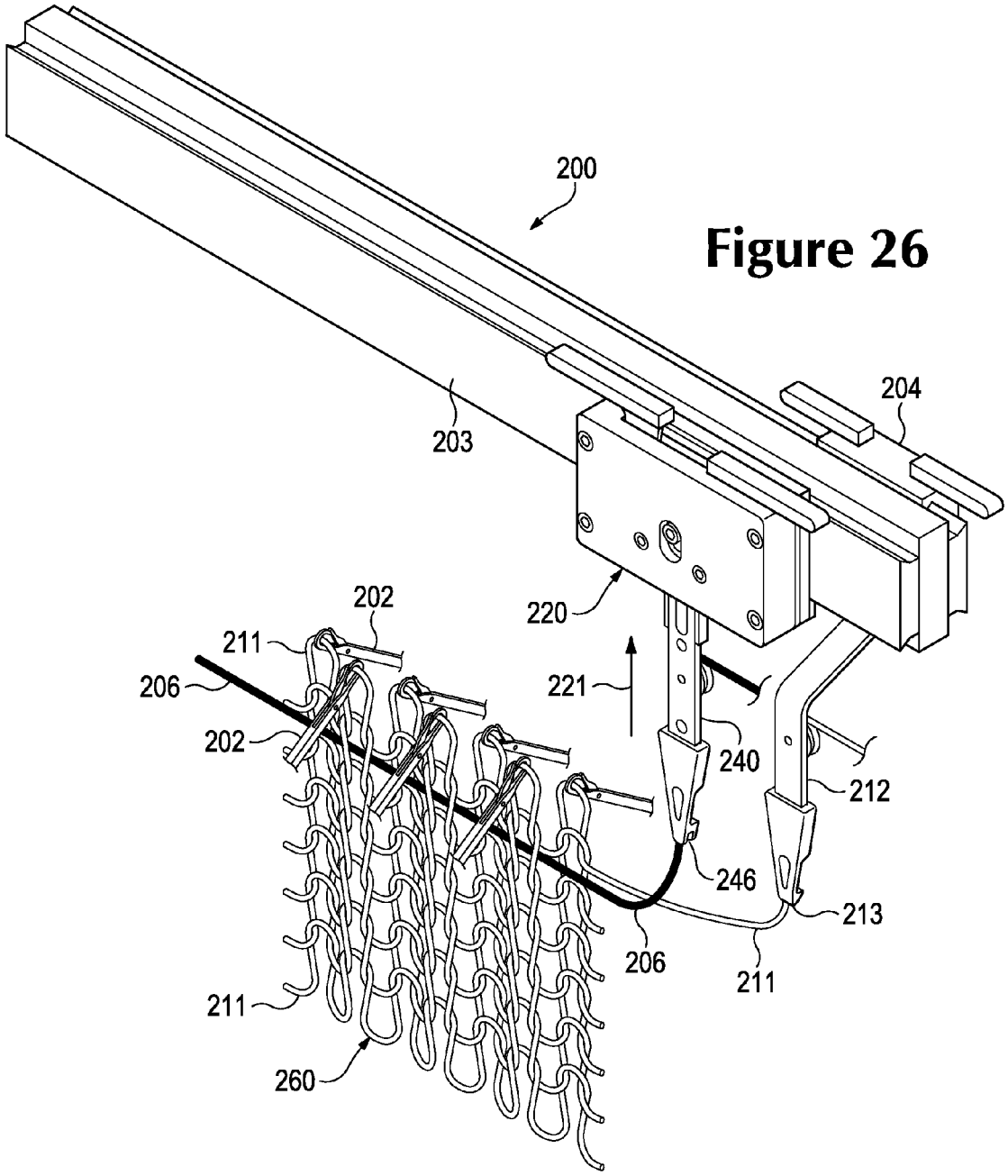

In order to complete inlaying yarn 206 into knitted component 260, first feeder 204 moves along rail 203 to form a new course from yarn 211, as depicted in FIG. 26. By forming the new course, yarn 206 is effectively knit within or otherwise integrated into the structure of knitted component 260. At this stage, feeder arm 240 may also translate from the extended position to the retracted position.

The general knitting process outlined in the above discussion provides an example of the manner in which inlaid strand 132 may be located in knit element 131. More particularly, knitted component 130 may be formed by utilizing combination feeder 220 to effectively insert inlaid strands 132 and 152 into knit elements 131. Given the reciprocating action of feeder arm 240, inlaid strands may be located within a previously formed course prior to the formation of a new course.

Figure 27:
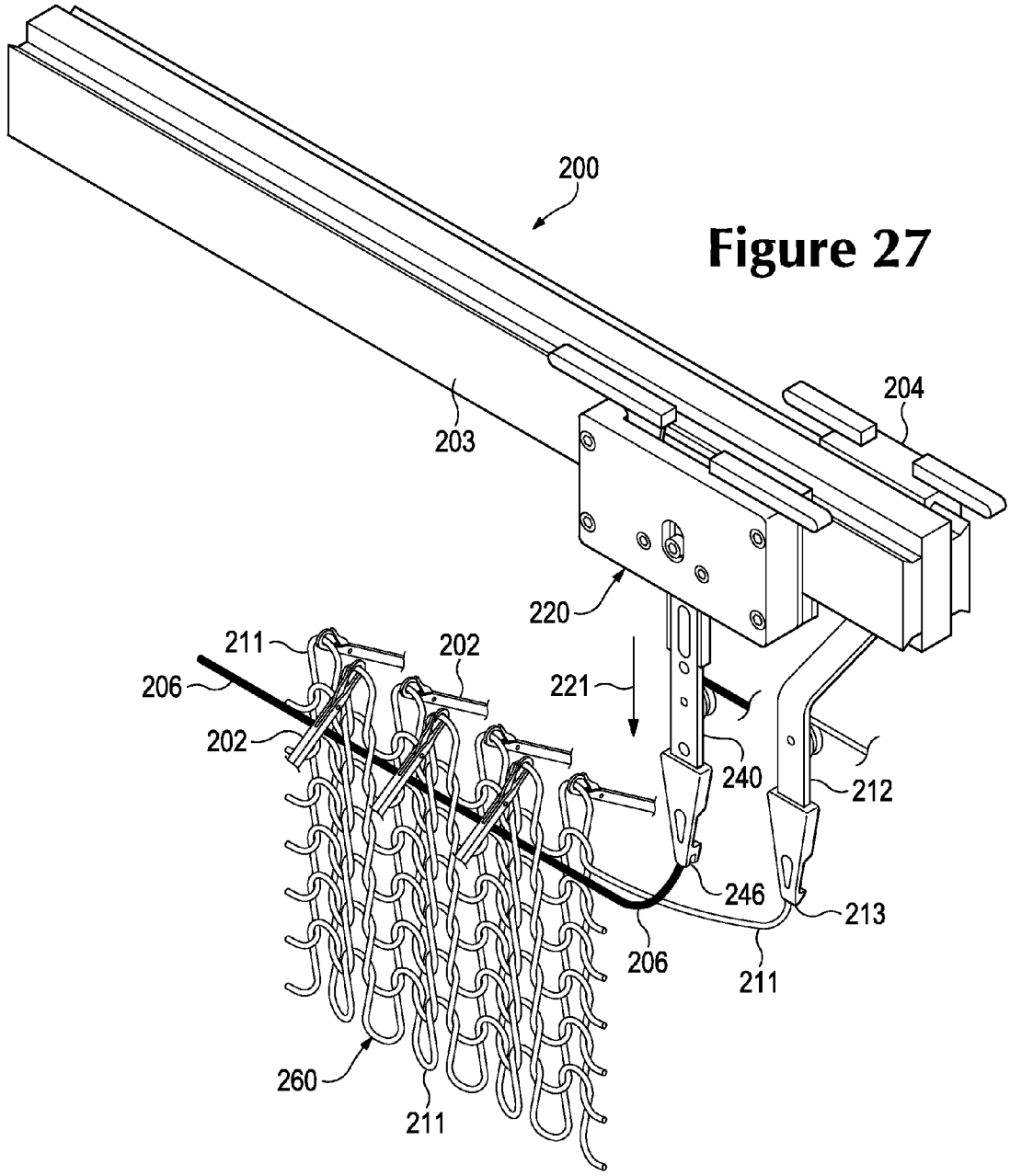
Figure 28:
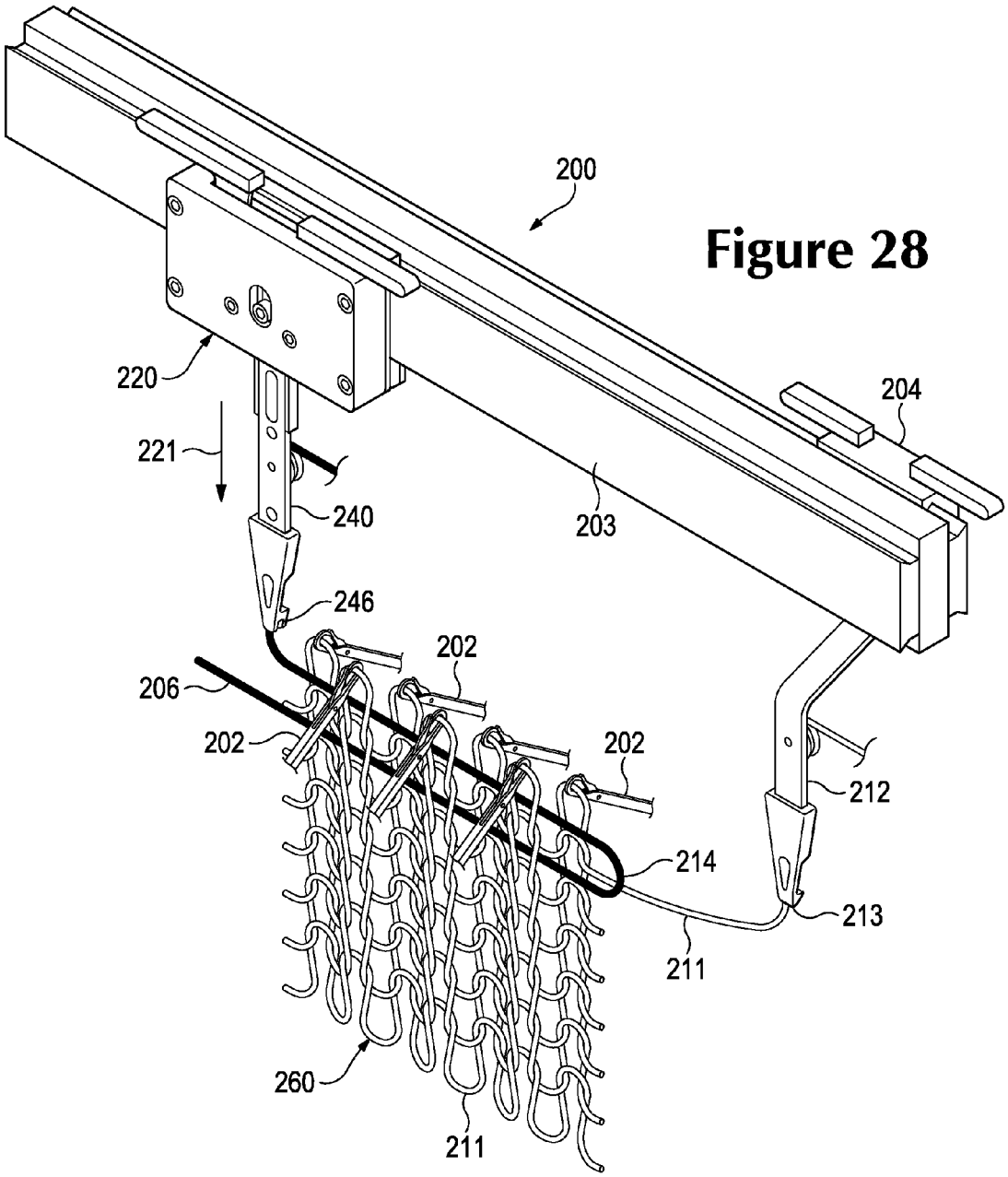
Figure 29:
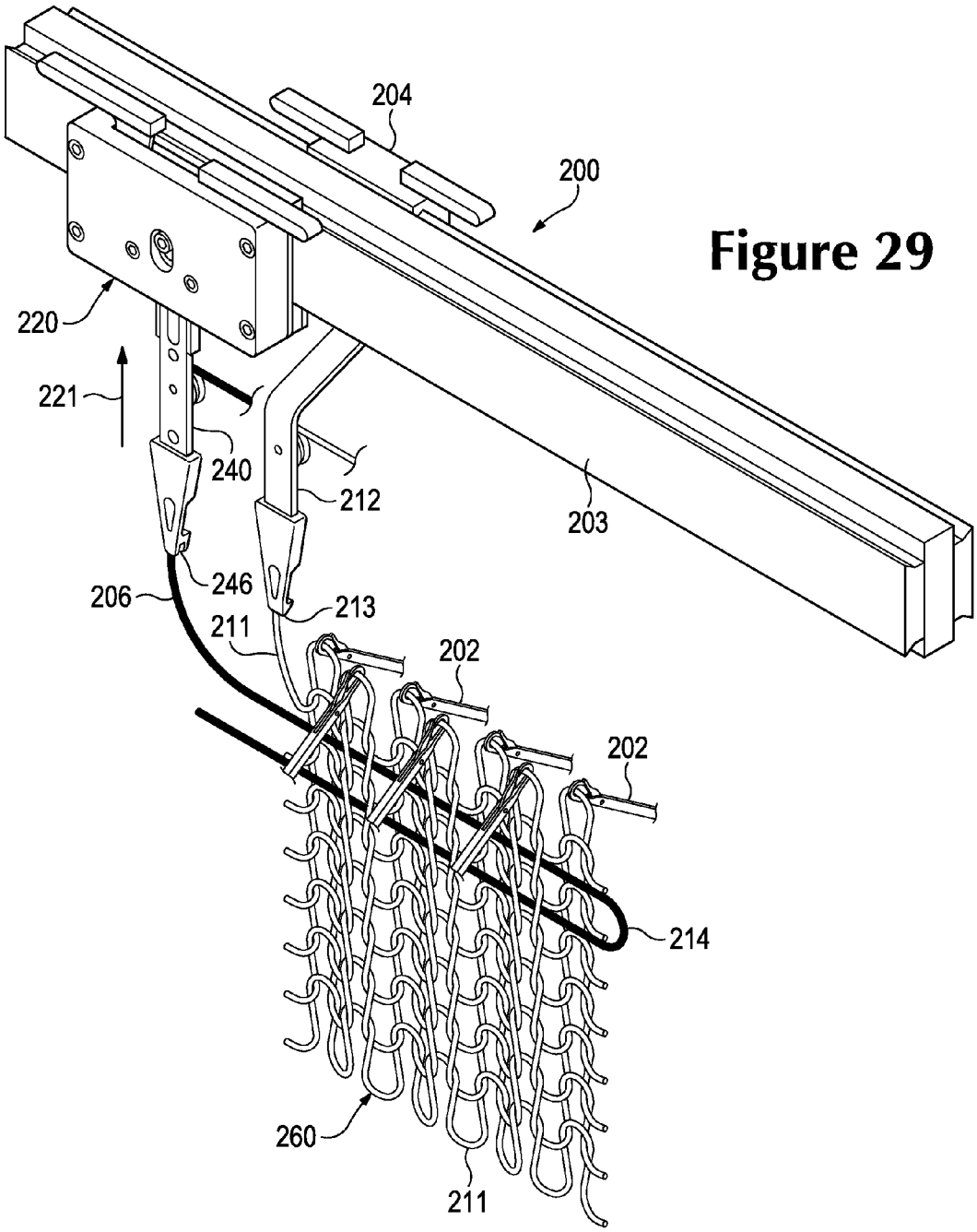

Continuing with the knitting process, feeder arm 240 now translates from the retracted position to the extended position, as depicted in FIG. 27. Combination feeder 220 then moves along rail 203 and yarn 206 is placed between loops of knitted component 260, as depicted in FIG. 28. This effectively places yarn 206 within the course formed by first feeder 204 in FIG. 26. Again, the projections 216, 217 can push aside the yarn 211 in the course to make room for inlaying the yarn 206. In order to complete inlaying yarn 206 into knitted component 260, first feeder 204 moves along rail 203 to form a new course from yarn 211, as depicted in FIG. 29. By forming the new course, yarn 206 is effectively knit within or otherwise integrated into the structure of knitted component 260. At this stage, feeder arm 240 may also translate from the extended position to the retracted position.

Referring to FIG. 29, yarn 206 forms a loop 214 between the two inlaid sections. In the discussion of knitted component 130 above, it was noted that inlaid strand 132 repeatedly exits knit element 131 at perimeter edge 133 and then re-enters knit element 131 at another location of perimeter edge 133, thereby forming loops along perimeter edge 133, as seen in FIGS. 5 and 6. Loop 214 is formed in a similar manner. That is, loop 214 is formed where yarn 206 exits the knit structure of knitted component 260 and then re-enters the knit structure.

Figure 30:
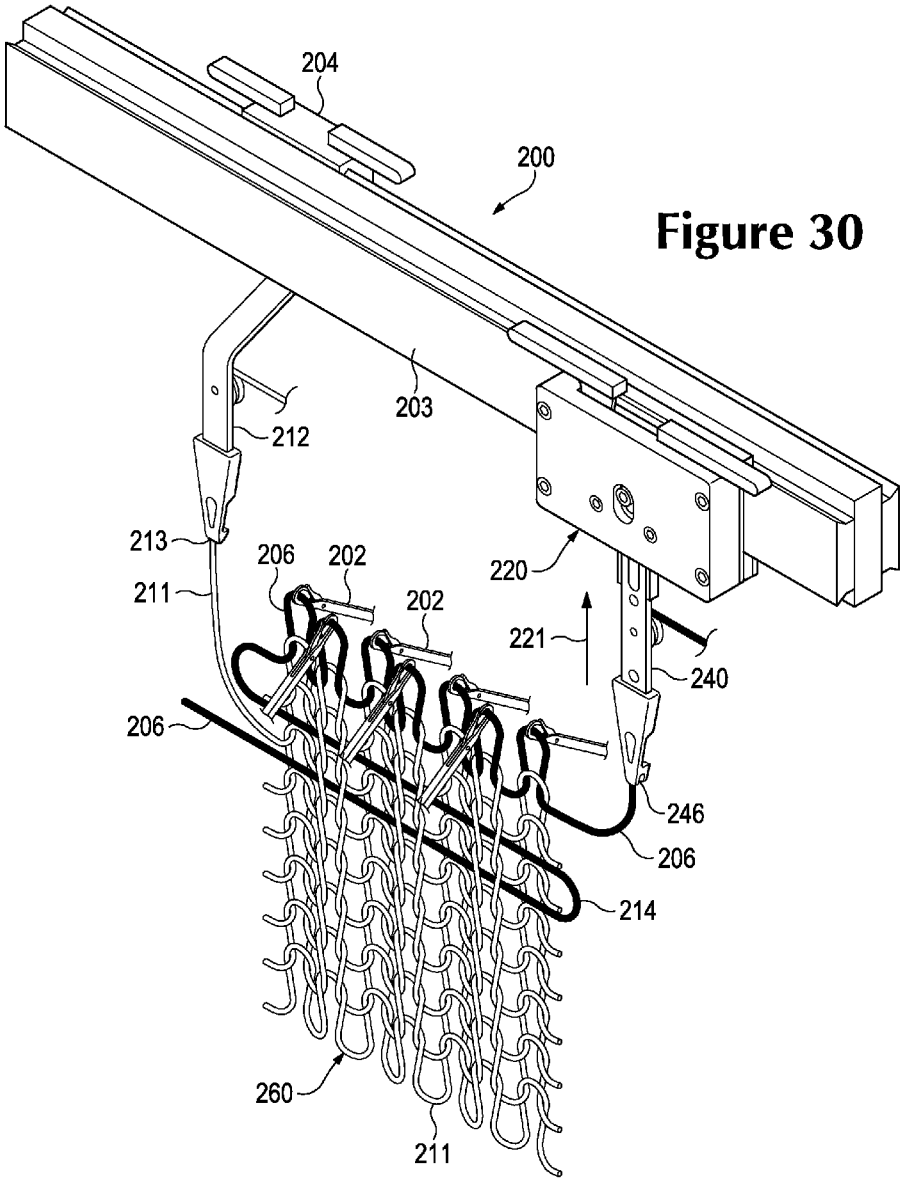

As discussed above, first feeder 204 has the ability to supply a strand (e.g., yarn 211) that needles 202 manipulate to knit, tuck, and float. Combination feeder 220, however, has the ability to supply a yarn (e.g., yarn 206) that needles 202 knit, tuck, or float, as well as inlaying the yarn. The above discussion of the knitting process describes the manner in which combination feeder 220 inlays a yarn while in the extended position. Combination feeder 220 may also supply the yarn for knitting, tucking, and floating while in the retracted position. Referring to FIG. 30, for example, combination feeder 220 moves along rail 203 while in the retracted position and forms a course of knitted component 260 while in the retracted position. Accordingly, by reciprocating feeder arm 240 between the retracted position and the extended position, combination feeder 220 may supply yarn 206 for purposes of knitting, tucking, floating, and inlaying.

Following the knitting processes described above, various operations may be performed to enhance the properties of knitted component 130. For example, a water-repellant coating or other water-resisting treatment may be applied to limit the ability of the knit structures to absorb and retain water. As another example, knitted component 130 may be steamed to improve loft and induce fusing of the yarns.

Although procedures associated with the steaming process may vary greatly, one method involves pinning knitted component 130 to a jig during steaming. An advantage of pinning knitted component 130 to a jig is that the resulting dimensions of specific areas of knitted component 130 may be controlled. For example, pins on the jig may be located to hold areas corresponding to perimeter edge 133 of knitted component 130. By retaining specific dimensions for perimeter edge 133, perimeter edge 133 will have the correct length for a portion of the lasting process that joins upper 120 to sole structure 110. Accordingly, pinning areas of knitted component 130 may be utilized to control the resulting dimensions of knitted component 130 following the steaming process.

The knitting process described above for forming knitted component 260 may be applied to the manufacture of knitted component 130 for footwear 100. The knitting process may also be applied to the manufacture of a variety of other knitted components. That is, knitting processes utilizing one or more combination feeders or other reciprocating feeders may be utilized to form a variety of knitted components. As such, knitted components formed through the knitting process described above, or a similar process, may also be utilized in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted components may also be utilized in bed coverings (e.g., sheets, blankets), table coverings, towels, flags, tents, sails, and parachutes. The knitted components may be utilized as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, knitted components formed through the knitting process described above, or a similar process, may be incorporated into a variety of products for both personal and industrial purposes.

Additional Features for Feeder and Knitting Operations

Figure 43:
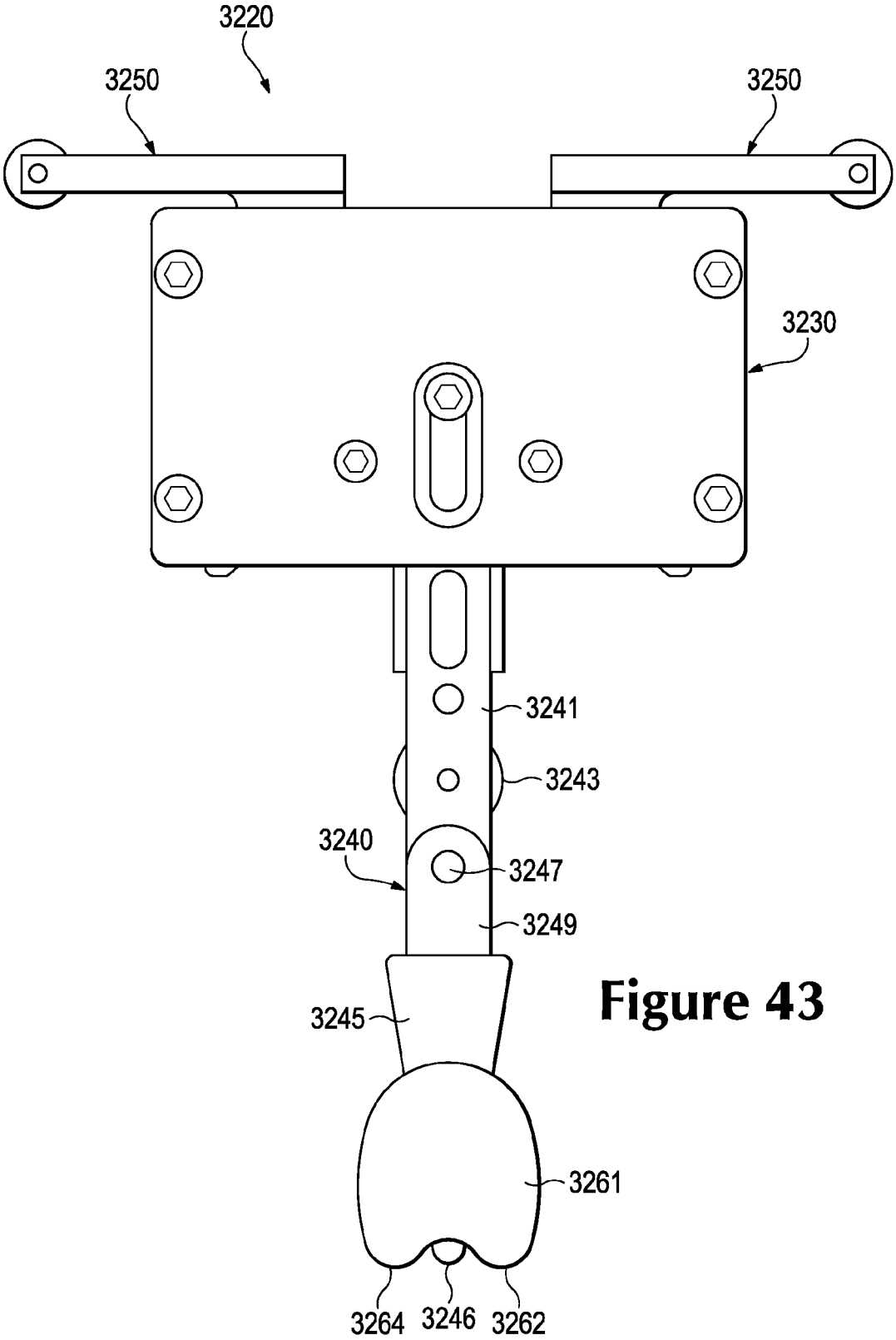
FIG. 43 is an elevational view of a combination feeder according to additional exemplary embodiments of the present disclosure.

Referring now to FIG. 43, additional embodiments of combination feeder 3220 are illustrated. The feeder 3220 can be substantially similar to the feeder 220 discussed above in relation to FIGS. 10-21, except as noted.

As will be discussed, the feeder 3220 of FIG. 43 can include one or more features that assist in knitting processes. For instance, the feeder 3220 can push previously-knitted courses that lie ahead of the dispensing tip of the feeder 3220 relative to the feeding direction of the feeder 3220. It will be appreciated that FIG. 43 is merely exemplary of various embodiments, and the feeder 3220 could vary in one or more ways.

The feeder 3220 can include a feeder arm 3240 having a first portion 3241 and a second portion 3249. The first portion 3241 can be attached to and can extend downward from the carrier 3230. The first portion 3241 can also include the pulley 3243. Additionally, the second portion 3249 can be moveably attached to the first portion 3241. For instance, the first and second portions 3241, 3249 can be pivotally attached via a hinge 3247, a flexible joint, or other suitable coupling. Moreover, the dispensing area 3245 can be attached to the second portion 3249.

The feeder 3220 can also include an enlarged end 3261. In some embodiments, the end 3261 can be bulbous. The end 3261 can be hollow and received over the tapered dispensing area 3245 of the feeder 3220. In additional embodiments, the end 3261 can be integrally attached to the dispensing area 3245. The end 3261 can include one or more projections 3262, 3264 that are rounded and convex. The projections 3262, 3264 can be separated by a gap, and the dispensing tip 3246 can be disposed between the projections 3262, 3264 as shown in FIG. 43. Stated differently, the projections 3262, 3264 can be spaced in opposite directions from the dispensing tip 3246 substantially parallel to the direction of movement of the feeder 3220 along the rails of the knitting machine.

Figure 44:
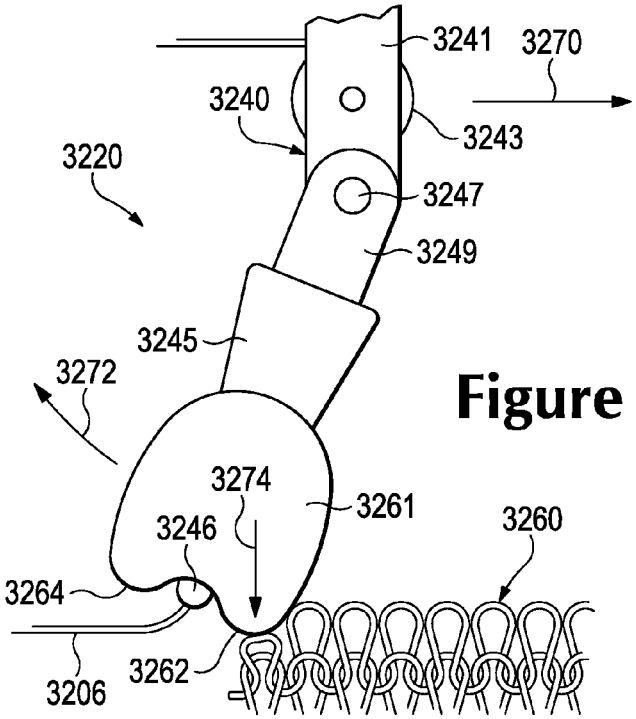
FIGS. 44 and 45 are elevational views of the combination feeder of FIG. 43, shown during use.
Figure 45:
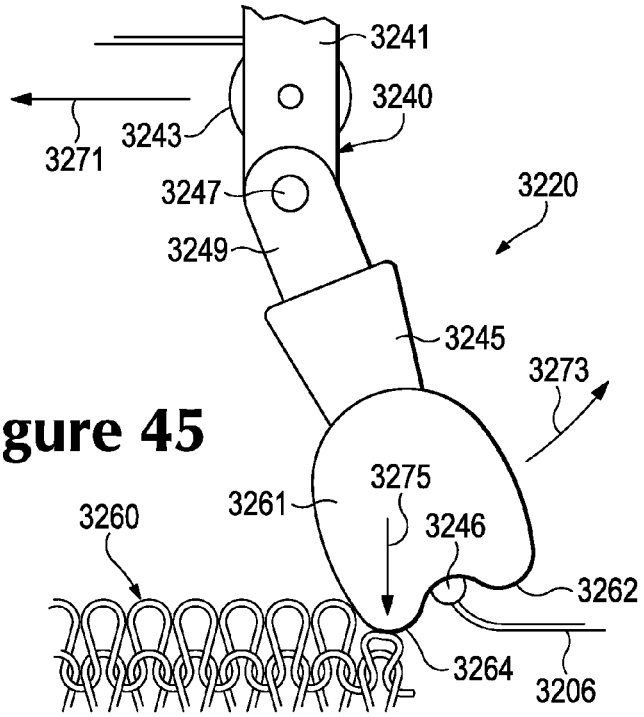

Because the first and second portions 3241, 3249 are moveably attached, the feeder 3220 can have a first position (FIG. 44) and a second position (FIG. 45). The feeder 3220 can move between the first and second positions depending on the feeding direction of the feeder 3220.

For instance, when the feeder 3220 moves in the feeding direction 3270 (FIG. 44), friction between the bulbous end 3261 and the knit component 3260 can push and rotate the second portion 3249 in a clockwise direction as indicated by arrow 3272 in FIG. 44. As the feeder 3220 moves linearly in the feeding direction 3270, the first projection 3262 can push against the previously knit courses of the knit component 3260. More specifically, the first projection 3262 can push the stitches that lie ahead of the dispensing tip 3246 in the feeding direction 3270. Pushing of the first projection 3262 against the stitches of the knit component 3260 is indicated by arrow 3274. As such, the strand 3206 being fed by the feeder 3220 can have sufficient clearance to be incorporated into the knit component 3260. For instance, if the strand 3206 is being inlaid into the knit component 3260, the first projection 3262 can provide clearance for such inlaying.

On the other hand, if the feeder 3220 is moving in the opposite feeding direction as indicated by arrow 3271 in FIG. 45, then friction between the knit component 3260 and the bulbous end 3261 can cause the second portion 3249 to rotate counterclockwise as indicated by arrow 3273. Thus, as the feeder 3220 moves in the feeding direction 3271, the second projection 3264 can push against the stitches lying ahead of the dispensing tip 3246 as indicated by arrow 3275. Accordingly, the second projection 3264 can provide ample clearance for incorporation of the strand 3206 into the knit component 3260.

Thus, the projections 3262, 3264 can push stitching that lies ahead of the dispensing tip 3246 as the feeder 3220 moves for more accurate knitting. Also, it will be appreciated that the knitting machine can include so-called "sinkers" or "knock-overs" that are disposed adjacent the needles in the needle bed. The sinkers can sequentially open as the feeder 3220 moves across the needle bed and these sinkers can sequentially close after the feeder 3220 has passed to push down on the knitted stitches. Because the dispensing tip 3246 is angled away from the direction of movement 3270 of the feeder 3220, the dispensing tip 3246 can be moved closer to the sinkers that are closing behind the feeder 3220. As such, the strand 3206 can be quickly grasped by the closing sinkers and pushed into the knit component 3260. Thus, the strand 3206 is more likely to be inlaid properly into the knit component 3260.

It will be appreciated that movement of the feeder 3220 between its first position (FIG. 44) and its second position (FIG. 45) can be controlled in other ways. For instance, the feeder 3220 can include an actuator and a controller for selectively moving the feeder 3220 between its first and second positions. It will also be appreciated that a single feeder can incorporate one or more features of the embodiments of FIGS. 43-45 as well as the embodiments of FIGS. 10-21 without departing from the scope of the present disclosure.

Take-Down Assembly

Figure 37:
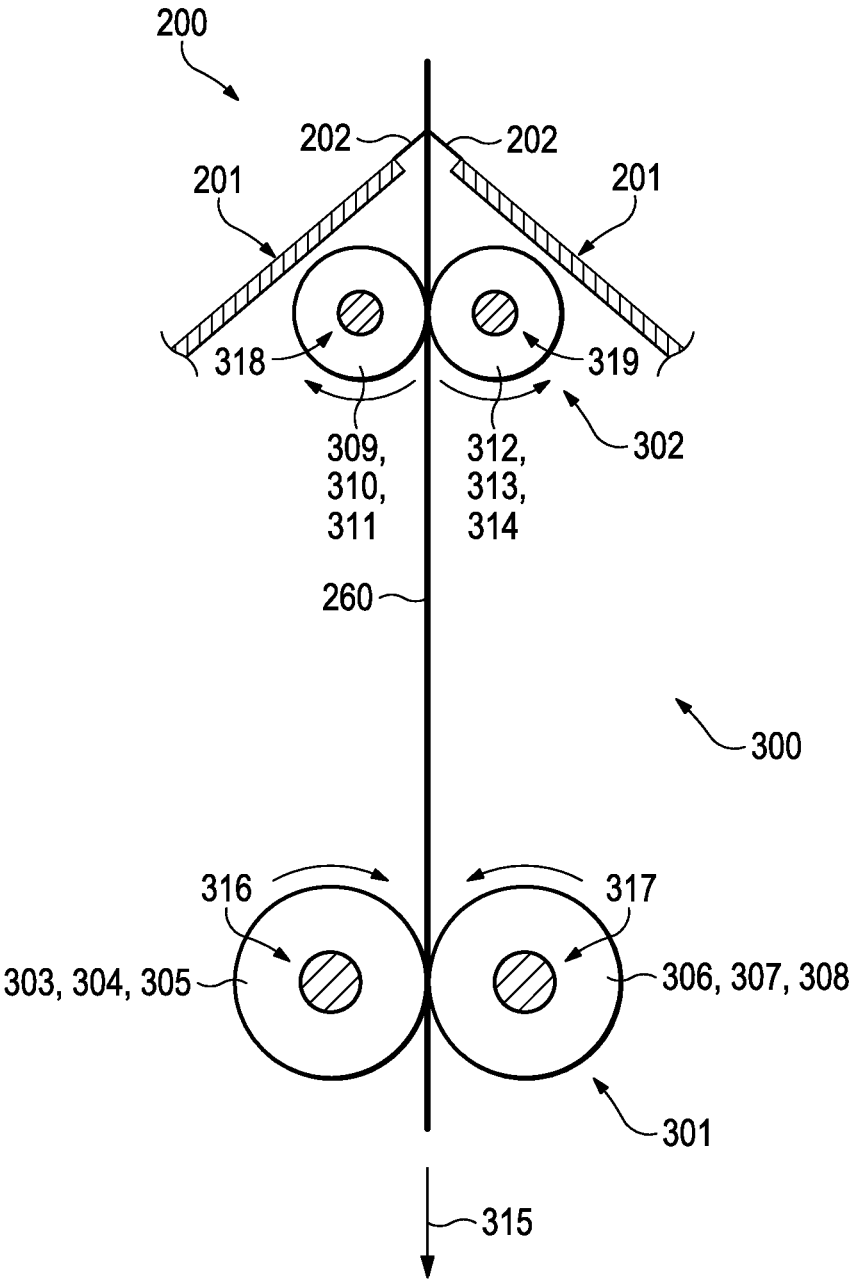
FIG. 37 is a section view of the knitting machine taken along the line 37-37 of FIG. 9 and showing a take-down assembly of the knitting machine according to exemplary embodiments of the present disclosure.

Referring now to FIG. 37, a section view of the knitting machine 200 is shown in simplified form and according to exemplary embodiments of the present disclosure. (FIG. 37 is taken along the line 37-37 of FIG. 9.) As shown, the knitting machine 200 can additionally include a take-down assembly 300, which can advance (e.g., pull, etc.) the knit component 260 away from the needle beds 201. More specifically, the knit component 260 can be formed between the needle beds 201, and the knit component 260 can grow in the downward direction as sequential courses are added at the needle beds 201. The take-down assembly 300 can receive, grasp, pull and/or advance the knit component 260 away from the needle beds 201 as indicated by the downward arrow 315 in FIG. 37. Also, the take-down assembly 300 can apply tension to the knit component 260 as the take-down assembly 300 pulls the knit component 260 from the needle beds 201.

As will be discussed, the take-down assembly 300 can include one or more features that increases the user's control over the tension applied to different portions of the knit component 260 as the knit component 260 is formed at and grows from the needle beds 201. Specifically, the take-down assembly 300 can include a variety of independently controlled and independently actuated members for applying different levels of tension to the knit component 260 along the longitudinal direction along the needle beds 201.

Figure 38:
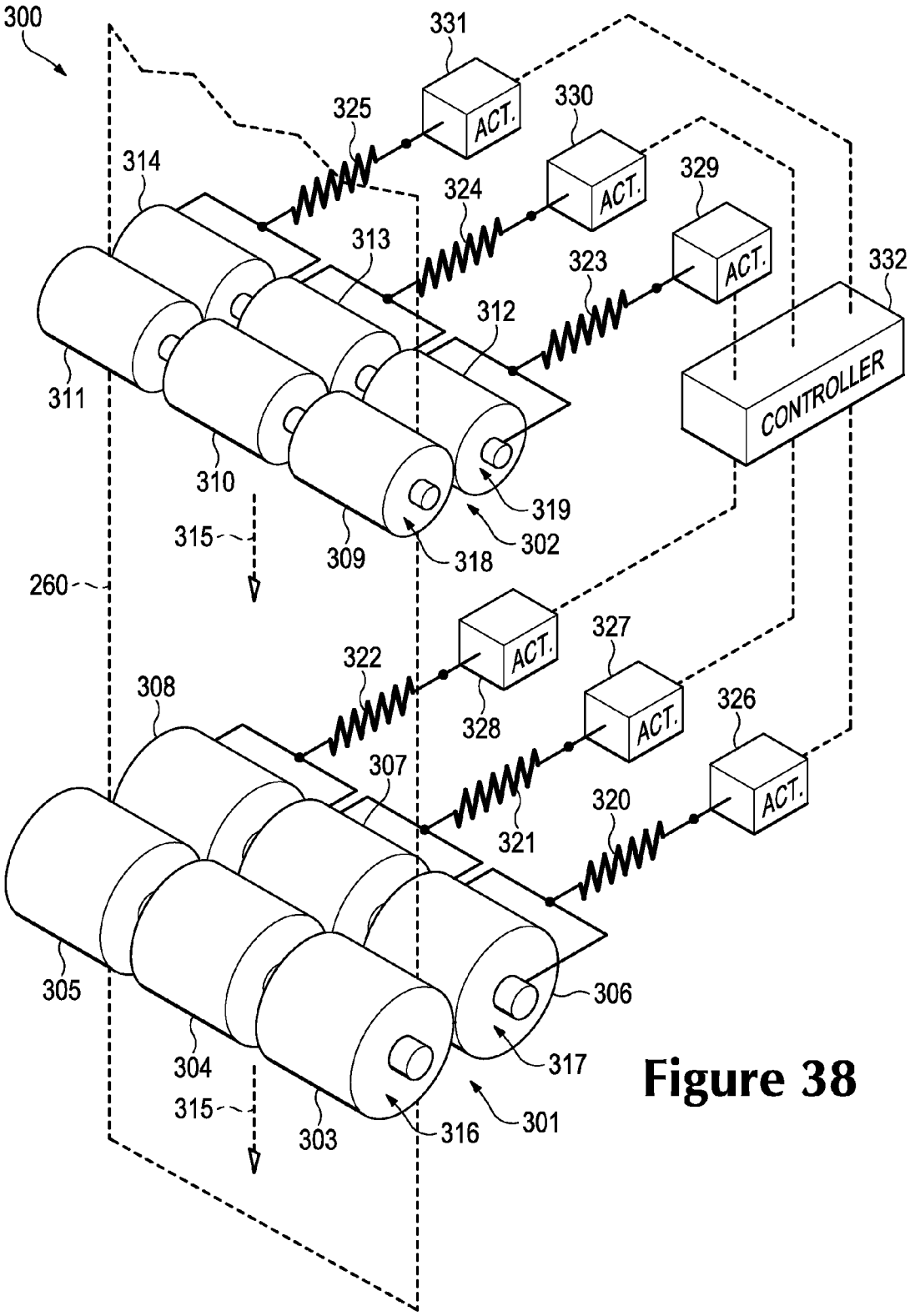
FIG. 38 is a schematic perspective view of groups of rollers of the take-down assembly of FIG. 37.

For instance, the take-down assembly 300 can include a plurality of rollers 303, 304, 305, 306, 307, 308, 309, 310, 311, 312, 313, 314, as shown schematically in FIGS. 37 and 38. The rollers 303-314 can be cylindrical and can include rubber or other material on the outer circumferential surfaces thereof. Also, the rollers 303-314 can include texturing (e.g., raised surfaces) on the outer circumferential surfaces to enhance gripping, or the rollers 313-314 can be substantially smooth. The rollers 303-314 can have any suitable radius (e.g., between approximately 0.25 inches and 2 inches) and can have any suitable longitudinal length (e.g., between approximately 0.5 inches and 5 inches). As will be discussed, the rollers 303-314 can rotate about respective axes of rotation and contact and grip the knit component 360. Because the knit component 360 is held by the needles 201 as the rollers 303-314 rotate, the rotation of the rollers 303-314 can pull and apply tension to the knit component 360.

In the embodiments illustrated in FIG. 38, the knitting machine 200 can include a first group 301 of rollers 303, 304, 305, 306, 307, 308 (main rollers) and a second group 302 of rollers 309, 310, 311, 312, 313, 314 (auxiliary rollers). As shown, rollers 303-305 can be arranged generally in a row 316 that extends substantially parallel to the longitudinal direction of the needle beds 201. Likewise, rollers 306-308 can be arranged in a row 317. Moreover, the outer circumferential surface of roller 303 can oppose that of roller 306. Likewise, roller 304 can oppose roller 307, and roller 305 can oppose roller 308. In the second group 302, rollers 309-311 can be arranged in a row 318, and rollers 312-314 can be arranged in a separate row 319. These rollers 309-314 can be opposingly paired such that roller 309 opposes roller 312, roller 310 opposes roller 313, and roller 311 opposes roller 314.

As shown in the embodiments of FIG. 38, the take-down assembly 300 can further include one or more biasing members 320-325. The biasing members 320-325 can include a compression spring, a leaf spring, or other type of biasing member. The biasing members 320-325 can bias the opposing pairs of rollers 303-314 toward each other. For instance, the biasing member 320 can be operably coupled (e.g., via mechanical linkage, etc.) to an axle of roller 306 such that roller 306 is biased toward the roller 303. Moreover, the biasing member 320 can bias roller 306 toward roller 303 such that the respective axes of rotation remain substantially parallel, but spaced apart. Likewise, biasing member 321 can bias roller 307 toward roller 304, biasing member 322 can bias roller 308 toward roller 305, biasing member 323 can bias roller 312 toward roller 309, biasing member 324 can bias roller 313 toward roller 310, and biasing member 325 can bias roller 314 toward roller 311. The outer circumferential surfaces of these opposing pairs of rollers can press against each other due to the respective biasing members 320-325.

Moreover, the take-down assembly 300 can include a plurality of actuators 326-331. The actuator 312 can include an electric motor, a hydraulic or pneumatic actuator, or any other suitable type of automated actuating mechanism. The actuators 326-331 can also include a servomotor in some embodiments. As shown in FIG. 38, actuator 326 can be operably coupled to the biasing member 320, the actuator 327 can be operably coupled to the biasing member 321, the actuator 328 can be operably coupled to the biasing member 322, the actuator 329 can be operably coupled to the biasing member 323, the actuator 330 can be operably coupled to the biasing member 324, and the actuator 331 can be operably coupled to the biasing member 325. The actuators 326-331 can actuate to selectively adjust the biasing load of the respective biasing members 320-325. For instance, the actuators 326-331 can actuate to change the length of springs of the biasing members 320-325 for such adjustment of the biasing loads according to Hooke's law. The term "biasing load" is to be interpreted broadly to include biasing force, spring stiffness, and the like. Accordingly, compression between opposing pairs of the rollers 303-314 can be selectively adjusted.

The actuators 326-331 can be operably coupled to a controller 332. The controller 332 can be included in a personal computer and can include programmed logic, a processor, a display, input devices (e.g., a keyboard, a mouse, a touch-sensitive screen, etc.), and other related components. The controller 332 can send electric control signals to the actuators 326-331 to control actuations of the actuators 326-331. It will be appreciated that the controller 332 can control the actuators 326-331 independently. Accordingly, the biasing force, spring stiffness, etc. can vary among the biasing members 320-325. Thus, as will be described, the tension across the knit component 260 can be varied as will be discussed, allowing different stitch types to be incorporated across the knit component 260, allowing some stitched areas to be pulled tighter than others, and the like.

Operation of the take-down assembly 300 will now be discussed. As shown generally in FIG. 37, the knit component 260 can grow in a downward direction as courses are added. Thus, the knit component 260 can be received, initially, between the rows 318, 319 of rollers 309-314. As the knit component 260 continues to grow, the knit component 260 can be received between the rows 316, 317 of rollers 303-308.

Also, because the pairs of opposing rollers 303-314 are spaced along the longitudinal direction of the needle beds 201, different pairs of rollers 303-314 contact and advance different portions of the knit component 260. Biasing loads of the biasing members 320-325 can be independently controlled such that tension is applied in a desired manner to each portion of the knit component 260.

FIGS. 39-42 show these operations in more detail. For purposes of clarity, only the rollers 309-314 are shown; however, it will be appreciated that the other rollers of the take-down assembly 300 could be used in a related manner. In the embodiments of FIGS. 39-42, the rollers 309-314 rotate continuously; however, the biasing loads applied by the biasing members 323-325 are independently adjusted.

Figure 39:
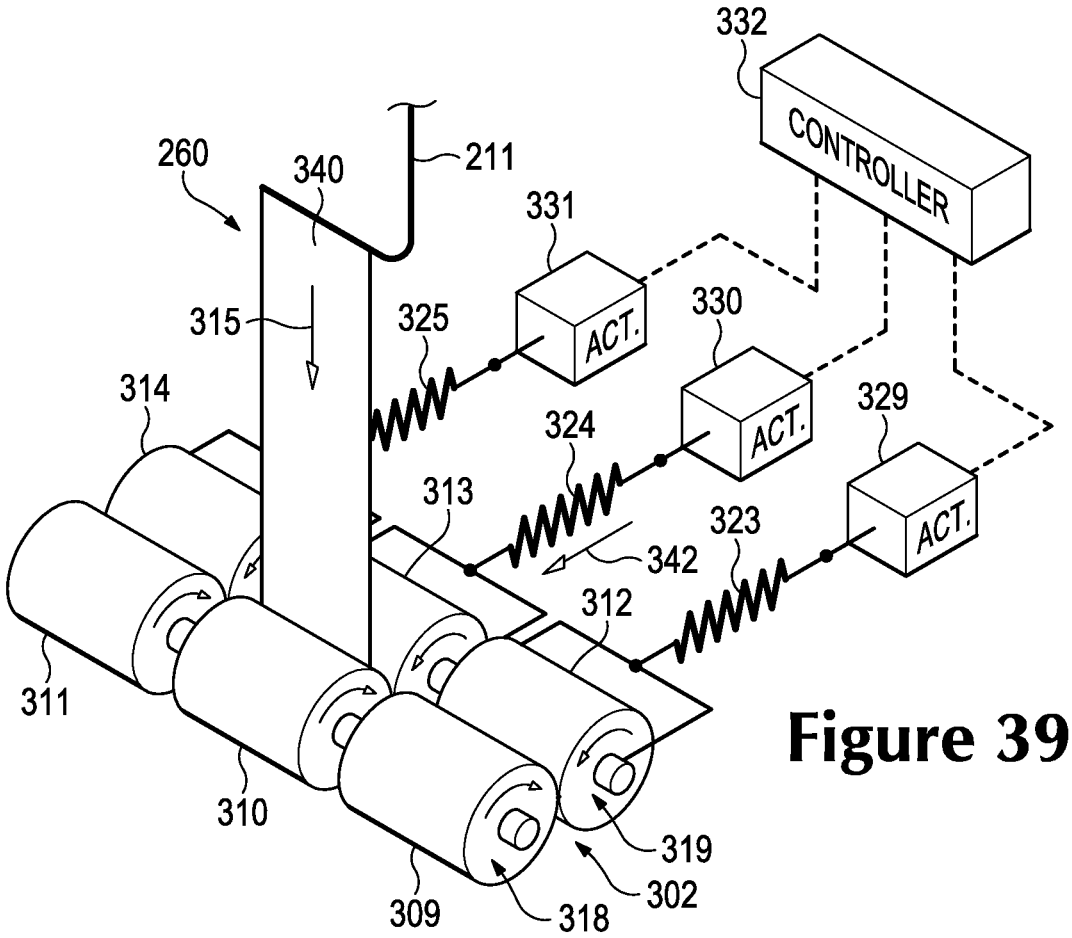
FIGS. 39-42 are perspective views of the group of rollers of the take-down assembly shown during operation according to exemplary embodiments of the present disclosure.

As shown in FIG. 39, a first portion 340 of the knit component 260 is formed above the opposing pairs of rollers 310, 313. Stated differently, the yarn 211 is knit into the first portion 340 at a knitting area immediately above the rollers 310, 313. Once the first portion 340 has grown enough to be received between the rollers 310, 313, the actuator 330 actuates to increase the biasing load applied by the biasing member 324 to a predetermined level, and the rollers 310, 313 can firmly grip and advance the first portion 340. This is indicated by the arrow 342 in FIG. 39. Accordingly, the rollers 310, 313 can pull the first portion 340 from the needle beds 201 at a desired tension to facilitate knitting of the first portion 340. Meanwhile, the other rollers 309, 311, 312, 314 rotate, but the biasing loads 323, 325 applied by the biasing members 323, 325 remain relatively low.

Figure 40:
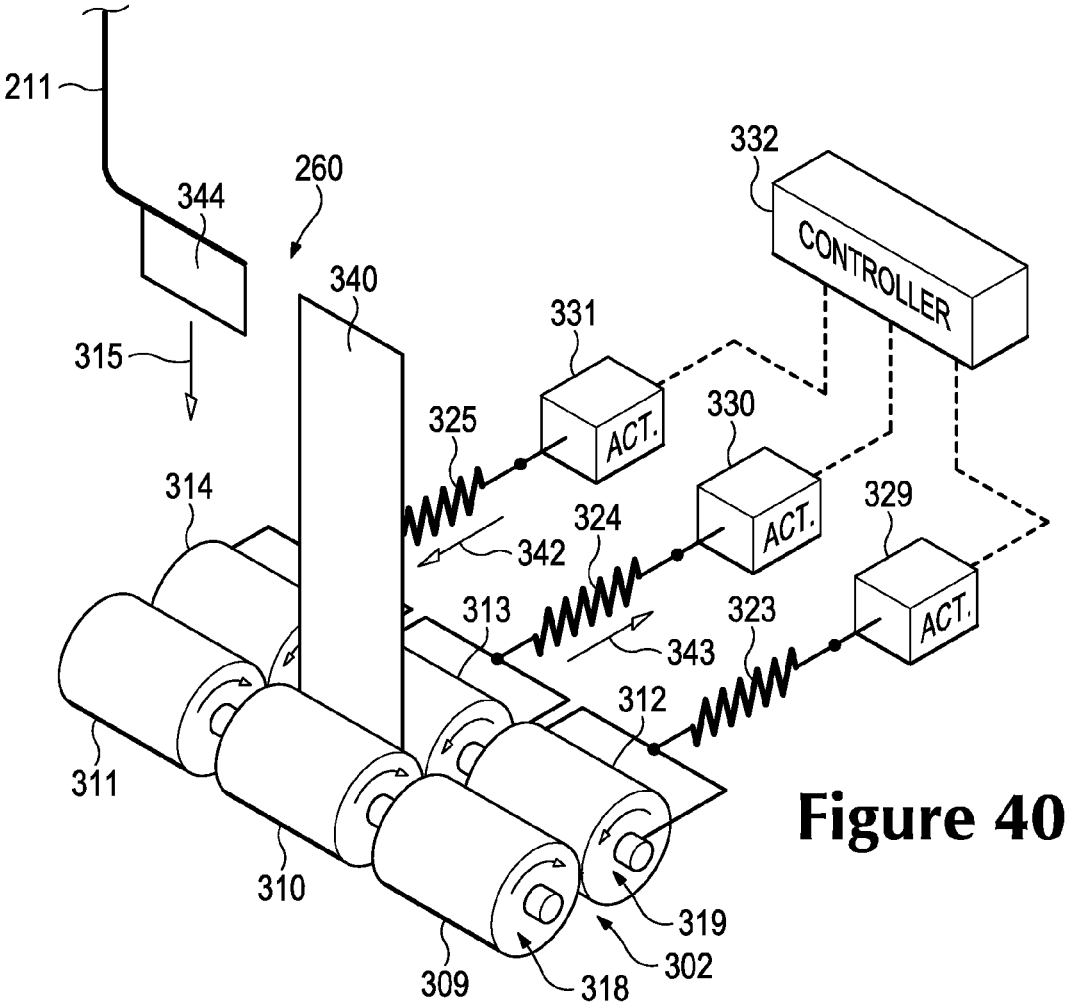
Figure 41:
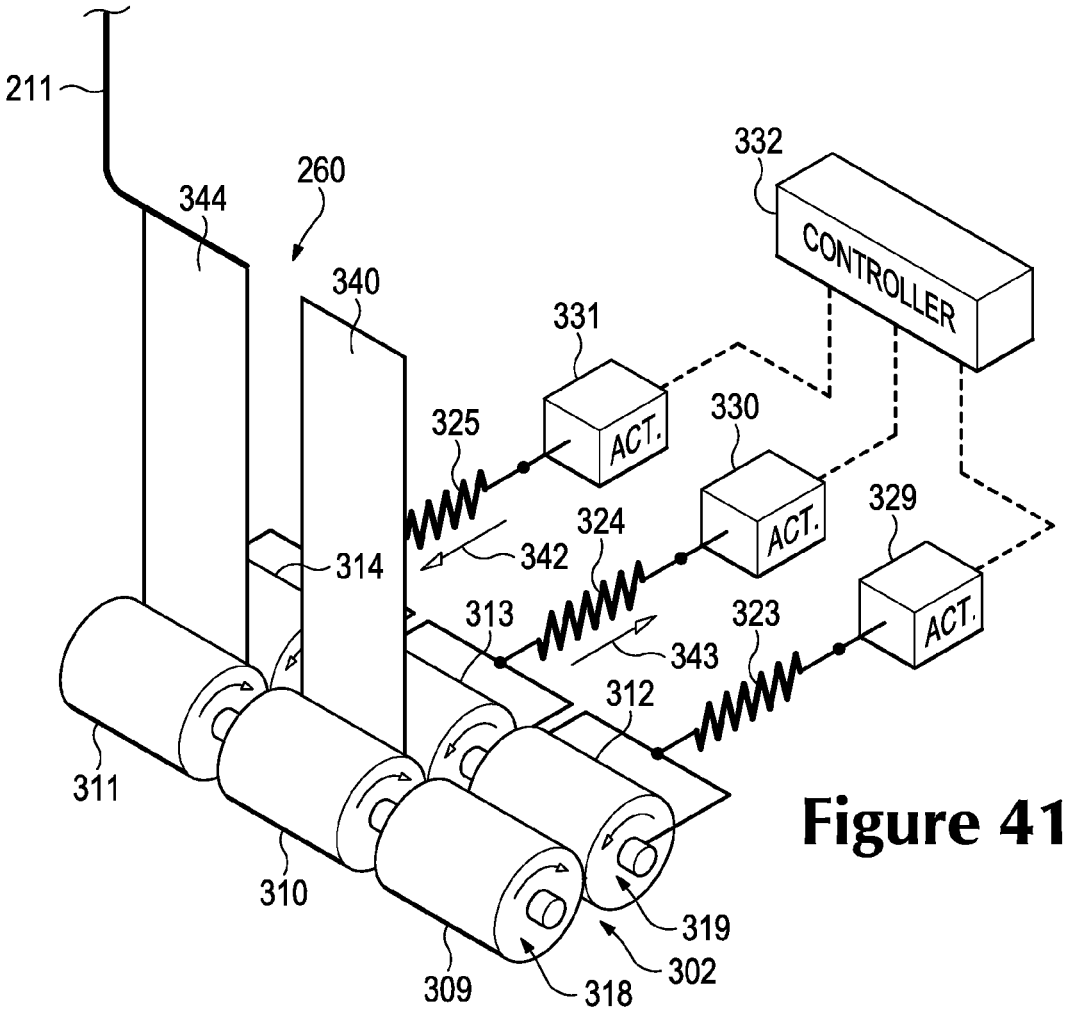

Subsequently, as shown in FIG. 40, a second portion 344 of the knit component 260 can begin to be formed at an area of the needle beds 201 immediately above the pair of rollers 311, 314. The second portion 344 can grow to eventually be received between rollers 311, 314 as shown in FIG. 41. As shown in FIGS. 40 and 41, the actuator 331 can actuate to increase the biasing load applied by the biasing member 325 to a predetermined level. This is indicated by arrow 342 in FIGS. 40 and 41. Meanwhile, the first portion 340 of the knit component 260 can be held stationary relative to the rollers 310, 313 (and held stationary at the area of the needle bed 201 immediately above rollers 310, 313). To keep the first portion 340 stationary and, yet, at a desirable tension, the actuator 330 can actuate to reduce the biasing load applied by the biasing member 324 on the rollers 310, 313. This is indicated by the arrow 343 in FIG. 40. By reducing the biasing load, the rollers 310, 313 can rotate and slip on the respective surfaces of the first portion 340 without advancing the first portion 340 away from the needle beds 201.

Figure 42:
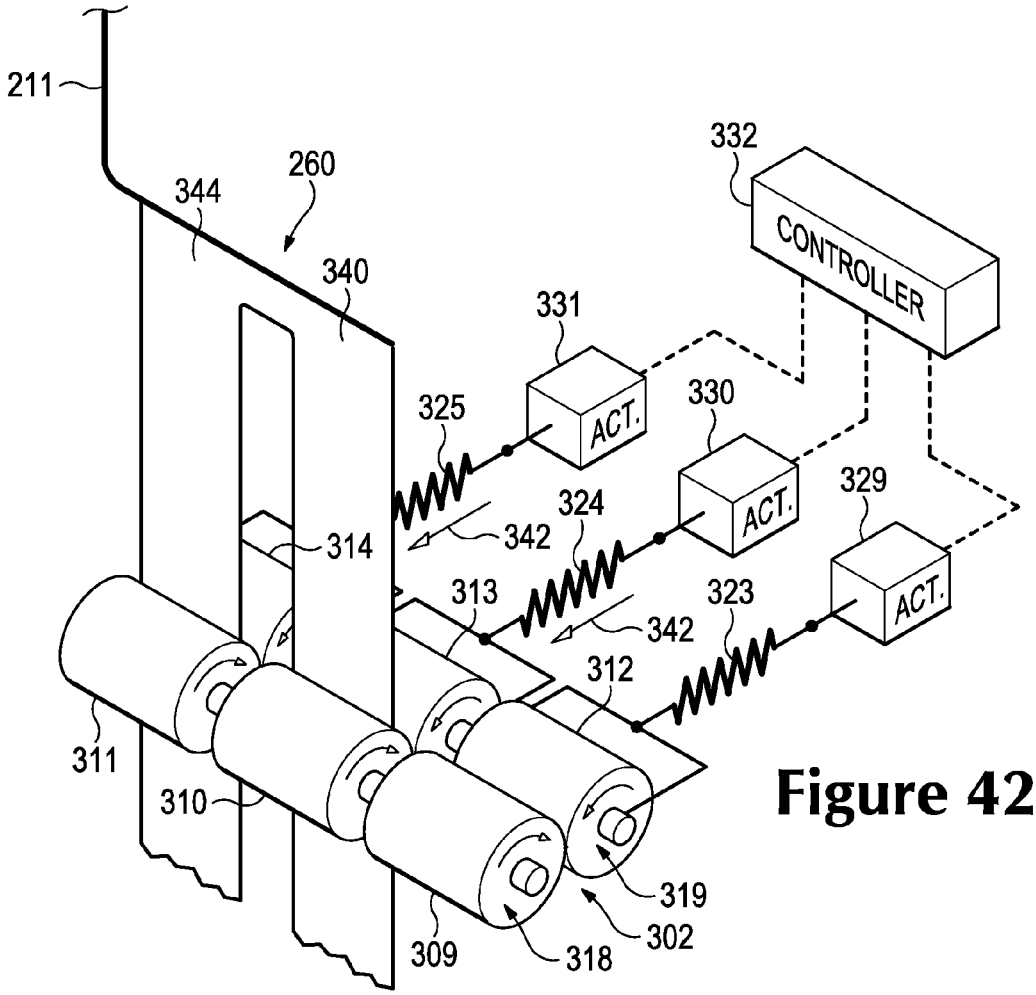

Then, as shown in FIG. 42, the yarn 211 can knit one or more courses to join the first and second portions 340, 344 together. The actuators 330, 331 can both actuate to increase the biasing loads applied by the biasing members 324, 325, respectively. Accordingly, the rollers 310, 313 can more tightly grip the first portion 340 of the knit component 260, and the rollers 311, 314 can grip the second portion 344 to further advance the knit component 260 and pull the knit component 260 at the desired tension from the needle beds 201.

These manufacturing techniques can be employed, for instance, when forming an upper of an article of footwear, such as the knit components described above. For instance, the first portion 340 shown in FIGS. 39-42 can represent a tongue of the article of footwear, and the second portion 344 can represent a medial or lateral portion of the upper that becomes integrally attached to the tongue. Stated differently, the techniques can be employed to form a one-piece upper in which the tongue and surrounding portions of the upper are joined by at least one common, continuous course at the throat area of the upper. Examples of such an upper are disclosed in U.S. patent application Ser. No. 13/400,511, filed Feb. 20, 2012, which is hereby incorporated by reference in its entirety. These techniques can also be employed where the knit component 260 is a knitted fabric that spans across the needle bed 201, and the different portions 340, 344 are pulled from the needle beds 201 at different tensions by the take-down assembly 300.

It will be understood that when the rollers 303-314 increase tension on the respective portions 340, 344 of the knit component 260, stitching in those portions 340, 344 can be tighter and "cleaner." On the other hand, decreasing tension on the respective portions 340, 344 can allow the stitches to be looser. As such, adjusting tension applied by the rollers 303-314 of the take-down assembly 300 can affect the look, feel, and/or other features of the knit component 260. Also, tension applied by the rollers 303-314 can be varied to allow different types of yarns (e.g., yarns of different diameter) to be incorporated into the knit component 260.

Furthermore, it will be appreciated that the circumferential surfaces of the rollers 303-314 can roll evenly and continuously over the sides of the knit component 260 to advance the knit component 260. As such, compressive and tangential loading from the rollers 303-314 can be distributed evenly over the surface of the knit component 260. As a result, knitting can be completed in a highly controlled manner.

Additional embodiments of the take-down assembly are shown in FIGS. 32-36. Although shown separately, it will be appreciated that one or more features of the take down assembly of FIGS. 32-42 can be combined.

Figure 32:
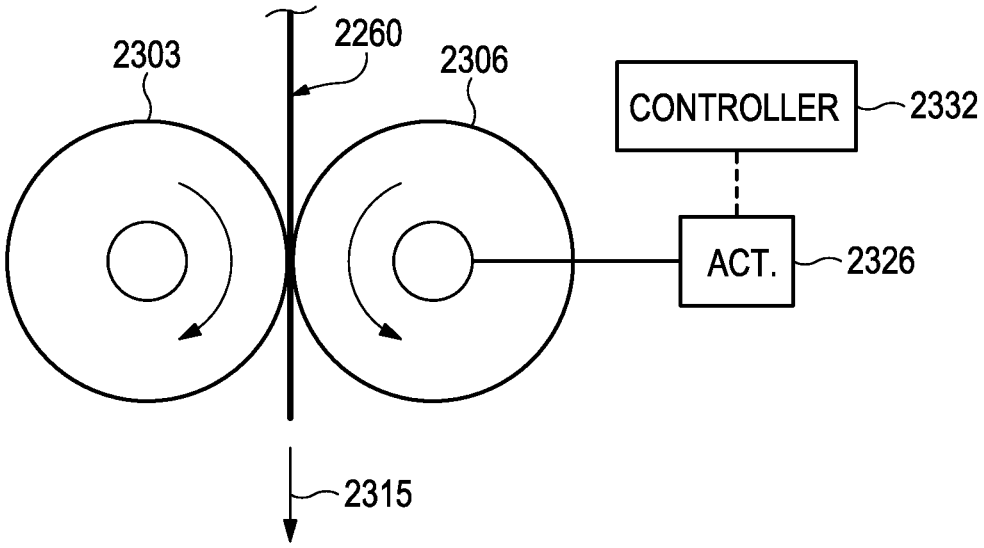
FIG. 32 is an end view of a group of rollers of the take-down assembly of the knitting machine of FIG. 9.

Also, for purposes of simplicity, FIG. 32 illustrates one pair of opposing rollers 2303, 2306 that can be incorporated in the assembly. As shown, the roller 2306 can be operably coupled to an actuator 2326. The actuator 2326 can be configured to drivingly rotate the roller 2306 about its axis of rotation. This can cause rotation of the roller 2303 due to compression between the two rollers 2306, 2303. Like the embodiments of FIGS. 38-42, the actuator 2326 can include an electric motor, a pneumatic actuator, a hydraulic actuator, and the like. Also, the actuator 2326 can be a hub motor such that the roller 2306 rotates about a housing of the actuator 2326. The actuator 2326 can be controlled via a controller 2332, similar to the embodiments of FIGS. 38-42.

Figure 33:
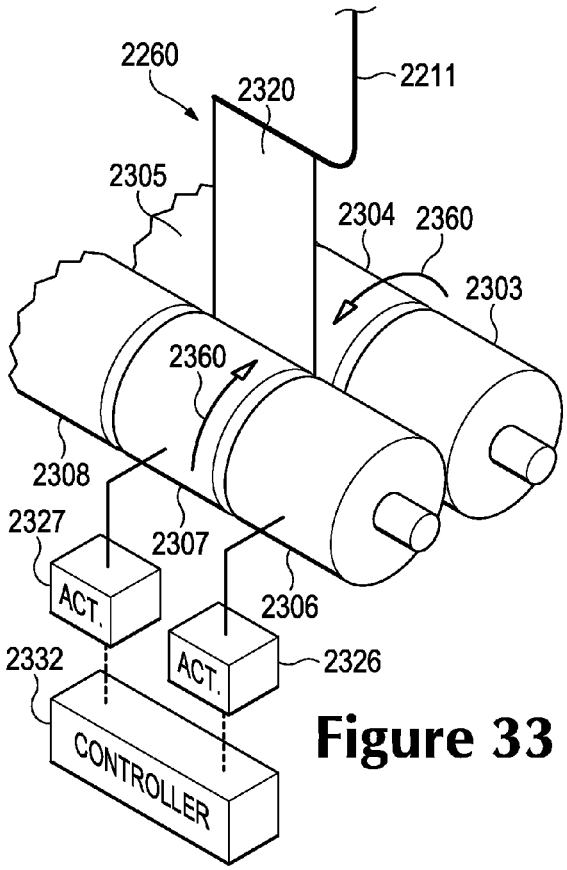
FIGS. 33-36 are perspective views of the group of rollers of the take-down assembly shown during operation according to exemplary embodiments of the present disclosure.

FIG. 33 shows how the configuration of FIG. 32 can be employed for a plurality of rollers 2303-2306 of the take-down assembly. As shown, each of rollers 2306, 2307 can be drivingly rotated by separate, respective actuators 2326, 2327. Also, the actuators 2326, 2327 can be controlled by controller 2332. As will be discussed, the controller 2332 can control the actuators 2326, 2327 to drivingly rotate the rollers 2306, 2307 at different speeds. For instance, roller 2306 can be driven faster than the roller 2307, or vice versa. Also, roller 2306 can be driven in rotation while the roller 2307 remains substantially stationary, or vice versa.

FIGS. 33-36 show a sequence of operations of the take-down assembly, wherein the rollers 2306, 2307 are independently rotated. As shown in FIG. 33, the roller 2307 can be driven in rotation by the respective actuator 2327 to advance the portion 2320 of the knit component 2260 between rollers 2307, 2304 and to pull the portion 2320 at a desired tension from the area of the needle beds 201 directly above. This driving rotation of the rollers 2307, 2304 is indicated by arrows 2360 in FIG. 33. This rotation can occur while the roller 2306 remains substantially stationary.

Figure 34:
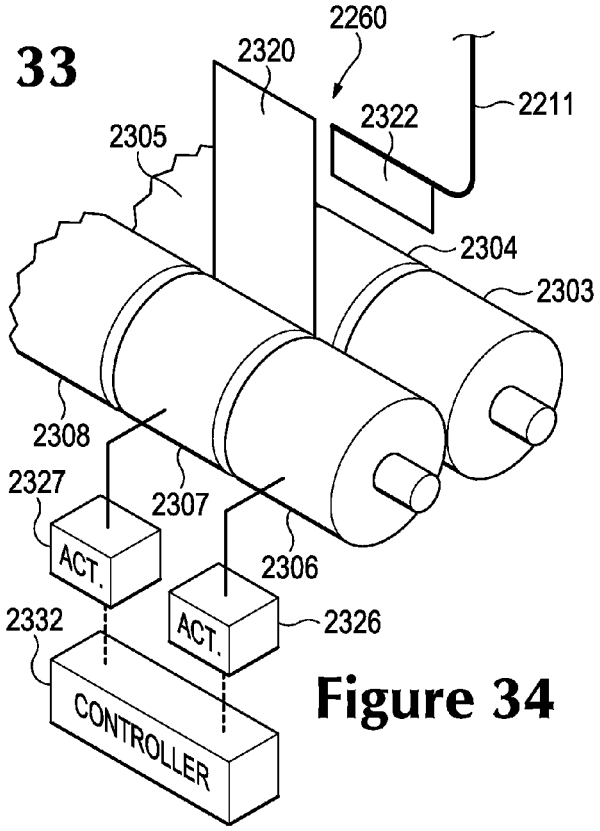
Figure 35:
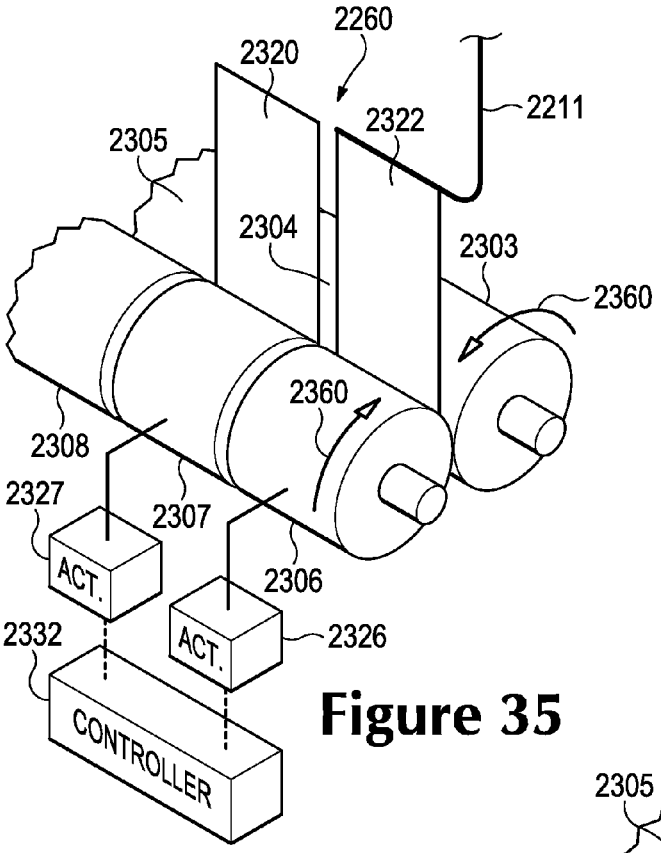

Then, once the portion 2320 of the knit component 260 has reached a predetermined length (i.e., sufficient courses of the yarn 211 have been added to the portion 320), the rollers 2307, 2304 can discontinue rotating. As shown in FIG. 34, another portion 2322 of the knit component 260 can begin to be formed.

Once the portion 2322 is long enough to reach the rollers 2306, 2303, the roller 2306 can be driven in rotation by the respective actuator 2326. This rotation is represented by the two curved arrows 2360 in FIG. 35. The yarn 2211 can continue to be knit into or otherwise incorporated into the portion 2322. The rollers 2306, 2303 can also rotate while the rollers 2307, 2304 remain substantially stationary.

Figure 36:
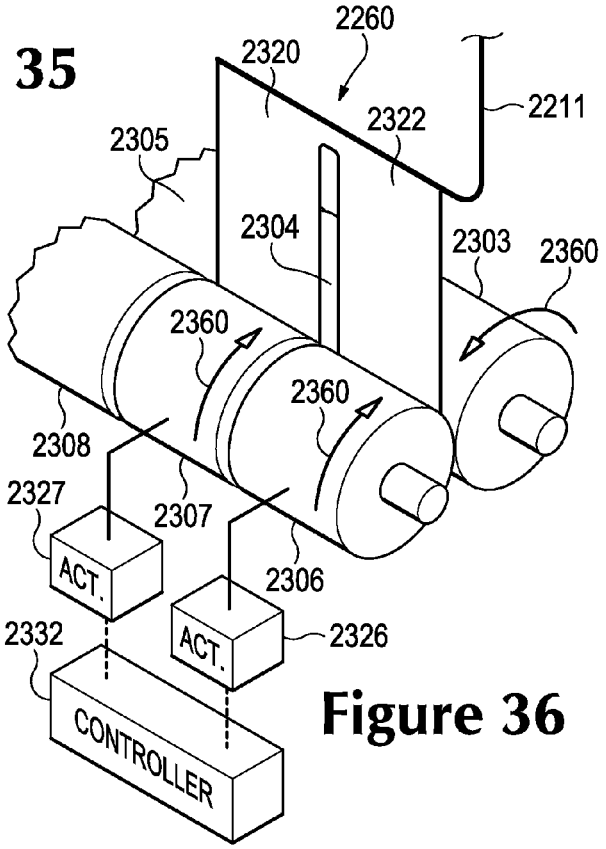

Once the portion 2322 has reached a predetermined length, the pairs of rollers 2303, 2306, 2304, 2307 can rotate together. This can occur while the yarn 2211 is incorporated into both the portions 2320, 2322. Stated differently, the yarn 2211 can be knit into one or more continuous courses that connect the portions 2320, 2322 as shown in FIG. 36.

It will also be appreciated that one opposing pair of the rollers 2303, 2306 can be drivingly rotated faster than another opposing pair of rollers 2304, 2307 such that the portion 2322 is pulled at a higher tension than the portion 2320. Accordingly, the stitches in the portion 2322 can be more tightly formed than those of the portion 2320.

Accordingly, the take-down assemblies disclosed herein can allow the knit component to be formed in a highly controlled manner. This can facilitate manufacture of a high quality, highly durable, and aesthetically pleasing knit component.

The present disclosure is discussed in detail above and in the accompanying figures with reference to a variety of configurations. The purpose served by the discussion, however, is to provide an example of the various features and concepts related to the disclosure, not to limit the scope of the same. One skilled in the relevant art will recognize that numerous variations and modifications may be made to the configurations described above without departing from the scope of the present disclosure, as defined by the appended claims.

What is claimed is:

1. A knitting machine configured for knitting a knit component having a first portion and a second portion, the knitting machine comprising:

a knitting bed with a plurality of knitting needles that are arranged along a longitudinal direction, the knitting bed defining a first knitting area and a second knitting area that are spaced apart in the longitudinal direction, the first knitting area configured to form the first portion of the knit component, the second knitting area configured to form the second portion of the knit component;

a take-down assembly that includes a first take-down roller and a second take-down roller, the first take-down roller configured to rotate at a variable first speed while contacting the first portion of the knitted component to apply tension to the first portion of the knit component, the second take-down roller configured to rotate at a variable second speed while contacting the second portion of the knitted component to apply tension to the second portion of the knit component;

a first actuator that is configured to actuate to selectively adjust the first speed of the first take-down roller for varying tension on the first portion of the knit component;

a second actuator that is configured to actuate to selectively adjust the second speed of the second take-down roller for varying tension on the second portion of the knit component; and a controller that is operably coupled to the first actuator and the second actuator to selectively and independently control actuation of the first actuator and the second actuator, wherein the controller controls the first and second actuators to rotate the first and second take-down rollers at different speeds while forming at least one of the first and second portions of the knit component.

2. The knitting machine of claim 1, wherein the first take-down roller is paired with a first opposing take-down roller that rotates in tandem with the first take-down roller, the first take-down roller and the first opposing take-down roller being configured to receive the first portion of the knit component therebetween, the first take-down roller and the first opposing take-down roller being configured to cooperatively pull the first portion of the knit component away from the first knitting area to apply tension to the first portion of the knit component.

3. The knitting machine of claim 2, further comprising a first biasing member that biases at least one of the first take-down roller and the first opposing take-down roller toward the other of the first take-down roller and the first opposing take-down roller.

4. The knitting machine of claim 1, wherein at least one of the first actuator and the second actuator includes an electric motor.

5. The knitting machine of claim 1, wherein the controller is operably coupled to the first actuator and the second actuator to selectively rotate the first take-down roller faster than the second take-down roller.

6. The knitting machine of claim 5, wherein the controller is operably coupled to the first actuator and the second actuator to selectively rotate the first take-down roller while the second take-down roller is stationary.

7. The knitting machine of claim 1, wherein the knitting machine is a flat knitting machine.

8. A method of knitting a knit component comprising:

providing a knitting bed with a plurality of knitting needles that are arranged along a longitudinal direction, the knitting bed defining a first knitting area and a second knitting area that are spaced apart in the longitudinal direction;

providing a take-down assembly that includes a first take-down roller and a second take-down roller;

knitting a first portion of the knit component in the first knitting area to a first predetermined length;

knitting a second portion of the knit component in the second knitting area;

rotating the first take-down roller at a first speed using a first actuator to apply tension to the first portion of the knit component while the first take-down roller contacts the first portion of the knitted component;

rotating the second take-down roller at a second speed using a second actuator to apply tension to the second portion of the knit component while the second take-down roller contacts the second portion of the knitted component;

controlling the first actuator to vary the first speed of the first take-down roller to vary tension on the first portion of the knit component when the first portion has reached the first predetermined length; and controlling the second actuator independent of the first actuator to vary the second speed of the second take-down roller and to vary tension on the second portion of the knit component.

9. The method of claim 8, wherein controlling the second actuator includes controlling the second actuator to rotate the second take-down roller faster than the first take-down roller.

10. The method of claim 9, wherein controlling the second actuator includes controlling the second actuator to rotate the second take-down roller while the first take-down roller is stationary.

11. The method of claim 8, further comprising:

providing a first opposing take-down roller; and rotating the first opposing take-down roller and the first take-down roller in tandem to cooperatively pull the first portion of the knit component away from the first knitting area and to apply tension to the first portion of the knit component using both the first take-down roller and the first opposing take-down roller.

12. The method of claim 11, further comprising providing a biasing member that biases at least one of the first take-down roller and the first opposing take-down roller toward the other of the first take-down roller and the first opposing take-down roller.

13. The method of claim 8, wherein at least one of the first actuator and the second actuator includes an electric motor.

14. The method of claim 8, further comprising providing a flat knitting machine that includes the knitting bed and the take-down assembly.

15. The method of claim 8, wherein controlling the first actuator includes controlling the first actuator to reduce the first speed of the first take-down roller when the first portion has reached the first predetermined length.

16. The method of claim 8, wherein controlling the first actuator includes controlling the first actuator to stop rotation of the first take-down roller when the first portion has reached the first predetermined length.

17. The method of claim 16, further comprising knitting the second portion when the first portion has reached the first predetermined length.

18. The method of claim 17, further comprising knitting to join the first portion and the second portion together; and further comprising controlling the first and second actuators to rotate both the first take-down roller and the second take-down roller after joining the first portion and the second portion together.

19. The method of claim 18, wherein controlling the first and second actuators includes rotating the first take-down roller faster than the second take-down roller.

20. A knitting machine configured for knitting a knit component having a first portion and a second portion, the knitting machine comprising:

a knitting bed with a plurality of knitting needles that are arranged along a longitudinal direction, the knitting bed defining a first knitting area and a second knitting area that are spaced apart in the longitudinal direction, the first knitting area configured to form the first portion of the knit component, the second knitting area configured to form the second portion of the knit component;

a take-down assembly that includes a first take-down roller and a second take-down roller, the first take-down roller configured to rotate at a variable first speed while contacting the first portion of the knitted component to apply tension to the first portion of the knit component, the second take-down roller configured to rotate at a variable second speed while contacting the second portion of the knitted component to apply tension to the second portion of the knit component, wherein the first speed is different than the second speed;

a first actuator that is configured to actuate to selectively adjust the first speed of the first take-down roller for varying tension on the first portion of the knit component;

a second actuator that is configured to actuate to selectively adjust the second speed of the second take-down for varying tension on the second portion of the knit component; and a controller that is operably coupled to the first actuator and the second actuator to selectively and independently control actuation of the first actuator and the second actuator.

* * * * *